US005449593A

United States Patent [19]

Morigaki et al.

[11] Patent Number: 5,449,593

[45] Date of Patent: * Sep. 12, 1995

[54] PROCESSING SOLUTION FOR SILVER HALIDE COLOR PHOTOGRAPHIC MATERIALS AND METHOD FOR PROCESSING THE MATERIALS WITH USE OF THE PROCESSING SOLUTIONS

[75] Inventors: Masakazu Morigaki; Hiroshi Kawamoto; Shigeru Nakamura, all of Kanagawa, Japan

[73] Assignee: Fuji Photo Film Co., Ltd., Kanagawa, Japan

[ * ] Notice: The portion of the term of this patent subsequent to Dec. 14, 2010 has been disclaimed.

[21] Appl. No.: 838,963

[22] Filed: Feb. 21, 1992

[30] Foreign Application Priority Data

Feb. 22, 1991 [JP] Japan ..... 3-048679
May 20, 1991 [JP] Japan ..... 3-142708

[51] Int. Cl.[6] ..... G03C 7/407

[52] U.S. Cl. ..... 430/372; 430/393; 430/401; 430/427; 430/428; 430/429; 430/430; 430/454; 430/455; 430/463

[58] Field of Search ..... 430/372, 428, 463, 429, 430/393, 401, 427, 430, 454, 455

[56] References Cited

U.S. PATENT DOCUMENTS

| | | | |
|---|---|---|---|
| 3,247,201 | 4/1966 | De Marie | 544/140 |
| 3,577,240 | 5/1971 | Nishio et al. | 430/233 |
| 4,599,427 | 7/1986 | Oeckl et al. | 548/262 |
| 4,851,325 | 7/1989 | Morimoto et al. | 430/372 |
| 4,859,574 | 8/1989 | Gormel | 430/372 |
| 4,917,992 | 4/1990 | Tirel et al. | 430/465 |
| 4,937,178 | 6/1990 | Koboshi et al. | 430/375 |
| 4,960,683 | 10/1990 | Okazaki et al. | 430/428 |
| 5,270,148 | 12/1993 | Morigaki et al. | 430/372 |

FOREIGN PATENT DOCUMENTS

| | | |
|---|---|---|
| 0395442 | 11/1990 | European Pat. Off. . |
| 0464461 | 3/1992 | European Pat. Off. . |
| 42660 | 3/1986 | Japan . |
| 61-75354 | 4/1986 | Japan . |
| 255948 | 11/1987 | Japan . |
| 1159645 | 12/1987 | Japan . |
| 1230043 | 9/1989 | Japan . |
| 295258 | 11/1989 | Japan . |
| 54261 | 2/1990 | Japan . |
| 2153350 | 6/1990 | Japan . |

OTHER PUBLICATIONS

Patent Abstract of Japan, vol. 10, No. 247 (P-490)(2303) Aug. 26, 1986, JP 61-75354, Apr. 1986.
European Search Report, Dec. 15, 1992.

*Primary Examiner*—Hoa Van Le
*Attorney, Agent, or Firm*—Sughrue, Mion, Zinn, Macpeak & Seas

[57] ABSTRACT

A processing solution for a silver halide color photographic material, said solution containing at least one kind of compound represented by formula (I), (II), or (III);

(I)

(II)

(III)

the substituents are defined in the instant specification.

19 Claims, No Drawings

PROCESSING SOLUTION FOR SILVER HALIDE COLOR PHOTOGRAPHIC MATERIALS AND METHOD FOR PROCESSING THE MATERIALS WITH USE OF THE PROCESSING SOLUTIONS

FIELD OF THE INVENTION

The present invention relates to a processing solution being used for processing a silver halide color photographic material, (hereinafter, also referred to as a color photographic material or a light-sensitive material) and a processing method using it, and more particularly a processing solution giving a reduced formaldehyde vapor pressure that is excellent in stabilizing dye images, and a method for processing the silver halide color photographic material with the processing solution.

BACKGROUND OF THE INVENTION

In general, the fundamental steps for processing a color photographic material are a color development step and a desilvering step. In the color development step, the exposed silver halide is reduced by a color developing agent to form silver and at the same time the oxidized color developing agent reacts with color forming agents (couplers) to form dye images. In the subsequent desilvering step, silver formed in the color development step is oxidized by an oxidizing agent called a bleaching agent; this oxidized silver is then dissolved by a complex ion forming agent of silver ions called a fixing agent. As the result of applying the desilvering step, dye images only are formed on the color photographic material.

Usually, after these steps, a wash process removes unnecessary components left on the color photographic material from the processing solutions. In the case of a color photographic paper and a reversal color photographic paper, processing is finished by the above-described steps and then the color photographic material is generally subjected to a drying step. In the case of a color negative photographic film and a color reversal photographic film, however a stabilization step is added to the foregoing steps. It is well-known that formalin is used in the stabilizing bath to prevent fading of magenta dyes caused by magenta couplers remaining in the color photographic material after processing. A certain amount of the formaldehyde vapor is generated during preparation of the stabilizing bath containing formaline and during drying of color photographic materials processed in these baths.

It is known that the inhalation of formalin is harmful for the human body and the Japan Association of Industrial Health that the allowable concentration of formaldehyde in a working environment is 0.5 ppm or less. Accordingly, efforts to reduce the concentration of formalin in a stabilizing bath and replacing formaldehyde with an alternative have been made to improve the working environment.

As an alternative for formalin, hexamethylenetetramine series compounds are described in JP-A-63-244036 (the term "JP-A" as used herein means an "unexamined published Japanese patent application"). By using these compounds, the concentration of formaldehyde, that is, the vapor pressure of formaldehyde can be reduced but the ability to prevent fading of magenta dye is also reduced. Thus, the essential purpose of using these compounds is diminished for when the color images formed are allowed to stand, the magenta color fades within few weeks, even at room temperature.

On the other hand, JP-A-61-75354, JP-A-61-42660, JP-A-62-255948, JP-A-1-295258, and JP-A-2-54261 describe 1-(dihydroxyaminomethyl)benztriazoles, JP-A-1-230043, etc., describes N-(morpholinomethyl)heterocyclic thiones and N-(piperidinomethyl)heterocyclic thiones, and JP-A-2-153350 describes bis(alkylamino)methane and bis(anilino)methane.

However, although some these compounds reduce vapor pressure of formaldehyde (as compared with that formed when using formalin alone), the image storage stability is poor. The rest of these compounds that do have improved image storage stability produce a vapor pressure of formaldehyde similar to that produced when using formalin. Thus, the foregoing compounds do not simultaneously improve the image storage stability and reduce of the vapor pressure of formaldehyde.

It has also been found that some of these compounds can improve the image storage stability of a magenta dye but form stains; deteriorate the storage stability of other dyes contained in the color photographic material processed, such as yellow dyes and cyan dyes; show low solubility; and attach to the color photographic material which stains the color images formed.

Thus, there has been strong demand for an innovative process to prevent magenta dye fading and lower the vapor pressure of formaldehyde.

SUMMARY OF THE INVENTION

One object of this invention is to provide a photographic processing solution which does not substantially release compounds in amounts harmful to the human body.

A second object of the present invention is to provide a photographic processing method which is safe and can give color images having excellent image storage stability after processing.

A third object of the present invention is to provide an excellent photographic process which gives color images having an excellent image storage stability and causes no problems of staining color photographic materials, etc.

As the result of various investigations, the present inventors have discovered that the foregoing objects can be achieved by the present invention as described hereinbelow.

That is, the above objects can be achieved by processing a silver halide color photographic material with a processing solution for a silver halide color photographic material, said solution containing at least one kind of a compound represented by formula (I), (II), or (III);

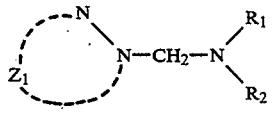

(I)

wherein $z_1$ represents a non-metallic atomic group bonding to each nitrogen atom with a carbon atom, an oxygen atom, or a sulfur atom and necessary for forming a 4- to 8-membered ring, and $R_1$ and $R_2$, which may be the same or different, each represents a hydrogen atom, an alkyl group, an alkenyl group, an aryl group, a heterocyclic group, an acyl group, a sulfonyl group, a sulfinyl group, a hydroxy group, an acyloxy group, an alkoxycarbonyl group, an alkoxy group, an aryloxy group, an amino group, an alkylamino group, an acylamino group, a sulfonamide group, a ureido group, a sulfamoylamino group, an alkoxycarbonylamino group, a carbamoyl group, or a sulfamoyl group, with the proviso that $R_1$ and $R_2$ do not form a ring which is formed by bonding $R_1$ to $R_2$, and

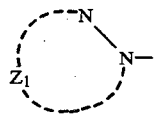

is not

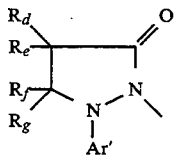

wherein Ar' represents an aryl group, $R_d$, $R_e$, $R_f$ and $R_g$ each represents a hydrogen atom, an alkyl group or an aryl group:

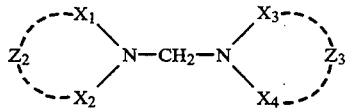

(II)

wherein $X_1$, $X_2$, $X_3$, and $X_4$, which may be the same or different, each represents

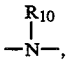

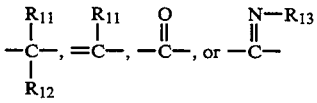

(wherein $R_{10}$, $R_{11}$, $R_{12}$, or $R_{13}$, which may be the same or different, each represents a hydrogen atom or a substituent); and $Z_2$ and $Z_3$, which may be the same or different, each represents a non-metallic atomic group necessary for forming a 4- to 8-membered ring, with the proviso that when the ring formed by $Z_2$ is a 5-membered ring and one of $X_1$ and $X_2$ is —CO and another of $X_1$ and $X_2$ is

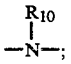

and/or when the ring formed by $Z_3$ is a 5-membered ring and one of $X_3$ and $X_4$ is

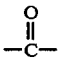

and another of $X_3$ and $X_4$ is

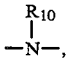

$R_{10}$ is not an aryl group:

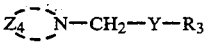

(III)

wherein $Z_4$ represents non-metallic atomic group necessary for forming a 4- to 8-membered ring; Y represents —O— or —S—; and $R_3$ represents an alkyl group, an alkenyl group, an aryl group, a heterocyclic group, an acyl group a sulfonyl group, a sulfinyl group, an alkoxycarbonyl group, a carbamoyl group, a sulfamoyl group, or an oxalyl group.

According to other embodiment of the present invention, there is further provided a method for processing an imagewise exposed silver halide color photographic material comprising a support having thereon at least one light-sensitive silver halide emulsion layer, comprising the steps of color developing in a color developing solution and bleaching in a solution having a bleaching ability, wherein color developing the photographic material is processed in a processing solution containing at least one compound represented by the above described formula (I), (II) or (III).

DETAILED DESCRIPTION OF THE INVENTION

The processing solution of the present invention which contains the compound represented by formula (I), (II), or (III) described above, maintains a safer working environment by reducing formaldehyde vapor pressure. Also, the present invention has the additional important features of stabilizing the color images formed and not staining color photographic materials. The present invention has the additional advantage that, any conventional processing solution and conventional color photographic materials can be used.

The compounds shown by formulae (I), (II), and (III) being used in this invention are described in detail.

In formula (I), $Z_1$ represents a non-metallic atomic group bonding to each nitrogen atom with a carbon atom, an oxygen atom, or a sulfur atom and necessary for forming a 4- to 8-membered ring.

Examples of the 4- to 8-membered ring formed with $Z_1$ and —N—N—, include, for example, diazetine, pyrazole, 1,2,4-triazole, indazole, pyrazolidine, pyrazoline, pyrazolo[4,3-d]oxazole, maleinhydrazide, diazepine, and 1,2-diazacyclooctane.

The carbon atom or nitrogen atom bonding to each nitrogen atom of the 4- to 8-membered ring formed by $Z_1$ may be substituted. Examples of the substituent include a halogen atom (e.g., chlorine, bromine, and fluorine), a hydroxyl group, a nitro group, a formyl group, a cyano group, a sulfo group, a carboxy group, a phospho group, an alkyl group (e.g., methyl, ethyl, n-propyl, n-butyl, cyclopropyl, hydroxymethyl, hydroxyethyl, methoxymethyl, benzyl, pyrazolylmethyl, and 1,2,4-triazol-1-yl-methyl), an alkenyl group (e.g., allyl), an aryl group (e.g., phenyl and 4-tert-butylphenyl), a heterocyclic group (e.g., 5-pyrazole and 4-pyrazole ), an acyl group (e.g., acetyl, benzyl, and propanoyl ), a sulfonyl group (e.g., methanesulfonyl, octanesulfonyl and toluenesulfonyl, benzenesulfonyl), a sulfinyl group (e.g., dodecanebenzenesulfonyl, methanesulfinyl, benzenesulfinyl), an acyloxy group (e.g., acetoxy), an alkoxycarbonyl group (e.g., methoxycarbonyl and butoxycarbonyl), an alkoxy group (e.g., methoxy and ethoxy), an aryloxy group (e.g., phenoxy), an amino group, an alkylamino group (e.g., methylamino, diethylamino, and N-hydroxyethylamino), an acylamino group (e.g., acetylamino, benzamino, and diacetylamino), a sulfonamide group (e.g., sulfonamide and benzenesulfonamide), an imido group (e.g., succinimido), an ureido group (e.g., methylureido), a sulfamoylamino group (e.g., N-methylsulfamoylamino), an alkoxycarbonylamino group (e.g. methoxycarbonylamino), a carbamoly group (e.g., carbamoyl and N-ethylcarbamoyl, N-methylcarbamoyl ), a sulfamoyl group (e.g., sulfamoyl and N-ethylsulfamoyl, N-methylsulfamoyl), an alkylthio group (e.g., methylthio and octylthio), and arylthio group (e.g., phenylthio), a heterocyclic thio group (e.g., benzoyltriazolylthio), and a heterocyclic oxy group (e.g., 1-phenyltetrazol-5-oxy). Among these, a halogen atom, a sulfo group, a carboxy group, an alkyl group, an alkoxycarbonyl group, an alkoxy group and an acylamino group are preferred.

In formula (I), $R_1$ and $R_2$, which may be the same or different, each represents a hydrogen atom, an alkyl group, an alkenyl group, an aryl group, a heterocyclic group, an acyl group, a sulfonyl group, a sulfinyl group, a hydroxyl group, an acyloxy group, an alkoxycarbonyl group, an alkoxy group, an aryloxy group, an amino group, an alkylamino group, an acylamino group, a sulfonamide group, a ureido group, a sulfamoylamino group, an alkoxycarbonylamino group, a carbamoyl group, or a sulfamoyl group. In these groups, the groups which can have a substituent may be substituted and examples of the substituent include the above-described substituents which can be substituted to the carbon atom or nitrogen atom bonding to each nitrogen atom of the ring formed by $Z_1$.

$R_1$ and $R_2$ represent, in more detail, a hydrogen atom, an alkyl group [e.g., methyl, ethyl, n-propyl, i-propyl, n-butyl, cyclopropyl, hydroxymethyl, hydroxyethyl, hydroxypropyl, 2,3-dihydroxypropyl, methoxymethyl, methoxyethyl, carboxyethyl, sulfoethyl, cyanomethyl, and 2-(N-pyrazolyl-N-methylamino)ethyl], an alkenyl group (e.g., allyl), an aryl group (e.g., phenyl and 4-tert-butylphenyl), a heterocyclic group (e.g., 5-pyrazolyl and 4-pyrazolyl), an acyl group (e.g., acetyl, benzoyl, and propanoyl), a sulfonyl group (e.g., methanesulfonyl, octanesulfonyl, and toluenesulfonyl, benzenesulfonyl), a sulfinyl group (e.g., dodecanebenzenesulfonyl), methanesulfinyl, benzenesulfinyl), a hydroxy group, an acyloxy group (e.g., acetoxy), an alkoxycarbonyl group, (e.g., methoxycarbonyl and butoxycarbonyl), carbonyl), an alkoxy group (e.g., methoxy and ethoxy), an aryloxy group (e.g., phenoxy), an amino group, an alkylamino group (e.g., methylamino, diethylamino, and N-hydroxyethylamino), an acylamino group (acetylamino, benzamino, and diacetylamino), a sulfonamide group (e.g., sulfonamide and benzenesulfonamide), a ureido group (e.g., methylureido), a sulfamoylamino group (e.g., N-methylsulfamoylamino), an alkoxycarbonylamino group (e.g., methoxycarbonylamino), a carbamoyl group (e.g., carbamoyl, N-methylcarbamoyl, and N-ethylcarbamoyl), or a sulfamoyl group (e.g., sulfamoyl, N-methylsulfamoyl, and N-ethylsulfamoyl).

In formula (II), $X_1$, $X_2$, $X_3$, and $X_4$, which may be the same or different, each represents

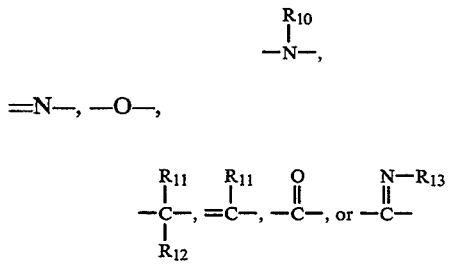

(wherein $R_{10}$, $R_{11}$, $R_{12}$, and $R_{13}$, which may be the same or different, each represents a hydrogen atom or a substituent.

$R_{10}$ is preferably a hydrogen atom, an alkyl group, an alkenyl group, an aryl group, a heterocyclic group, an acyl group, or a sulfonyl group.

$R_{11}$ and $R_{12}$ are preferably a halogen atom, a nitro group, a formyl group, a cyano group, a sulfo group, an alkylthio group, an arylthio group, a heterocyclicthio group, a heterocyclicoxy group, or each of the foregoing groups shown by $R_1$ and $R_2$.

$R_{13}$ is preferably each of the foregoing groups shown by $R_1$ and more preferably each of the foregoing preferred groups shown by $R_{10}$.

In these groups, these groups which can have a substituent may be substituted, such as those described above as the substituents of the groups shown by $R_1$ and $R_2$.

In more detail, $R_{10}$ is preferably a hydrogen atom, an alkyl group (e.g., methyl, ethyl, n-propyl, butyl, cyclopropyl, hydroxymethyl, and methoxymethyl), an alkenyl group (e.g., allyl), an aryl group (e.g., phenyl and 4-tert-butylphenyl), a heterocyclic group (e.g., 5-pyrazolyl and 4-pyrazolyl), an acyl group (e.g., acetyl, benzoyl, and propanoyl), or a sulfonyl group (e.g., methanesulfonyl, octanesulfonyl, benzenesulfonyl, and toluenesulfonyl).

$R_{11}$ and $R_{12}$ each is preferably a halogen atom (e.g., chlorine, bromine, and fluorine), a nitro group, a formyl group, a cyano group, a sulfo group, an alkylthio group (e.g., methylthio and octylthio), an arylthio group (e.g., phenylthio), a heterocyclic thio group (e.g., benzoyltriazolylthio), a heterocyclic oxy group (e.g., 1-phenyltetrazol-5-oxy) or each of the groups shown by $R_1$ and $R_2$ described above in detail.

The preferred group for $R_{13}$ is each of the foregoing groups shown by $R_1$.

With the proviso that $R_1$ and $R_2$ do not form a ring which is formed by bonding $R_1$ to $R_2$, and further

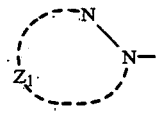

is not

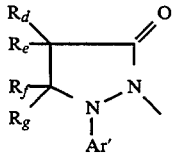

wherein Ar' represents an aryl group, $R_d$, $R_e$, $E_f$ and $R_g$ each represents a hydrogen atom, an alkyl group or an aryl group.

In formula (II), $Z_2$ and $Z_3$, which may be the same or different, each represents a non-metallic atomic group necessary for forming a 4- to 8-membered ring together with the nitrogen atom, $X_1$ and $X_2$ in formula (II) or together with the nitrogen atom, $X_3$ and $X_4$ in formula (II), with the proviso that when the ring formed by $Z_2$ is a 5-membered ring and one of $X_1$ and $X_2$ is

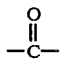

and another of $X_1$ and $X_2$ is

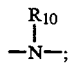

and/or when the ring formed by $Z_3$ is a 5-membered ring and one of $X_3$ and $X_4$ is

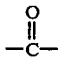

and another of $X_3$ and $X_4$ is

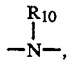

$R_{10}$ is not an aryl group.

In formula (III), $Z_4$ also represents a non-metallic atomic group necessary for forming a 4- to 8-membered ring together with the nitrogen atom in formula (III). It is preferred that the ring formed by $Z_4$,

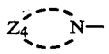

is not

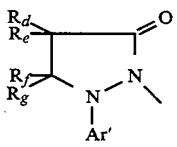

wherein Ar' represents an aryl group, $R_d$, $R_e$, $R_f$ and $R_g$ each represents a hydrogen atom, an alkyl group or an aryl group.

Examples of the 4- to 8-membered ring formed by $Z_2$, $Z_3$ or $Z_4$ as described above include azetidine, azetidin-2-one, pyrrole, pyrrolidine, pyrazole, imidazole, indole, benzimidazole, 1,2,4-triazole, 1,2,3-triazole, tetrazole, urazole, pyrazoline, piperazine, piperidine, morpholine, purine, azepine, ε-caprolactam, 7-pentanelactam, and S-triazine.

The carbon atom or the nitrogen atom of the 4- to 8-membered ring thus formed may be substituted. Examples of the substituent include the above-described substituents which can be substituted to the carbon atom or the nitrogen atom bonding to each nitrogen atom of the ring formed by $Z_1$.

In formula (III), Y represents —O— or —S—.

$R_3$ represents an alkyl group, an alkenyl group, an aryl group, a heterocyclic group, an acyl group, a sulfonyl group, a sulfinyl group, an alkoxycarbonyl group, a carbamoyl group, a sulfamoyl group, or an oxalyl group. These groups each may also be substituted by the above-described substituents which can be substituted to the carbon atom or the nitrogen atom of the formed by $Z_1$.

$R_3$ represents, in more detail, an alkyl group (e.g., methyl, ethyl, n-propyl, butyl, cyclopropyl, hydroxymethyl, methoxymethyl, i-propyl, n-butyl, hydroxyethyl, hydroxypropyl, methoxyethyl, carboxyethyl, sulfoethyl, cyanomethyl, 2-(N-pyrazolyl-N-methylamino)ethyl, and 2,3-dihydroxypropyl), an alkenyl group (e.g., allyl), an aryl group (e.g., phenyl and 4-tertbutylphenyl), a heterocyclic group (e.g., 5-pyrazolyl and 4-pyrazolyl), an acyl group (e.g., acetyl, benzoyl, and propanoyl), a sulfonyl group (e.g., methanesulfonyl and benzenesulfonyl, octanesulfonyl, toluenesulfonyl ), a sulfinyl group (e.g., methanesulfinyl and benzenesulfinyl, dodecanesulfinyl), an alkoxycarbonyl group (e.g., methoxycarbonyl and butoxycarbonyl), a carbamoyl group (e.g., carbamoyl N-ethylcarbamoyl and N-methylcarbamoyl), a sulfamoyl group (e.g., sulfamoyl N-ethylsulfamoyl and N-methylsulfamoyl), or an oxalyl group (e.g., methoxalyl and phenoxyalyl).

In the compound represented by formula (I), the sum total of carbon atoms of $R_1$ and $R_2$ is preferably not more than 15, more preferably not more than 10, and particularly preferably not more than 6.

Also, it is preferred that $R_1$ and $R_2$ each represent an alkyl group.

As to the ring formed by $Z_1$, an aromatic ring or a ring capable formally forming an aromatic ring as a tautomer (i.e., a tautomer of the aromatic ring such as a urazole ring) is preferable, a 5-membered ring is more preferable, and a pyrazole ring, a 1,2,4-triazole ring, or a urazole ring is most preferred. In particular, the ring represented by following formula (Z) is desired.

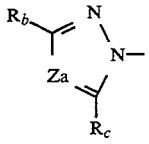

(Z)

In formula (Z), Za represents —C(Ra)= or —N= and Ra, Rb, and Rc, which may be the same or different, each represents a hydrogen atom, a halogen atom, a hydroxy group, an alkyl group having a sum total of carbon atoms of from 1 to 3 (e.g., methyl, ethyl, and hydroxymethyl), or an alkylacylamino group having a sum total of carbon atoms of from 1 to 3 (e.g., acetylamino).

As to one preferred compounds represented by formula (II), at least one of the $Z_2$ or $Z_3$ is a non-metallic atomic group necessary for forming an aromatic ring or a ring capable of formally forming an aromatic ring as a tautomer (i.e., a tautomer of the aromatic ring) together with the nitrogen atom, $X_1$ and $X_2$ or together with the nitrogen atom, $X_3$ and $X_4$ in formula (II).

Then, preferred compounds in the compounds represented by formula (II) are described in detail.

As to one preferred compounds represented by formula (II), $Z_2$ is a non-metallic atomic group necessary for forming an aromatic ring or a ring capable of formally forming an aromatic ring as a tautomer (i.e., a tautomer of the aromatic ring) together with the nitrogen atom, $X_1$ and $X_2$ in formula (II) and $Z_3$ is a non-metallic atomic group necessary for forming a non-aromatic ring together with the nitrogen atom, $X_3$ and $X_4$ is preferable.

As the aromatic ring or the ring capable of formally forming an aromatic ring as a tautomer (i.e., a tautomer of the aromatic ring) formed by $Z_2$, a 5-membered ring is preferred and a pyrazole ring, a triazole ring (e.g., 1,2,4-triazole and 1,2,3-triazole, provided that preferably 1,2,4-triazole), and a urazole ring are more preferable. Also, as the non-aromatic ring formed by $Z_3$, a pyrrolidine ring, a piperidine ring, a morpholine ring, and a piperazine ring are more preferred.

Among the compounds represented by formula (II), the compounds represented by formula (II-1) are preferable.

(II-1)

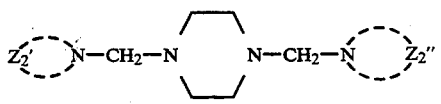

wherein $Z_2'$ and $Z_2''$ which may be the same or different, each represents a non-metallic atomic group necessary for forming a 5-membered aromatic ring or a ring capable of formally forming a 5-membered aromatic ring as a tautomer.

As the 5-membered aromatic ring or a ring capable of formally forming a 5-membered aromatic ring as a tautomer formed by $Z_2'$ or $Z_2''$, a pyrazole ring, a 1,2,4-triazole ring, a 1,2,3-triazole ring and a urazole ring are preferred.

As the 5-membered aromatic ring formed by $Z_2'$ or $Z_2''$, the rings represented by formula (Z) described above are preferable. That is, the compounds represented by formula (II-1) is preferably

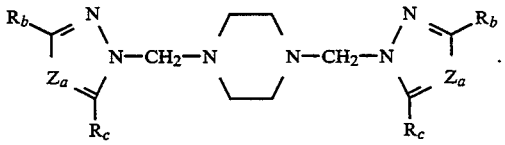

In particular, as the 5-membered ring formed by $Z_2'$ or $Z_2''$, the compounds represented by formula (Z), wherein Za represents —C(Ra)= or —N=, and Ra, Rb, and Rc, which may be the same or different, each represents a hydrogen atom, a halogen atom or an alkyl group having a sum total of carbon atoms of from 1 to 3 (e.g., methyl, ethyl, and hydroxymethyl) are preferable.

In the compounds represented by formula (III) described above, the compounds wherein the sum total of carbon atoms of $R_3$ is not more than 15 are preferred, the compounds wherein the sum total of carbon atoms of $R_3$ is not more than 10 are more preferred, and the compounds wherein the sum total of carbon atoms is not more than 5 are most preferred.

As the ring formed by $Z_4$ in formula (III), aromatic ring or a ring capable of formally forming an aromatic ring as a tautomer is preferred, a 5-membered ring compound is more preferred, and a pyrazole ring, a 1,2,4-triazole ring, and a urazole ring are most preferred. In particular, the rings represented formula (Z) described above are preferred.

In formula (III), Y is preferably —O—.

Among the compounds represented by formula (I), (II), and (III), the compounds represented by formula (I) or (II) are preferred, and the compounds represented by formula (II) are most preferred.

Furthermore, it is preferred that the compounds represented by formulae (I), (II), and (III) are water-soluble. Also, the sum total of carbon atoms in the compound is preferably not more than 30, more preferably not more than 20, and particularly preferably not more than 16.

Then, specific examples of the compounds for use in this invention represented by formulae (I), (II), and (III) are illustrated below but the invention is not limited to these compounds.

I-1

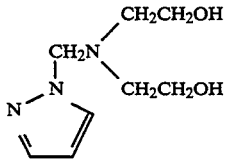

I-2

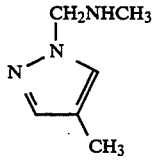

I-3

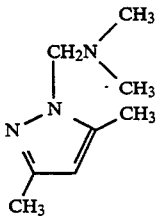

I-4

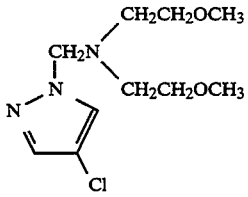

I-5

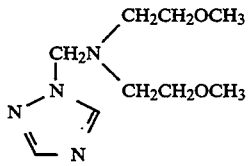

I-6

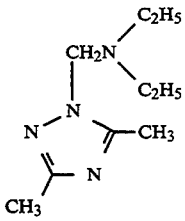

-continued
I-7
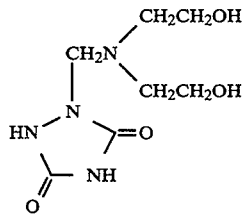
I-8
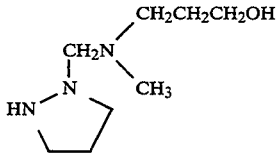
I-9
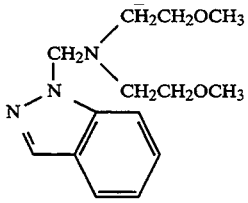
I-10
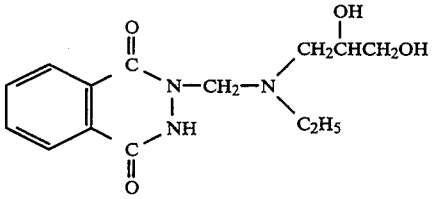
I-11
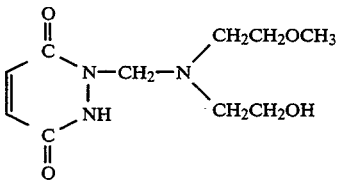
I-12
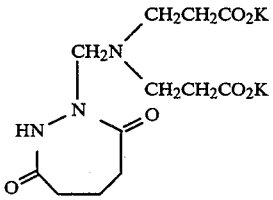
I-13
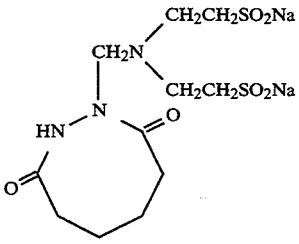
I-14
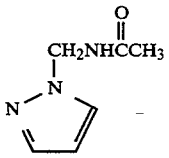
-continued
I-15
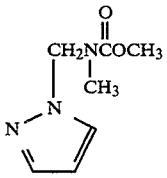
I-16
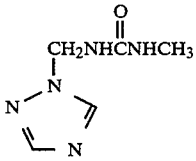
I-17
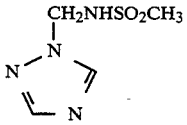
I-18
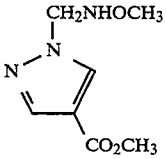
I-19
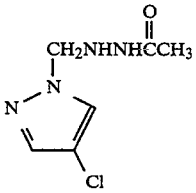
I-20
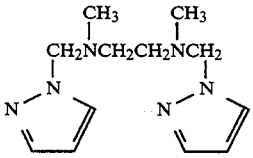
I-21
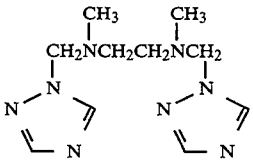
I-22
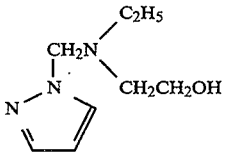
I-23
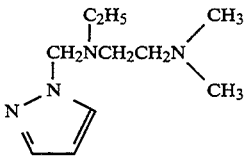

-continued
I-24
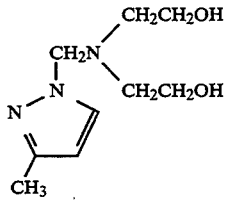
I-25
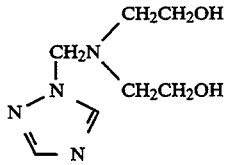
I-26
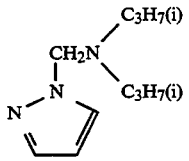
I-27
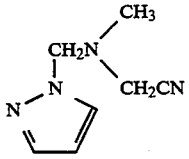
I-28
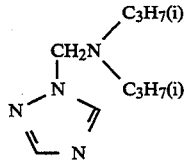
I-29
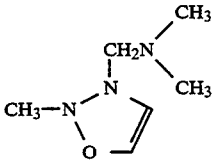
I-30
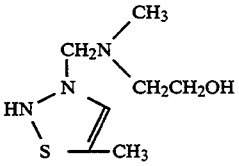
II-1
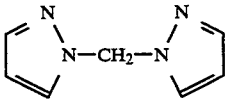
II-2
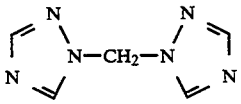
II-3
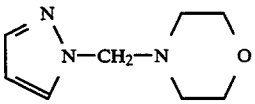
-continued
II-4
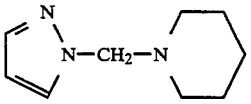
II-5
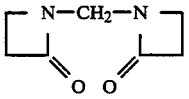
II-6
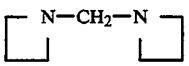
II-7
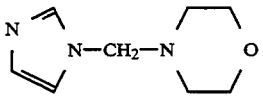
II-8
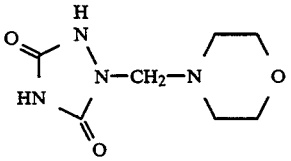
II-9
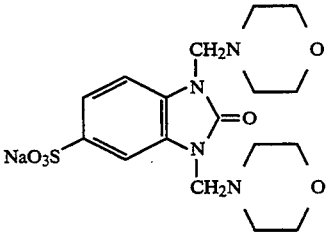
II-10
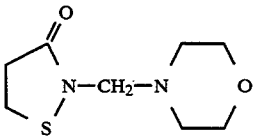
II-11
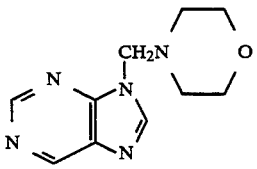
II-12
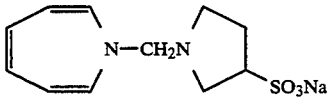
II-13
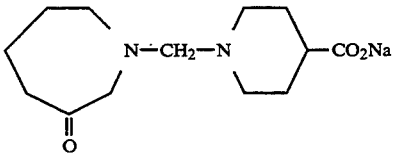
II-14
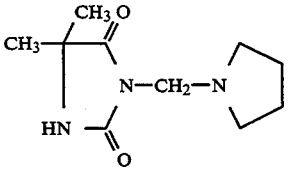

-continued
II-15
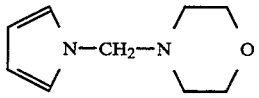
II-16
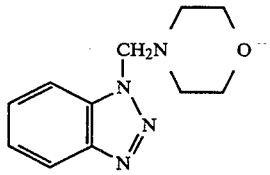
II-17
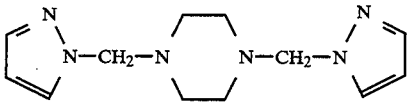
II-18
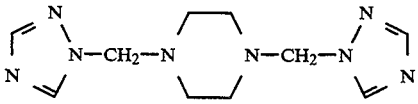
II-19
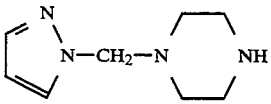
II-20
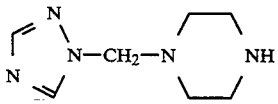
II-21
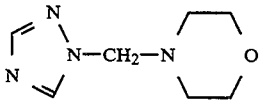
II-22
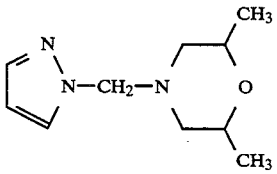
II-23
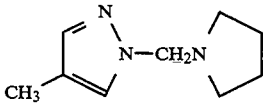
II-24
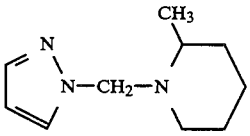
II-25
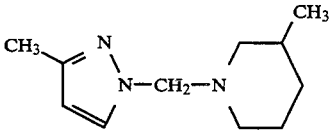
-continued
II-26
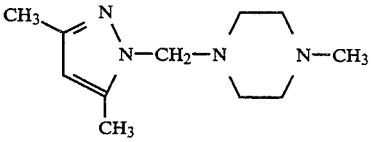
II-27
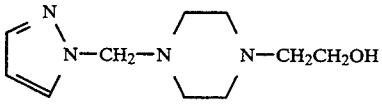
II-28
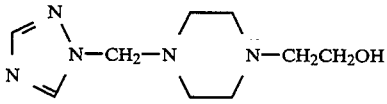
II-29
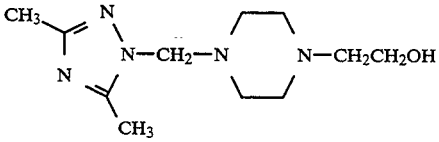
II-30
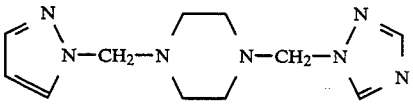
II-31
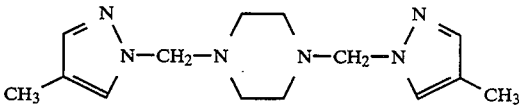
II-32
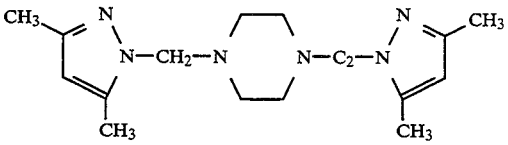
II-33
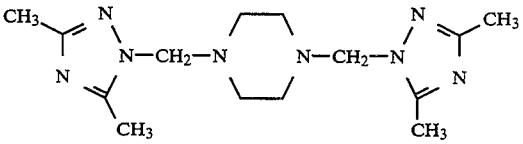
II-34
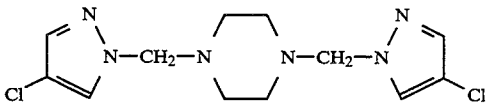
II-35
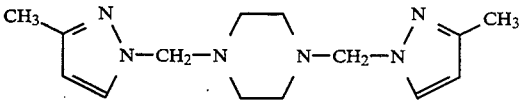
II-36
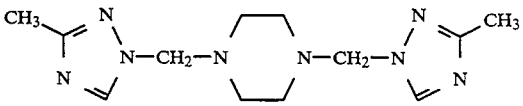
II-37
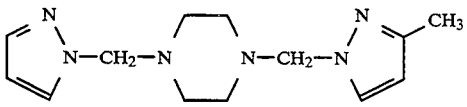

-continued
II-38
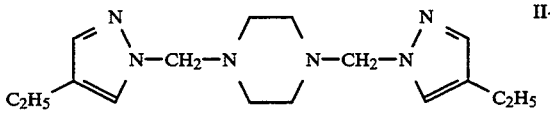
II-39
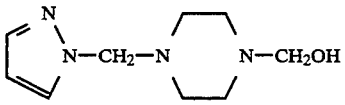
II-40
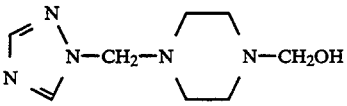
II-41
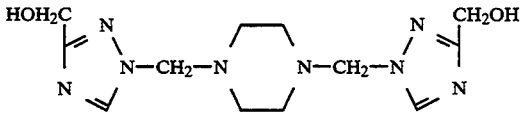
II-42
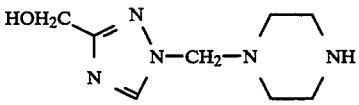
II-43
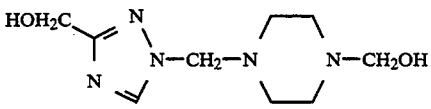
II-44
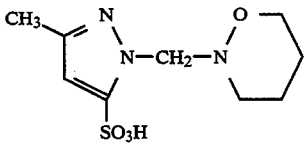
II-45
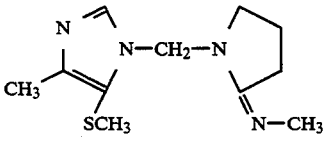
II-46
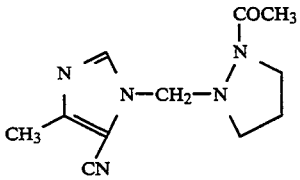
II-47
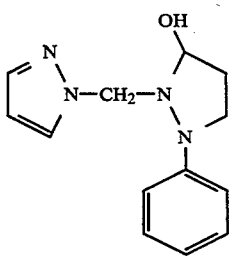
II-48
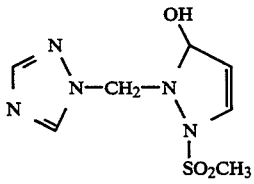
-continued
II-49
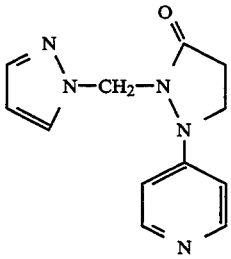
II-50
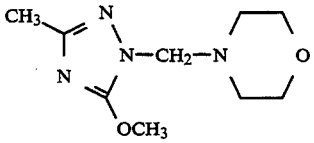
III-1
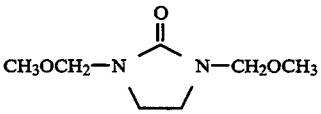
III-2
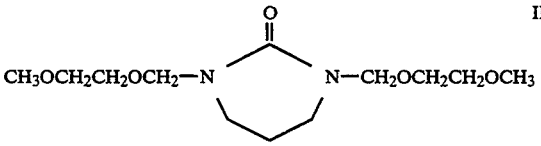
III-3
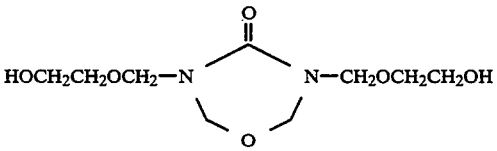
III-4
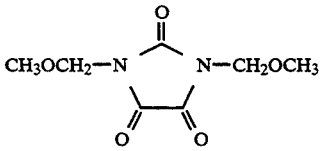
III-5
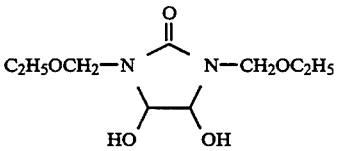
III-6
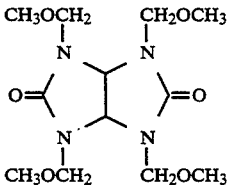
III-7
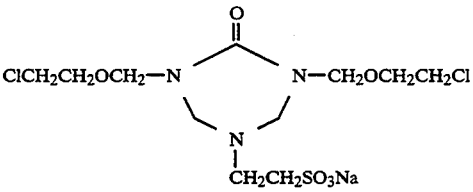

-continued
III-8
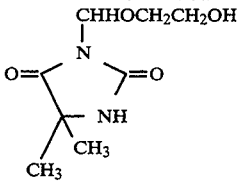
III-9
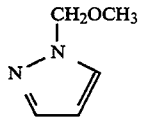
III-10
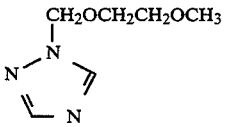
III-11
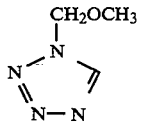
III-12
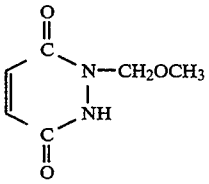
III-13
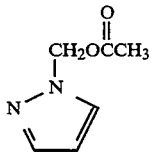
III-14
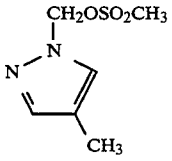
III-15
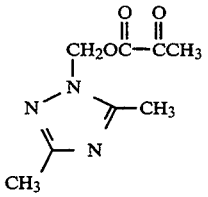
III-16
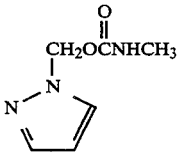
III-17
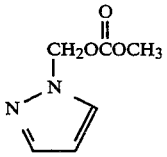
-continued
III-18
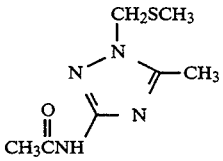
III-19
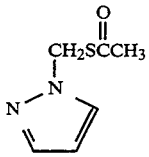
III-20
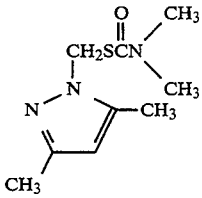
III-21
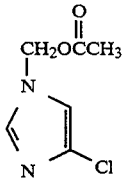
III-22
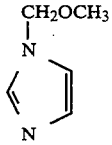
III-23
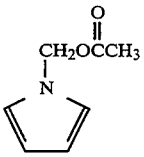
III-24
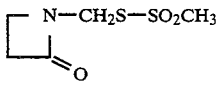
III-25
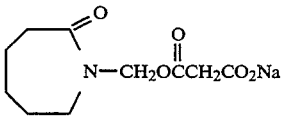
III-26
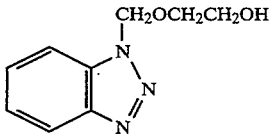
III-27
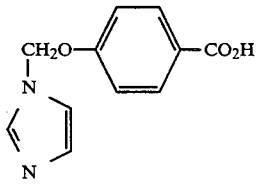

-continued

III-28

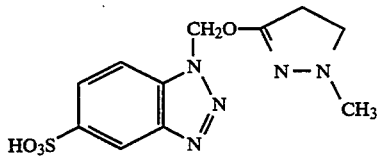

Among these, Compounds II-17 and II-18 are preferred.

The compounds for use in this invention can be synthesized by the methods or methods similar to these described in *Journal of Americal Pharma. Association*, 45, 531(1956), *Ber.*, 91, 1432(1958), *Journal of Americal Chemical Society*, 68, 2496(1956), *Rev. Prog. Coloration*, 17, 7(1987), and the literatures cited within these publications.

Typical synthesis of examples of compounds in this invention are shown below:

Synthesis Example 1 (Compound II-17)

In a 500 ml three-neck flask equipped with a stirrer, a thermometer, and a condenser were placed 68 g of pyrazole and 80 ml of methanol. The mixture was heated to 50° C. while stirring. To this mixture was added, dropwise, a mixture of 31.6 g of 95% paraformaldehyde, 0.67 g of methanol containing 28% $NaOCH_3$, and 70 ml of methanol. The resultant mixture was stirred for one hour at 50° C., and then cooled with water. The mixture was stirred for one hour after adding 97.1 g of piperazine hexahydrate to the mixture little by little. The reaction mixture formed was filtrated, the filtrate was concentrated under reduced pressure. The concentrate thus obtained was crystallized with a mixed solvent of 300 ml of acetic acid ethyl ester and 50 ml of n-hexane to provide 100 g of compound (II-17) as colorless crystals having a melting point of from about 109° C. to 112° C. Elemental analysis and various spectra confirmed the chemical structure of the compound.

Synthesis Example 2 (Compound II-18)

In a 500 ml three-neck flask equipped with a stirrer, a thermometer, and a condenser were placed 69.1 g of 1,2,4-triazole and 170 ml of methanol. The mixture was heated to 50° C. while stirring. To this mixture was added, dropwise, a mixture of 31.6 g of 95% paraformaldehyde, 0.67 g of methanol containing 28% $NaOCH_3$, and 67 ml of methanol. The resultant mixture was heated to 50° C. for one hour and then cooled with water. The mixture was stirred for about one hour after adding thereto 97.1 g of piperazine hexahydrate little by little. Crystals formed during the reaction. After the reaction was over, the reaction mixture was cooled with water. Resulting crystals were collected by filtration and washed with cooled methanol to provide 103 g of compound (II-18) as colorless crystals having a melting point of from about 205° C. to 209° C. Elemental analysis and varions spectra confirmed the chemical structure of the compound.

Other compounds can be also synthesized similarly.

The compound for .use in this invention may be used for any step in the processing steps of color photographic materials.

The processing solution of the present invention is a processing solution (including the replenisher for the processing solution) having the effect for stabilizing the dye images formed by color development (in particular, the effect of preventing a magenta dye from fading with the passage of time), by containing the compound of the present invention. That is, the processing solution of the present invention is an aqueous photographic processing solution. Accordingly, the processing solution of the present invention is a processing solution for use after color development: namely, a bleaching solution, a bleach-fixing solution (blixing solution), a fixing solution, a stopping solution, a conditioning solution, a washing solution, a rinsing solution, or a stabilizing solution, preferably a stabilizing solution, a stopping solution, a conditioning solution, or a bleaching solution, more preferably a stabilizing solution, a conditioning solution or a bleaching solution and most preferably a stabilizing solution.

The compound for use in this invention represented by formula (I), (II), or (III) may be added to the replenisher for each processing solution that is a preferred embodiment of this invention. Thus, the processing solution of the present invention includes a replenisher. The replenisher in the present invention is a solution for replenishing a fresh processing solution used for keeping the original composition of a processing solution at continuous photographic processing.

Each replenisher of this invention is prepared to sustain the performance of each processing solution by maintaining a constant concentration of active compounds through replenishment of these compounds consumed during processing of color photographic materials and degraded in an automatic processor with the passage of time, while controlling the concentration of compounds dissolved out from color photographic materials by processing. Accordingly, the concentration of these compounds which are consumed is kept higher in the replenisher than the corresponding processing solution. Conversely, the concentration of compounds eluted from the photographic materials is kept lower in the replenisher than in the processing solution. About the same concentration as in the ordinary processing solution is used in the corresponding replenisher for those compounds which do not tend to change concentration by processing or with the passage of time.

The stabilizing solution in the present invention is a stabilizing solution used for the final processing step of a color negative photographic film and a color reversal photographic film or a stabilizing solution used in place of water-washing solution in a washing step as the final processing step. When the final processing step is a washing step or a rinsing step, a stabilizing solution used for the stabilizing step as the pre-bath for the step or the rinsing step is also another in the processing solution of the present invention. The stabilizing solution containing the compound for use in this invention is preferably used during the final step.

Before our innovation, a stabilizing solution and its replenisher used during the final processing step was a processing solution containing formalin that produced an image stabilization effect. However, in this invention, the vapor pressure of formaldehyde caused by the presence of formalin in the processing solution can be reduced without losing stabilization of color images. Therefore, the stabilizing solution of this invention does not substantially contain formalin. The term "not substantially contain formalin" means that the solution may contain formalin within the range which does not influence the effect of the present invention. Practically, it means that the sum of formaldehyde and the hydrate of formaldehyde is generally not more than 0.005 mol/- liter. For reducing the vapor pressure of formaldehyde, the sum of formaldehyde and its hydrate is preferably as low as possible and more preferably not more than $1.0\times10^{-4}$ mol/liter.

The content of the compound represented by formula (I) to (III) in the processing solution of this invention is preferably from $1.0\times10^{-4}$ to 0.5 mol, more preferably from 0.001 to 0.1 mol, and most preferably from 0.001 to 0.03 mol per liter of the processing solution.

The processing solutions to which the discovered compound can be added as well as other processing solutions used in conjunction are described next. Since the processing solution containing the discovered compound alone does not have a stabilization effect of color images, it is technically improper to call such this processing solution a stabilizing solution. But for convenience, such a processing solution will also be called a stabilizing solution.

First, a stabilizing solution and a conditioning solution are the preferred processing solution for containing the compound in this invention. The conditioning solution is a processing solution that is sometimes called a bleach accelerating bath.

It is preferable that the stabilizing solution contains various surface active agents for preventing water spots during the drying of color photographic materials. Appropriate surface active agents include: polyethylene glycol type nonionic surface active agents, polyhydric alcohol type nonionic surface active agents, alkylbenzenesulfonate type anionic surface active agents, higher alcohol sulfate type anionic surface active agents, alkylnaphthalenesulfonate type anionic surface active agents, quaternary ammonium salt type cationic surface active agents, amine salt type cationic surface active agents, amino salt type amphoteric surface active agents, and betaine type amphoteric surface active agents. Nonionic surface active agents are preferred, and alkylphenol ethylene oxide addition products are particularly preferred. The desired alkylphenol includes: octylphenol, nonylphenol, dodecylphenol, and dinonylphenol. The addition mol number of ethylene oxide is particularly preferably from 8 to 14. Furthermore, silicone series surface active agents having a high defoaming effect is preferred.

Also, it is preferred that the stabilizing solution contains various antibacterial agents or antifungal agents to prevent the formation of fur and fungi in-the color photographic materials. Examples of these antibacterial agents and antifungal agents include the thiazolylbenzimidazole series compounds as described in JP-A-57-157244 and JP-A-58-105145, the isothiazolone series compounds described in JP-A-57-8542, chlorophenol series compounds such as trichlorophenol, etc., bromophenol series compounds, organotin compounds, organozinc compounds, acid amide series compounds, diazine and triazine series compounds, thiourea compounds, benzotriazole series compounds, alkylguanidine series compounds, quaternary ammonium salts such as benzalkonium chloride, etc., antibiotics such as penicillin, etc., and the antifungal agents described in *Journal of Antibacterial* and *Antifungal Agents*, vol. 1, No. 5, 207–223 (1983).

These compounds may be used singly or in combination. Also, the various bactericides described in JP-A-48-83820 can be used.

Also, it is preferred that the stabilizing solution contains various chelating agents. As preferred chelating agents, aminopolycarboxylic acids such as ethylenediaminetetraacetic acid, diethylenetriaminepentaacetic acid, etc; organic phosphonic acids such as 1-hydroxyethylidene-1,1-diphosphonic acid, diethylenetriamine-N,N,N'N'-tetramethylenephosphonic acid, etc.; and the hydrolized products of maleic anhydride polymers described in European Patent 345,172A1.

Also, for the stabilizing solution, other compounds for stabilizing dye images than the compounds for use in this invention such as, for example, hexamethylenetetramine and the derivatives thereof, hexahydrotriazine and the derivatives thereof, dimethylolurea, organic acids, and pH buffers may be used single or in combination. Furthermore, it is preferred that the stabilizing solution of this invention contains, if desired; an ammonium compound such as ammonium chloride, ammonium sulfite, etc.; a metal compound such as a Bi compound, an Al compound, etc.; an brightening agent, a hardener, the alkanolamine described in U.S. Pat. No. 4,786,583, and a preservative which can be used for a fixing solution or a blixing solution described below.

The pH of the stabilizing solution in this invention is in the range of usually from 4 to 9, and preferably from 6 to 8. The replenishment amount for the stabilizing solution is preferably from 200 to 1500 ml, and more preferably from 300 to 600 ml per square of a color photographic material being processed. The processing temperature of the stabilizing solution is preferably from 30° C. to 45° C. and the processing time is preferably from 10 seconds to 2 minutes, and particularly preferably from 15 seconds to 30 seconds.

The conditioning solution of this invention can further contain an aminopolycarboxylic acid chelating agent such as ethylenediaminetetraacetic acid, diethylenetriaminepentaacetic acid, 1,3-diaminopropanetetraacetic acid, cyclohexanediaminetetraacetic acid, etc.; a sulfite such as sodium sulfite, ammonium sulfite, etc,; and a bleaching accelerator such as thioglycol, aminoethanethiol, sulfoethanethiol, etc. (These additives will be explained during discussion of the bleaching solution.) It is preferred that the conditioning solution contains the sorbitan esters of fatty acid substituted by ethylene oxide described in U.S. Pat. No. 4,839,262 and the polyoxyethylene compounds described in U.S. Pat. No. 4,059,446 and *Research Disclosure*, Vol. 191, 19104, (1980). These compounds can be used in the range of from 0.1 g to 20 g, and preferably from 1 g to 5 g per liter of the conditioning solution.

The pH of the conditioning solution is usually in the range of from 3 to 11, preferably from 4 to 9, and more preferably from 4.5 to 7.

The processing time of the conditioning solution is preferably from 30 seconds to 5 minutes.

Also, the replenishment amount for the conditioning solution is preferably from 30 ml to 3000 ml, and more preferably from 50 ml to 1500 ml per square meter of a color photographic material being processed.

The processing temperature of the conditioning solution is preferably from 20° C. to 50° C., and more preferably from 30° C. to 40° C.

A silver halide color photographic material, a negative type color photographic material and a direct positive type color photographic material are usually subjected to a color development after imagewise exposure. A reversal positive type color photographic material is usually subjected to a color development after being subjected to a black and white development, reversal processing, etc.

The color developer to be used in this invention is an alkaline aqueous solution containing an aromatic primary amine color developing agent as its main component.

A preferred color developing agent is a p-phenylenediamine derivative and typical examples are shown below, but the invention is not limited to them.

| | |
|---|---|
| D-1 | N,N-Diethyl-p-pheylenediamine |
| D-2 | 2-Methyl-N,N-diethyl-p-phenylenediamine |
| D-3 | 4-[N-Ethyl-N-(β-hydroxyethyl)amino]aniline |
| D-4 | 2-Methyl-4-[N-ethyl-N-(β-hydroxyethyl)-amino]aniline |
| D-5 | 4-Amino-3-methyl-N-ethyl-N-[β-(methane-sulfonamido)ethyl]aniline |
| D-6 | 4-Amino-3-methyl-N-ethyl-N-methoxyethyl-aniline |
| D-7 | 4-Amino-3-methyl-N-ethyl-N-(4-hydroxy-butyl)aniline |

Of the above p-phenylenediamine derivatives, D-4 and D-5 are particularly preferred.

These p-phenylenediamine derivatives may be in the form of the salts, such as: the sulfates, hydrochlorides, sulfites, p-toluenesulfonates, etc.

The amount of the aromatic primary amine color developing agent is preferably from 0.001 to 0.1 mol, and more preferably from 0.01 to 0.06 mol per liter of the color developer.

Also, the color developer can contain a sulfite, if desired, a sulfite such as sodium sulfite, potassium sulfite, sodium hydrogensulfite, potassium hydrogensulfite, sodium metasulfite, potassium metasulfite, etc., or a carbonylsulfite addition product. The preferred addition amount of the preservative is from 0.5 to 10 g, and particularly from 1 to 5 g per liter of the color developer.

As compound can be added preserve the previously discussed aromatic primary amine color developing agent. Examples include: various hydroxylamines (preferably, the compounds having a sulfo group or carboxy group) described in JP-A-63-5341 and JP-A-63-106655; the hydroxamic acids described in JP-A-63-43138; the hydrazines and hydrazides described in JP-A-63-146041; the phenols described in JP-A-63-44657 and JP-A-63-58443; the α-hydroxyketones and α-aminoketones described in JP-A-63-44656; and various kinds of the sucrose described in JP-A-63-36244.

Additionally, these preservative compounds can be used in combination with: the monoamines described in JP-A-63-4235, JP-A-63-24254, JP-A-63-21647, JP-A-63-146040, JP-A-63-27841, and JP-A-63-25654; the diamines described in JP-A-63-30845, JP-A-63-14640, and JP-A-63-43139; the polyamines described in JP-A-63-21647, JP-A-63-26655, and JP-A-63-44655; the nitroxy radicals described in JP-A-63-53551; the alcohols described in JP-A-63-43140 and JP-A-63-53549; the oximes described, in JP-A-63-56654, and the tertiary amines described in JP-A-63-239447.

The color developer may also contain other preservatives. Examples include: the various metals described in JP-A-57-44-44148 and JP-A-57-53749; the salicylic acids described in JP-A-59-180588; the alkanolamines described in JP-A-54-3582; the polyethyleneimines described in JP-A-56-94349; the aromatic polyhydroxy compounds described in U.S. Pat. No. 3,746,544, etc. Of these compounds, the aromatic polyhydroxy compounds are particularly preferred.

The pH of the color developer being used in this invention is preferably from 9 to 12, and more preferably from 9 to 11.0. To maintain the pH within these parameters, it is preferable to use various buffers.

Practical examples of buffers include: sodium carbonate, potassium carbonate, sodium hydrogencarbonate, potassium hydrogencarbonate, sodium tertiary phosphate, potassium tertiary phosphate, sodium secondary phosphate, potassium secondary phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The addition amount of the buffer is preferably not less than 0.1 mol, and particularly preferably from 0.1 to 0.4 mol per liter of the color developer.

It is preferred that the color developer contains various kinds of chelating agents to inhibit a precipitation of calcium and magnesium or to further improve the stability of the color developer. As the chelating agent, organic acid compounds are preferable examples include aminopolycarboxylic acids, organic sulfonic acids, and phosphonocarboxylic acids.

Typical examples of these organic acid compounds include diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, hydroxyethyliminodiacetic acid, glycol ether diaminetetraacetic acid, ethylenediamine o-hydroxyphenylacetic acid, 2-phosphonobutane-1,2,4-tricarboxylic acid, 1-hydroxyethylidene-1,1-diphosphonic acid, and N,N'-bis(2-hydroxybenzyl)ethylenediamine-N,N'-diacetic acid.

Chelating agents may be used single or in combination. A typical amount of the chelating agent required to block metal ions in the color developer and is about 0.1 g to 10 g per liter of the color developer.

If desired, an optional developing accelerator can be added to the color developer. It is preferred, however, that the color developer in this invention contains substantially no benzyl alcohol. Benzyl alcohol pollutes the enviroment, worsens the preparing property of the solution, and promotes color stains. In this case, the term "contains substantially no benzyl alcohol" means that the color developer contains not more than 2 ml of benzyl alcohol per liter of the color developer and preferably contains no benzyl alcohol.

Examples of the developing accelerator which can be added, if desired, to the color developer include the thioether Compounds described in JP-B-37-16088, JP-B-37-5987, JP-B-38-7826, JP-B-44-12380, JP-B-45-9019 (the term "JP-B" as used herein means an "examined Japanese patent publication"), and U.S. Pat. No. 3,818,247; the p-phenylenediamine series compounds described in JP-A-52-49829 and JP-A-50-15554; the quaternary ammonium salts described in JP-A-50-137726, JP-B-44-30074, JP-A-56-156826, and JP-A-52-43429; the amine series compounds described in U.S. Pat. Nos. 2,494,903, 3,128,182, 4,230,796, and 3,253,919, JP-B-41-11431, U.S. Pat. Nos. 2,484,546, 2,596,926, and 3,582,346; the polyalkylene oxides described in JP-B-37-16088, JP-B-42-25201, U.S. Pat. No. 3,128,183, JP-B-41-11431, JP-B-42-23883, and U.S. Pat. No. 3,532,510; as well as 1-phenyl-3-pyrazolideones, and imidazoles.

The addition amount of the development accelerator is from about 0.01 g to 5 g per liter of the color developer.

In this invention, the color developer can contain, if desired, an optional antifoggant.

Examples of the antifoggants include alkali metal halides, such as sodium chloride, potassium bromide, potassium iodide, etc. and organic anti-foggants. Examples of the organic antifoggant include nitrogen-containing heterocyclic compounds such as benzotriazole, 6-nitrobenzimidazole, 5-nitroisoindazole, 5-methylbenzotriazole, 5-nitrobenzimidazole, 5-chlorobenzotriazole, 2-thiazolyl-benzimidazole, 2-thiazolylmethylbenzimidazole, indazole, hydroxyazaindolizine, and adenine.

The addition amount of the antifoggant is from about 0.001 g to 1 g per liter of the color developer.

The color developer of this invention may further contain an optical brightening agent. The prefened optical brightening agents are 4,4'-diamino-2,2'-disulfostilbene series compounds. The addition amount of the optical brightening agent to be added is preferably from 0 to 5 g, and more preferably from 0.1 g to 4 g per liter of the color developer.

If necessary, the color developer may also contain various surface active agents including: alkylsulfonic acids, arylsulfonic acids, aliphatic carboxylic acids, aromatic carboxylic acids, etc.

The replenisher for the color developer contains these compounds found in the color developer. One function of the replenisher for the color developer is to replenish the compounds which are consumed during processing of color photographic materials or by the deterioration in an automatic processor with the passage of time. Another founction is to maintain a constant rate of development by controlling the concentration the compounds released from the color photographic materials during processing. Accordingly, the concentrations of consumed compounds are higher in the replenisher than in the tank solution of the color developer. Conversely the concentration of released compounds is lower in the replenisher than in the tank solution.

The consumed compounds include a color developing agent and a preservative. The replenisher contains them in a ratio of from 1.1 to 2 times those in the tank solution. Also, the released compound is a development inhibitor such as a halide (e.g., potassium bromide); the replenisher contains it in a ratio of from 0 to 0.6 times that in the tank solution. The concentration of a halide in the replenisher for the color developer is usually not more than 0.006 mol/liter, if containing any at all.

Some, compounds virtually maintain their concentration despite processing and/or the passage of time the replenisher has almost same concentrations of these condition as those in the tank solution of the color developer. Examples of such compounds are chelating agents and buffers.

Furthermore, the pH of the replenisher for the color developer is higher by about 0.05 to 0.5 than that of the tank solution to maintain the pH in the tank solution during processing. The degree increased in pH of the replenisher is required to increase with the reduction of the replenishment amount. The replenishing amount for the color developer is preferbly not more than 3000 ml and more preferably from 100 ml to 1500 ml per square meter of a color photographic material being processed.

The proper processing temperature of the color developer is generally from 20° to 50° C., and preferably form 30° to 45° C. The processing time is properly from 20 seconds to 5 minutes, preferably from 30 seconds to 3 minutes and 20 seconds, and more preferably from 1 minute to 2 minutes and 30 seconds.

Also, if desired, the color development can be carried out using two or more baths. Its replenisher may be added during the first bath or the later baths. This shortens the developing time and further decreases the replenishing amount.

The processing method of the present invention is preferably used for color reversal photographic processing. In the color reversal process, a color development is carried out after black and white development and, if desired, applying reversal processing. The black and white developer, is usually called the black and white 1st developer, is used for the reversal process of a color photographic light-sensitive material and can contain various kinds of additives which are used for a black and white developer for processing a black and white silver halide photographic materials.

Typical additives include: a developing agent such as 1-phenyl-3-pyrazolidone, Metol, hydroquinone, etc.; a preservative such as a sulfite, etc.; an accelerator such as sodium hydroxide, sodium carbonate, potassium carbonate, etc.; an inorganic or organic inhibitor such as potassium bromide, 2-methylbenzimidazole, methylbenzothiazole, etc.; a water softener such as a polyphosphate, etc.; and a development inhibitor such as a slight amount of iodide, a mercapto compound etc.

An automatic processor using either black and white developer or color developer should have a small opening area. In other words, the contact area (opening area) of the developer (the black and white developer or color developer) exposed to air should be as small as possible. The opening ratio defined the opening area ($cm^2$) divided by the volume ($cm^3$) of the developer is preferably 0.01 $cm^{-1}$ or less, and more preferably 0.005 $cm^{-1}$ or less.

The developer can be regenerated for reuse. Regeneration of the used developer occurs through treatment with an anion exchange resin, electrodialysis, or addition of processing chemicals called regenerating agents. The old developer is activated and used again as fresh developer.

In this case, the generating ratio (the ratio of the overflow solution to the replenisher) is preferably 50% or more, and particularly preferably 70% or more.

In the regeneration of a developer, the overflow solution of the developer is, after regeneration, used as a replenisher for the developer.

As a method for the regeneration, it is preferred to use an anion exchange resin. Particularly preferred compositions of anion exchange resins and regenerating method for the anion exchange resins are described in *Diaion Manual (I)*, (14th edition, 1986), published by Mitsubishi Chemical Industry Co., Ltd. Also, in anion exchange resins, the resins having the compositions described in JP-A-2-952 and JP-A-1-281152.

In the present invention, the color developed photographic material is subjected to a desilvering process. The desilvering process is consists of a bleaching process and a fixing process carried out simultaneously as bleach-fixing process (blixing process) or a combination of them.

Typical desilvering processing steps are as follows:

(1) Bleaching-fixing (2) Bleaching-blixing
(3) Bleaching-washing-fixing
(4) Bleaching-blixing-fixing
(5) Blixing
(6) Fixing-blixing In the foregoing steps, steps (1), (2), (4), and (5) are preferred. Step (2) is disclosed, e.g., in JP-A-61-75352 and step (4) is disclosed, e.g., in JP-A-61-143755 and EP 0427204A1 corresponding to Japanese Patent Application No. 2-216389.

Also, the processing baths such as bleaching bath, fixing bath, etc., being applied to the foregoing steps each may comprise one bath or two or more boths (e.g., 2 to 4 baths, in this case, counter-current replenishing system is preferably employed).

The desilvering step may be carried out via a rinsing bath, a washing bath, a stopping bath, etc., after color development. When processing a negative type color photographic material, however the desilvering step is preferably carried out immediately after color development. During reversal process, the desilvering step is preferably carried out in a conditioning bath after color development.

The bleaching solution can contain the compound for use in the present invention. Examples of main component of bleaching agents include: inorganic compounds, such as potassium ferricyanide, ferric chloride, bichromates, persulfates, bromates, etc.; and partial-organic compounds such as an aminopolycarboxylic acid ferric complex salt, an aminopolyphosphoric acid ferric complex salt, etc.

In this invention, the use of an aminopolyphosphonic acid ferric complex salt is preferred form the view points of environmental preservation, safety to handle, and anti-corrosive property to metals.

Then, practical examples of the aminopolycarboxylic acid ferric complex salt in this invention are illustrated below together with their oxidation reduction potentials, but the bleaching agents for use in this invention are not limited to these compounds.

| Compound No. | | Oxidation Reduction Potential* |
|---|---|---|
| 1. | N-(2-Acetamido)iminodiacetic Acid Ferric Complex Salt | 180 |
| 2. | Methyliminodiacetic Acid Ferric Complex Salt | 200 |
| 3. | Iminodiacetic Acid Ferric Complex Salt | 210 |
| 4. | 1,4-Butylenediaminetetraacetic Acid Ferric Salt | 230 |
| 5. | Diethylene Thioether Diaminetetra-acetic Acid Ferric Complex Salt | 230 |
| 6. | Glycol Ether Diaminetetraacetic Acid Ferric Complex Salt | 240 |
| 7. | 1,3-Propylenediaminetetraacetic Acid Ferric Complex Salt | 250 |
| 8. | Ethylenediaminetetraacetic Acid Ferric Complex Salt | 110 |
| 9. | Diethylenetriamimepentaacetic Acid Ferric Complex Salt | 80 |
| 10. | Trans-1,2-cyclohexanediaminetetra-acetic Acid Ferric Complex Salt | 80 |

(*): (mV vs. NHE, pH = 6)

The oxidation reduction potential of the bleaching agent is defined as the oxidation reduction potential obtained by the method described in *Transactions of the Faraday Society*, Vol. 55, (1959), pages 1312–1313.

In the present invention, from the viewpoints of rapid processing and effectively obtaining the effects of this invention, the oxidation reduction potential of the bleaching agent is preferably not lower than 150 mV, more preferably not lower than 180 mV, and most preferably not lower than 200 mV. If the oxidation reduction potential of the bleaching agent is too high, bleaching fog occurs. Hence, the upper limit is 700 mV, and preferably 500 mV.

In the above-described aminopolycarboxylic acid ferric complex salts, compound No. 7, 1,3-propylenediaminetetraacetic ferric complex salt is particularly preferred.

The aminopolycarboxylic acid ferric complex salt is used as the salt of sodium, potassium, ammonium, etc., but the ammonium salt is preferred in the point of showing fastest bleaching.

The amount of the bleaching agent for the bleaching solution is preferably from 0.01 to 0.7 mol per liter of the bleaching solution and is also preferably from 0.15 to 0.7 mol in the points of rapid processing and reducing the occurrence of stains with the passage of time. The amount thereof is particularly preferably from 0.30 to 0.6 mol. Also, the amount of the bleaching agent for the blixing solution is preferably from 0.01 to 0.5 mol, and more preferably from 0.02 to 0.2 mol per liter of the blixing solution.

In the present invention, the bleaching agents may be used singly or in combination. When using two or more in combination, the total concentration may be adjusted such that it is within the range described above.

The aminopolycarboxylic acid ferric complex salt for the bleaching solution can be used in the form of the complex salt itself or as an aminopolycarboxylic acid (complex-forming compound) and ferric salt (e.g., ferric sulfate, ferric chloride, ferric nitrate, ammonium ferric sulfate, and ferric phosphate) may coexist in the bleaching solution to form the complex salt in the bleaching solution.

When the complex salt is formed in the bleaching solution as described above, the amount of the aminopolycarboxylic acid may be slightly excessive to the amount necessary for forming the complex salt with a ferric ion and in this case, it is preferably used excessively in the range of from 0.01 to 10%.

The bleaching solution is generally used at pH of from 2 to 7.0. For rapid processing, the pH of the bleaching solution is preferably from 2.5 to 5.0, more preferably from 3.0 to 4.8, and most preferably from 3.5 to 4.5. It is preferred that the replenisher for the bleaching solution has a pH of from 2.0 to 4.2.

In this invention, for adjusting the pH in the above-described range, conventional acids can be used. The acids used have preferably pKa of from 2 to 5.5, wherein pKa is defined as the logarithmic value of the reciprocal of an acid dissociation constant and is obtained under the condition of an ionic strength of 0.1 mol/dm (at 25° C.).

It is preferred that the bleaching solution contains at least 0.5 mol/liter of an acid having pKa in the range of from 2.0 to 5.5 for preventing the occurrence of bleaching fog and the precipitation in the replenisher at low temperature with the passage of time.

The acid having pKa of from 2.0 to 5.5, include: inorganic acids such as phosphoric acid, etc., and organic acids such as acetic acid, malonic acid, citric acid, etc. The acid having pKa from 2.0 to 5.5 effectively showing the aforesaid effect is preferably the organic acid. Also, in the organic acids, the organic acid having a carboxy group is particularly preferred.

The organic acid having pKa of from 2.0 to 5.5 may be a monobasic acid or a polybasic acid. In the case of the polybasic acid, the acid can be used in the form of a metal salt (e.g., a sodium salt and a potassium salt) or an ammonium salt if the pKa thereof is within the range of from 2.0 to 5.5. Also, the organic acids having pKa from 2.0 to 5.0 can be used as a mixture of two or more kinds thereof. With proviso that aminopolycarboxylic acids, the salts thereof, and the Fe complex salts thereof are excluded from the acids described above.

Preferred practical examples of the organic acid having pKa of from 2.0 to 5.5, which can be used in this invention, include aliphatic monobasic acids such as acetic acid, monochloroacetic acid, monobromic acid, glycolic acid, propionic acid, monochloropropionic acid, lactic acid, pyruvic acid, acrylic acid, butyric acid, isobutyric acid, pivaric acid, aminobutyric acid, valeric acid, isovaleric acid, etc.; amino acid series compounds such as asparagine, alanine, arginine, ethionine, glycine, glutamine, cysteine, serine, methionine, leucine, etc.; aromatic monobasic acids such as benzoic acid, monosubstituted benzoic acids (e.g., chlorobenzoic acid and hydroxybenzoic acid), nicotinic acid, etc.; aliphatic dibasic acids such as oxalic acid, malonic acid, succinic acid, tartaric acid, malic acid, maleic acid, fumaric acid, oxaloacetic acid, glutaric acid, adipic acid, etc.; amino acid series dibasic acids such as asparagic acid, glutamic acid, cystine, etc.; aromatic dibasic acids such as phthalic acid, terephthalic acid, etc.; and polybasic acids such as citric acid, etc.

Of these acids, the monobasic acids having a hydroxy group or a carboxy group are preferred, and glycolic acid and lactic acid are particularly preferred.

The amount of the glycolic acid or lactic acid is preferably from 0.2 to 2 mols, and more preferably. from 0.5 to 1.5 mols per liter of the bleaching solution. These acids are preferred since they remarkably exhibit the full effects of this invention, emit no odors, and restrain the occurrence of bleaching fog.

Also, the combination use of acetic acid and glycolic acid or lactic acid is preferred since the simultaneously solve the precipitation and bleaching fog. The ratio of acetic acid to glycolic acid or lactic acid is preferably from ½ to 2/1.

The total amounts of these acids are properly at least 0.5 mol, preferably from 1.2 to 2.5 mols, and more preferably from 1.5 to 2.0 mols per liter of the bleaching solution.

In the case of controlling the pH of the bleaching solution in the foregoing range, an alkali agent (e.g., aqueous ammonia, potassium hydroxide, sodium hydroxide, imidazole, monoethanolamine, and diethanolamine) may be used together with the acid(s). Among these alkali agents, aqueous ammonia is preferred.

Also, the preferred alkali agent which is used as a bleaching starer when preparing a starting solution of a bleaching solution from a replenisher, include: potassium carbonate, aqueous ammonia, imidazole, monoethanolamine or diethanolamine. Also, the diluted. replenisher may be used alone without the bleaching starter.

In the present invention, various bleaching accelerators can be added to the bleaching solutions or the prebaths thereof. Examples of the bleaching accelerator include the compounds having a mercapto group or a disulfido group described in U.S. Pat. No. 3,893,858, German Patent 1,290,821, British Patent 1,138,842, JP-A-53-95630, and *Research Disclosure*, No. 17129 (July, 1978); the thiazolidine derivatives described in JP-A-50-140129; the thiourea derivatives described in U.S. Pat. No. 3,706,561; the iodides described in JP-A-58-16235; the polyethylene oxides described in German Patent 2,748,430; and the polyamine compounds described in JP-B-45-8836. The mercapto compounds described in British Patent 1,138,842 and JP-A-2-190856 are particularly preferred.

The bleaching solution for use in this invention can further contain a rehalogenating agent such as bromides (e.g., potassium bromide, sodium bromide, and ammonium bromide) and chlorides (e.g., potassium chloride, sodium chloride, and ammonium chloride). The concentration of the rehalogenating agent is preferably from 0.1 to 5.0 mols, and more preferably from 0.5 to 3.0 mols per liter of the bleaching solution.

Also, it is preferred to use ammonium nitrate for the bleaching solution as a metal corrosion inhibitor.

In the present invention, a replenishing system is preferably used and the replenishing amount for the bleach solution is preferably not more than 600 ml, and more preferably from 100 to 500 ml per square of the color photographic material being processed.

The bleaching processing time is preferably 120 seconds or less, more preferably 50 seconds or less, and most preferably 40 seconds or less.

In addition, at processing, it is preferred that the bleaching solution containing an aminopolycarboxylic acid ferric complex salt is subjected to aeration to oxidize the aminopolycarboxylic acid ferrous complex salt formed, whereby the oxidizing agent (bleaching agent) is regenerated and the photographic performance is very stably kept.

In processing with the bleaching solution in this invention, it is preferred to apply a so-called evaporation correction, that is, to supply water corresponding to the evaporated amount of water of the bleaching solution. This is particularly preferred in the bleaching solution containing a color developer and a bleaching agent having a high electric potential.

There is no particular restriction on the practical method of supplying such water, but the evaporation correction method of using a monitering bath separately from the bleaching bath, determining the evaporation amount of water in the monitering bath, calculating the evaporation amount of water in the bleach bath from the evaporation amount of water thus determined, and supplying water to the bleaching bathing in proportion to the evaporation amount in the bleaching bath described in JP-A-1-254959 and JP-A-1-254960 and the evaporation correction method using a liquid level sensor or an overflow sensor described in Japanese Patent Application Nos. 2-46743, 2-47777, 2-47778, 2-47779, and 2-117972 are preferred.

In the present invention, the color photographic material after processed by the bleaching solution is processed by a processing solution having a fixing ability. The processing solution having a fixing ability is practically a fixing solution or a blixing solution. When processing step having a bleaching ability is carried out using a blixing solution, the step may also include a fixing ability as step (5) described before. In steps (2) and (4), wherein a color photographic material is processed with a blixing solution after bleaching with a bleaching solution, the bleaching agent in the bleaching solution may differ from the bleaching agent in the blixing solution. Also, in the case of employing a washing step between the bleaching step and the blixing step as step (3) described above, the compound for use in this invention may be incorporated in the washing solution.

The processing solution having a fixing ability contains a fixing agent. Examples of the fixing agents include thiosulfates such as sodium thiosulfate, ammonium thiosulfate, sodium ammonium thiosulfate, potassium thiosulfate, etc.; thiocyanates (rhodanates) such as sodium thiocyanate, ammonium thiocyanate, potassium thiocyanate, etc.; thiourea; thioethers, etc. In these compounds, ammonium thiosulfate is preferably used. The amount of the fixing agent is preferably from 0.3 to 3 mols, and more preferably from 0.5 to 2 mols per liter of the processing solution having the fixing ability.

Also, from the view point of fixing acceleration, it is preferred to use ammonium thiocyanate (ammonium rhodanate), thiourea, or a thioether (e.g., 3,6-dithia-1,8-octanediol) together with the thiosulfate. Of these, a combination of the thiosulfate and the thiocyanate is most preferred. The combination of ammonium thiosulfate and ammonium thiocyanate is particularly preferred. The amount of the compound which is used together with the thiosulfate is preferably from 0.01 to 1 mol, and more preferably from 0.1 to 0.5 mol per liter of the processing solution having a fixing ability but, as the case may be, by using the compound in an amount of from 1 to 3 mols, the fixing accelerating effect can be greatly increased.

The processing solution having a fixing ability can contain a sulfite (e.g., sodium sulfite, potassium sulfite, and ammonium sulfite), hydroxylamines, hydrazines, hydrogensulfite addition products of aldehyde compounds (e.g. acetaldehyde sodium hydrogensulfite, and particular preferably the compounds described in JP-A-3-158848 and EP 432499), or the sulfinic acid compounds described in JP-A-1-231051 as a preservative. Furthermore, the processing solution can contain various optical brightening agents, defoaming agents, surface active agents, polyvinylpyrrolidone, and organic solvents such as methanol, etc.

Furthermore, it is preferred that the processing solution having a fixing ability contains a chelating agent such as various aminopolycarboxylic acids, organic phosphonic acids, etc., for stabilizing the processing solution. Examples of preferred chelating agents include 1-hydroxyethylidene-1,1-diphosphonic acid, ethylenediamine-N,N,N',N'-tetramethylenephosphonic acid, nitrilotrimethylenephosphonic acid, ethylenediaminetetraacetic acid, diethylenetriaminepentaacetic acid, cyclohexanediaminetetraacetic acid, 1,2-propylenediaminetetraacetic acid, etc. Of these compounds, 1-hydroxyethylidene-1,1-diphosphonic acid and ethylenediaminetetraacetic acid are particularly preferred.

The amount of the chelating agent is preferably from 0.01 to 0.3 mol, and more preferably from 0.1 to 0.2 mol per liter of the processing solution.

The pH of the fix solution is preferably from 5 to 9, and more preferably from 7 to 8. Also, the pH of the blixing solution is preferably from 4.0 to 7.0, and more preferably from 5.0 to 6.5. Furthermore, the pH of the blixing solution after processing with a bleaching solution or a first blixing solution is preferably from 6 to 8.5, and more preferably from 6.5 to 8.0.

For controlling the processing solution having a fixing ability to the pH range, a compound having pKa of from 6.0 to 9.0 is preferably used as a buffer. Imidazoles such as imidazole, 2-methylimidazole, etc., are preferred as the buffer. The amount of such a buffer preferably from 0.1 to 10 mols, and more preferably from 0.2 to 3 mols per liter of the processing solution.

The blixing solution can further contain the above compounds which can be used for the bleaching solution.

In the present invention, the blixing solution (starting solution) at the initiation of processing is prepared by dissolving the above-described compounds for blixing solution in water or by mixing a bleaching solution and a fixing solution.

The replenishing amount for the fixing solution or the blixing solution in the case of employing a replenishing system is preferably from 100 to 3000 ml, and more preferably from 300 to 1800 ml per square meter of the color photographic material. The replenisher for the blixing solution may be replenished as a replenisher for blixing solution or may be replenished by using the overflow solutions of the bleaching solution and the fixing solution as described in JP-A-61-143755 and EP 0427204A1 corresponding to Japanese Patent Application No. 2-216389.

Also, in bleaching process described above, it is preferred that the blixing process is carried out while supplying water corresponding to evaporated water and replenishing the replenisher for the blixing solution.

Furthermore, in the present invention, the total processing time of the processing step having a fixing ability is preferably from 0.5 to 4 minutes, more preferably from 0.5 to 2 minutes, and most preferably from 0.5 to 1 minute.

In the present invention, the sum of the total processing times of the desilvering steps composed of a combination of bleaching, blixing, and fixing is preferably from 45 seconds to 4 minutes, and more preferably from 1 minute to 2 minutes. Also, the processing temperature is preferably from 25° C. to 50° C., and more preferably from 35° C. to 45° C.

From the processing solution having a fixing ability in this invention, silver can be recovered and then the regenerated solution after silver recovery can be reused. The effective silver recovering methods are an electrolysis method (described in French Patent 2,299,667), a precipitation method (described in JP-A-52-73037 and German Patent 2,331,220), an ion exchange method (described in JP-A-51-17114 and German Patent 2,548,237), and a metal substitution method (described in British Patent 1,353,805). These silver recovering methods are preferably carried out for the tank solutions in an in-line system since the rapid processing aptitude can be further improved.

After the processing step having a fixing ability, a washing step is usually carried out. However, a simple processing method wherein after processing with the processing solution having a fixing ability, stabilization process using the stabilizing solution containing the compound for use in this invention is carried out without applying substantial washing can be used.

Washing water used in the washing step can contain the surface active agent which can be contained in the stabilizing solution described above, an anti-bacterial agent, an antifungal agent, a germicide, a chelating agent, and the above preservative which can be contained in the processing solution having a fixing ability.

The washing step and the stabilization step are preferably carried out by a multistage counter-current system and in this system, the stage number is preferably from 2 or 4. The replenishing amount for the washing step or the stabilization step is preferably from 1 to 50 times, more preferably from 2 to 30 times, and most preferably from 2 to 15 times the carried amount of a processing solution from the pre-bath per unit area of the color photographic material being processed.

As water used for the washing step, city water can be used, but water deionized with ion exchange resins, etc., to reduce the concentrations of Ca ions and Mg ions to 5 mg/liter or less and water sterilized by a halogen, a ultraviolet sterilizing lamp, etc., are preferably used.

Also, as water for supplying evaporated water of each processing solution, city water may be used, but water deionized and water sterilized, which can be preferably used for the washing step, are preferably used.

Also, by a method of introducing the overflow solution from the washing step or the stabilization step into the bath having a fixing ability, which is the prebath thereof, the amount of the waste solution can be preferably reduced.

In the processing steps, it is preferred to supply a suitable amount of water, a correction water, or a processing replenisher to not only the bleaching solution, the blixing solution, and the fixing solution but also to other processing solutions (e.g., the color developer, washing water, and stabilizing solution) for correcting the concentration by evaporation.

In the present invention, when the total time from bleaching process to drying step is generally from 1 minute to 3 minutes, and preferably from 1 minute and 20 seconds to 2 minutes, the effect of the present invention of particularly effectively obtained.

In the present invention, the drying temperature is preferably from 50° C. to 65° C., and more preferably from 50° C. to 60° C., and the drying time is preferably from 30 seconds to 2 minutes, and more preferably from 40 seconds to 80 seconds.

The color photographic material processed by the processing of the present invention can have at least one of a blue-sensitive silver halide emulsion layer, a green-sensitive silver halide emulsion layer, and a red-sensitive silver halide emulsion layer on a support and there is no particular restriction on the layer number and the layer disposition order of the silver halide emulsion layers and light-insensitive layers.

A typical example thereof is a silver halide color photographic material having on a support at least a light-sensitive layer composed of plural silver halide emulsion layers each having a substantially same color sensitivity but having a different light sensitivity, the light-sensitive layer is a unit light-sensitive layer having a color sensitivity to blue light, green light or red light, and in a multilayer silver halide color photographic material, the unit light-sensitive layers are disposed on a support in the order of a red-sensitive layer, a green-sensitive layer, and a blue-sensitive layer from the support side. However, according to the purpose, other disposition order of the color-sensitive layers may be employed and also a layer structure that light-sensitive layers having a same color sensitivity have a light-sensitive layer having a different color sensitivity between the layers may be employed.

Furthermore, light-insensitive layers such as the uppermost layer, the lowermost layer, interlayers, etc., may be formed in addition to the silver halide light-sensitive emulsion layers.

The interlayers may contain the couplers, etc., described in JP-A-61-43748, JP-A-59-113438, JP-A-59-113440, JP-A-61-20037, and JP-A-61-20038 and also may contain color mixing inhibitors, ultraviolet absorbers, stain inhibitors (anti-stain agents), etc.

As plural silver halide emulsion layers constituting each unit light-sensitive layer, the two-layer structure of a high-speed emulsion layer and a low-speed emulsion layer as described in West German Patent 1,121,470 and British Patent 923,045 can be preferably used. Usually, it is preferred that these light-sensitive layers are disposed such that the light-sensitivity becomes successively lower towards the support and in this case, a light-insensitive layer may be formed between the light-sensitive emulsion layers. Also, a low-speed emulsion layer may be placed farther from the support and a high-speed emulsion layer may be placed near the support as described in JP-A-57-112751, JP-A-62-200350, JP-A-62-206541, and JP-A-62-206543.

In practical examples, the silver halide emulsion layers can be placed on a support from the farthest side of the support in the order of a low-speed blue-sensitive emulsion layer (BL)/a high-speed blue-sensitive emulsion layer (BH)/a high-speed green-sensitive emulsion layer (GH)/a low-speed green-sensitive emulsion layer (GL)/a high-speed red-sensitive emulsion layer (RH)/a low-speed red-sensitive emulsion layer (RL), in the order of BH/BL/GL/GH/RH/RL, or in the order of BH/BL/GH/GL/RL/RH.

Also, they can be also placed from the farthest side of a support, in the order of a blue-sensitive emulsion layer/GH/RH/GL/RL as described in JP-B-55-34932. Furthermore, they can be also placed from the farthest side of a support, in the order of a blue-sensitive emulsion layer/GL/ RL/GH/RH as described in JP-A-56-25738 and JP-A-62-63936. Moreover, a three-layer structure composed of the highest light-sensitive emulsion layer as the upper layer, a light-sensitive emulsion layer having a lower light-sensitivity than the upper layer as in inter layer, and a silver halide emulsion layer having a far lower light sensitivity than the inter layer as the lower layer as described in JP-B-49-15495 can be used. Even in the case composed of three layers each having a different light sensitivity, the layers may be disposed in the order of the medium-speed light-sensitive emulsion layer/the high-speed light-sensitive emulsion layer/the low-speed light-sensitive emulsion layer from the side apart from a support in a same color-sensitive layer as described in JP-A-59-202464.

As described above, various layer structures and layer dispositions can be selected according to the purpose of the color photographic light-sensitive material.

The dry layer thickness of the whole constituting layers of the color photographic material excluding the support, the subbing layer on the support and the back layer is preferably from 12.0 μm to 20.0 μm, and more preferably from 12.0 μm to 18.0 μm from the view points of preventing the formation of bleaching fog and preventing the occurrence of stains with the passage of time.

The layer thickness of a color photographic material is measured as follows. That is, the color photographic material being measured is stored for 7 days under the conditions of 25° C., 50% RH after the preparation thereof, the whole thickness of the color photographic material is first measured, and then, after removing the coated layers on the support, the thickness thereof is measured again, and the difference of the thicknesses is defined as the layer thickness of the whole coated layers of the color photographic material excluding the support. The thickness can be measured using, for example, a film measuring device by a contact type piezoelectric conversion element (K-403B Stand., trade name, manufactured by Anritsu Electric Co., Ltd.). In addition, the coated layers on the support can be removed using an aqueous sodium hypochlorite solution. Also, by photographing the cross section of the color photographic material using a scanning type electron microscope (magnification is preferably 3,000 or more), the thickness of the whole layers on the support can be determined.

In the present invention, the swelling ratio the color photographic material is preferably from 50 to 200%, and more preferably from 70 to 150%. The swelling ratio is defined by the following formula:

$$\text{Swelling ratio} = (A - B)/B \times 100(\%)$$

A: Equilibrium swollen layer thickness in water at 25° C.

B: Whole dry layer thickness at 25° C., 55% RH.

If the swelling ratio falls outside the preferred ranges, residue from a color developing agent increases and photographic performance, image qualities, such as desilvering property, etc., and film properties, such as the film strength, are adversely affected.

The swelling speed of a color photographic material in the present invention, represented by $T_{\frac{1}{2}}$ is preferably 15 seconds or less, and more preferably 9 seconds or less, wherein $T_{\frac{1}{2}}$ is defined as the time for the swelling to decrease to one half of a saturated swollen layer thickness. This saturated swollen layer thickness is defined as 90% of the maximum swollen layer thickness attained when the color photographic material is processed in a color developer at 38° C. for 3 minutes and 15 seconds.

The silver halide contained in the photographic emulsion layers of the color photographic material being processed by the process of the present invention may be silver bromide, silver iodochlorobromide, silver chlorobromide, silver bromide or silver chloride. The preferred silver halide is silver iodobromide, silver iodochloride, or silver iodochlorobromide containing about 0.1 to 30 mol % of silver iodide. Silver iodobromide containing from 2 to 25 mol % of silver iodide is particularly preferred.

The silver halide grains in the photographic silver halide emulsions may have a regular crystal form, such as cubic, octahedral, tetradecahedral, etc.; an irregular crystal form, such as spherical, tabular, etc.; or a crystal defect such as twin planes, etc.; or a composite form of them.

The grain sizes of the silver halide grains may be fine as about 0.2 micron or less or as large as up to about 10 microns in projected area diameters. Also, the silver halide emulsion may be polydispersed emulsion or monodispersed.

The silver halide photographic emulsions for use in this invention can be prepared by using the methods described, e.g., in *Research Disclosure (RD)*, No. 17643 (December), pages 22–23, "I. Emulsion Preparation and Types", ibid., No. 18716 (November, 1979 ), page 648, P. Glafkides, *Chimie et Physique Photographique*, published by Paul Montel, 1967, G. F. Duffin, *Photoqraphic Emulsion Chemistry*, published by Focal Press, 1966, and V. L. Zelikman et al, *Making and Coating Photoqraphic Emulsion*, published by Focal Press, 1964.

The monodisperse silver halide emulsion described in U.S. Pat. Nos. 3,574,628 and 3,655,394 and British Patent 1,413,748 is preferably used. Furthermore, tabular silver halide grains having an aspect ratio of at least about 5 can be used in this invention. The tabular silver halide grains can be prepared as described in Gutoff, *Photographic Science and Engineering*, Vol. 14, 248–257(1970, U.S. Pat. Nos. 4,434,226, 4,414,310, 4,430,048, and 4,439,520, and British Patent 2,112,157.

The crystal structure of the silver halide grains may have a uniform halogen composition throughout the whole grain, may have a different halogen composition between the inside and the surface portion thereof, or may have a multilayer structure. Also, a silver halide having a different halogen composition may be junctioned to the silver halide grains by an epitaxial junction. Also the silver halide grains may be junctioned to a compound other than silver halide, such as silver rhodanate, lead oxide, etc.

Also, a mixture of silver halide grains having various crystal forms can be used in the present invention.

Silver halide emulsions are usually subjected to physical ripening, chemical ripening, and a spectral sensitization before use. Additives used in these steps are described in *Research Disclosure (RD)*, No. 17643 (December,1978), ibid., No. 18716 (November, 1979), and ibid., No. 307105 (November, 1989) and the corresponding portions are summarized in the following table.

Also, photographic additives which can be used in the present invention are described in the three publications (RD) and the related portions are shown in the same table.

| Kind of Additive | RD 17643 | RD 18716 | RD 307105 |
|---|---|---|---|
| 1. Chemical Sensitizer | p. 23 | p. 648, right column (RC) | p. 866 |
| 2. Sensitivity Increasing Agent | — | p. 648, right column (RC) | — |
| 3. Spectral Sensitizer, Super sensitizer | pp. 23–24 | p. 648, RC to p. 649, RC | pp. 866–868 |
| 4. Brightening Agent | p. 24 | p. 647, RC | p. 868 |
| 5. Anti-foggant, Stabilizer | pp. 24–25 | p. 649, RC | pp. 868–870 |
| 6. Light Absorber, Filter Dye, UV Absorber | pp. 25–26 | p. 649, RC to p. 650, left column (LC) | p. 873 |
| 7. Anti-staining Agent | p. 25, RC | p. 650, LC to RC | p. 872 |
| 8. Dye Image Stabilizer | p. 25 | p. 650, LC | p. 872 |
| 9. Hardener | p. 26 | p. 651, LC | pp. 874–875 |
| 10. Binder | p. 26 | p. 651, LC | pp. 873–874 |
| 11. Plasticizer, Lubricant | p. 27 | p. 650, RC | p. 876 |
| 12. Coating Aid, Surfactant | pp. 26–27 | p. 650, RC | pp. 875–876 |
| 13. Anti-static Agent | p. 27 | p. 650, RC | pp. 876–877 |
| 14. Matting Agent | — | — | pp. 878–879 |

Various color couplers can be used in the color photographic materials. Practical examples of typical couplers are described in patents cited in *Research Disclosure*, No. 17643, VII-C to G and ibid., No. 07105, VII-C to G.

Examples of preferred yellow coupler are described in U.S. Pat. Nos. 3,933,501, 4,022,620, 4,326,024 4,401,752, 4,248,961, 3,973,968, 4,314,023, and 4,511,649, JP-B-58-10739, British Patent 1,425,020 and 1,476,760, and European Patent 249,473A.

Preferred magenta couplers are 2-equivalent and 4-equivalent 5-pyrazolne series and pyrazoloazole series compounds. The more preferred magenta couplers are described in U.S. Pat. Nos. 4,310,619, 4,351,897, 3,061,432, 3,725,064, 4,500,630, 4,540,654, and 4,556,630, European Patent 73,636, *Research Disclosure*, No. 24220 (June 1984), ibid., No. 24230 (June, 1984), JP-A-60-33552, JP-A-60-43659, JP-A-61-72238, JP-A-60-5730, JP-A-55-118034, and JP-A-60-185951, and WO(PCT) 8/04795.

In the present invention, the effect of this invention becomes more remarkable when at least one kind of a 4-equivalent magenta coupler is used.

Preferred 4-equivalent magenta couplers are the 4-equivalent 5-pyriazolone series magenta couplers represented by formula (M) and the 4-equivalent pyrazoloazole series magenta couplers represented by formula (m).

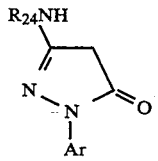
(M)

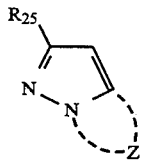
(m)

In formula (M), $R_{24}$ represents an alkyl group, an aryl group, an acyl group, or a carbamoyl group. Ar represents a substituted or unsubstituted phenyl group. Either $R_{24}$ or Ar may be a divalent or higher valent group forming a polymer, such as a dimer or a polymer coupler, which links the coupling mother nucleus to the main chain of a polymer.

In formula (m), $R_{25}$ represents a hydrogen atom or a substituent and Z represents a non-matellic atomic group necessary for forming a 5-membered azole ring containing 2 to 4 nitrogen atoms. This azole ring may have a substituent or a condensed ring. In addition, either $R_{25}$ or the group substituting the azole ring may become a divalent or higher valent group to form a polymer such as a dimer or a polymer coupler, or form a polymer coupler by bonding a high molecular chain with a coupling mother nucleus.

In formula (M), the alkyl group represented by $R_{24}$ represents a straight or branched alkyl group having from 1 to 42 carbon atoms, an aralkyl group, an alkenyl group, an alkynyl group, a cycloalkyl group, or a cycloalkenyl group; the aryl group represented by $R_{24}$ represents an aryl group having from 6 to 46 carbon atoms; the acyl group represented by $R_{24}$ is an aliphatic acyl group having from 2 to 32 carbon atoms or an aromatic acyl group having from 7 to 46 carbon atoms;. and the carbamoyl group represented by $R_{24}$ is an aliphatic carbamoyl group having from 2 to 32 carbon atoms or an aromatic carbamoyl group having from 7 to 46 carbon atoms.

These groups each may have a substituent and the substituent is an organic substituent or a halogen atom bonding with a carbon atom, an oxygen atom, a nitrogen atom or a sulfur atom. Examples of the substituent are an alkyl group, an aryl group, a heterocyclic group, a cyano group, a hydroxy group, a nitro group, a carboxy group, an amino group, an acyl group, an aryloxycarbonyl group, an alkoxycarbonyl group, a carbamoyl group, an alkoxy group, an aryloxy group, a heterocyclic oxy group, an acyloxy group, a carbamoyloxy group, a silyloxy group, an aryloxycarbonylamino group, an acylamino group, an alkylamino group, an anilino group, a ureido group, a sulfamoylamino group, an alkoxycarbonylaimo group, a sulfonamido group, an aryloxycarbonylamino group, an imido group, an alkylthio group, an arylthio group, a heterocyclic thio group, a sulfamoyl group, a sulfonyl group, a sulfinyl group, an azo group, a phosphonyl group, an azolyl group, a fluorine atom, a chlorine atom, and a bromine atom.

$R_{24}$ represents, in more detail, an alkyl group (e.g., methyl, ethyl, butyl, propyl, octadecyl, isopropyl, t-butyl, cyclopentyl, cyclohexyl, methoxyethyl, ethoxyethyl, t-butoxyethyl, phenoxyethyl, methanesulfonylethyl, and 2-(2,4-di-tert-amylphenoxy)ethyl), an aryl group (e.g., phenyl, 2-chlorophenyl, 2-methoxyphenyl, 2-chloro-5-tetradecanamidophenyl, 2-chloro-5-(3-octadecenyl-1-succinimido)phenyl, 2-chloro-5-octadecylsulfonamidophenyl, and 2-chloro-5-[2-(4-hydroxy-3-tretbutylphenoxy)tetradecanamidophenyl]), an acyl group (e.g., acetyl, pivaloyl, tetradecanoyl, 2-(2-,4-di-tertpentylphenoxy)acetyl, 2-(2,4-di-tert-pentylphenoxy)butanoyl, benzoyl, and 3-(2,4-di-tret-amylphenoxyacetamido)benzoyl), or a carbamoyl group (e.g., N-methylcarbamoyl, N,N-dimethylcarbamoyl, N-hexadecylcarbamoyl, N-methyl-N-phenylcarbamoyl, and N-[3-{2,4-di-tert-pentylphenoxy)butylamido}]-phenylcarbamoyl).

$R_{24}$ is preferably an aryl group or an acyl group.

In formula (M), Ar represents a substituted or unsubstituted phenyl group. The preferred substitute for the phenyl group include a halogen atom, an alkyl group, a cyano group, an alkoxy group, an alkoxycarbonyl group, or an acylamino group. In more detail, Ar is, for example, phenyl, 2,4,6-trichlorophenyl, 2,5-dichlorophenyl, 2,4-dimethyl-6-methoxyphenyl, 2,6-dichloro-4-methoxyphenyl, 2,6-dichloro-4-ethoxycarbonylphenyl, 2,6-dichloro-4-cyanophenyl, or 4-[2-(2,4-ditert-amylphenoxy)butylamido]phenyl.

Ar is preferably a substituted phenyl group, more preferably a phenyl group substituted with at least one halogen atom (in particular, chlorine), and most preferably 2,4,6-trichlorophenyl or 2,5-dichlorophenyl.

Of the pyrazoloazole series magenta couplers represented by formula (m), the preferred couplers include 1H-imidazo[1,2-b]pyrazole 1H-pyrazolo[1,5-b][1,2,4]-triazole, 1H-pyrazolo[5,1-c][1,2,4]triazole, and 1H-pyrazolol[1,5-d]tetrazole skeletons and they are represented by formulae (m-1), (m-2), (m-3) and (m-4).

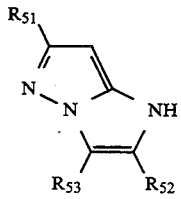
(m-1)

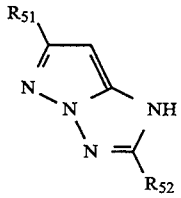
(m-2)

-continued

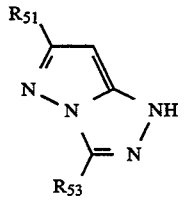

(m-3)

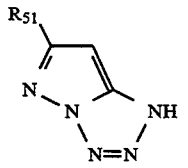

(m-4)

Then, $R_{25}$, $R_{51}$, $R_{52}$, and $R_{53}$ in formula (m) and the above formulae (m-1), (m-2), (m-3) and (m-4) are explained.

$R_{25}$ and $R_{51}$ each represents a hydrogen atom or a substituent and Examples of the substituent, include a halogen atom, an alkyl group, an aryl group, a heterocyclic group, a cyano group, a hydroxy group, a sulfo group, a nitro group, a carboxy group, an amino group, an alkoxy group, an aryloxy group, an acylamino group, an alkylamino group, an anilino group, a ureido group, a sulfamoylamino group, an alkylthio group, an aryl thio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, and an azolyl group.

These groups may be substituted by the same group of substituents for $R_{24}$. Also, $R_{25}$ and $R_{51}$ each may be a divalent group or higher valent group to form a polymer such as a dimer or a polymer coupler, or for a polymer coupler by bonding a high molecular chain with a coupling mother nucleus.

In more detail, $R_{25}$ and $R_{51}$ each represents a hydrogen atom, a halogen atom (e.g., chlorine and bromine), or an alkyl group (which may be a straight chain, branched, or cyclic). The alkyl group includes an aralkyl group, an alkinyl group, and a cycloalkyl group.

$R_{25}$ and $R_{51}$ each represents preferably an alkyl group having from 1 to 32 carbon atoms (e.g., methyl, ethyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)phenoxy]dodecanamido}phenyl}propyl, 2-ethoxytridecyl, trifluoromethyl, cyclopentyl, 3-(2,4-di-t-amylphenoxy)propyl), an alkenyl group (e.g., allyl), an aryl group (e.g., phenyl, 4-t-butylphenyl, 2,4-di-t-amylphenyl, and 4-tetradecanamidophenyl), a heterocyclic group (e.g., 2-furyl, 2-thienyl, 2-pyrimidinyl, and 2-benzothiazolyl), a cyano group, a hydroxy group, a sulfo group, a nitro group, a carboxy group, an amino group, an alkoxy group (e.g., methoxy, ethoxy, 2-methoxyethoxy, 2-dodecyloxyethoxy, and 2-methanesulfonylethoxy), an aryloxy group (e.g., phenoxy, 2-methylphenoxy, 4-t-butylphenoxy, 3-nitrophenoxy, 3-t-butyloxycarbamoylphenoxy, and 3-methoxycarbamouylphenoxy), an acylamino group (e.g., acetamido, benzamide, tetradecanamide, 2-(2,4-di-t-amylpheoxy)butanamide, 4-(3-t-butyl-4-hydroxyphenoxy)butanamide, and 2-{4-(4-hydroxyphenylsulfonyl)phenoxy}decanamide), an alkylamino group (e.g., methylamino, butylamino, dodecylamino, diethylamino, and methylbutylamino), an anilino group (e.g., phenylamino, 2-chloroanilino, 2-chloro-5-tetradecanaminoanilino, 2-chloro-5-dodecyloxycarbonylanilino, N-acetylanilino, and 2-chloro-5-{α-(3-t-butyl-4-hydroxyphenoxy)dodecanamido}anilino), a ureido group (e.g., phenylureido, methylureido, and N,N-dibutylureido), a sulfamoylamino group (e.g., N,N-dipropylsulfamoylamino and N-methyl-N-decylsulfamoylamino), an alkylthio group (e.g., methylthio, octylthio, tetradecylthio, 2-phenoxyethylthio, 3-phenoxypropylthio, and 3-(4-t-butylphenoxy)propylthio), an arylthio group (e.g., phenylthio, 2-butoxy-5-t-octylphenylthio 3-pentadecylphenylthio, 2-carboxyphenylthio, and 4-tetradecanamidophenylthio), an alkoxycarbonylamino group (e.g., methoxycarbonylamino and tetradecyloxycarbonylamino), a sulfonamide group (e.g., methanebenzenesulfonamide, hexadecanesulfonamide, benzenesulfonamide, p-toluenesulfonamide, octadecanesulfonamide, and 2-methoxy-5-butylbenzenesulfoneamide), a carbamoyl group (e.g., N-ethylcarbamoyl, N,N-dibutylcarbamoyl, N-(2-dodecyloxyethyl)carbamoyl, N-methyl-N-dodecylcarbamoyl, and N-{3-(2,4-t-amylphenoxy)-propyl}carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a sulfonyl group (e.g., methanesulfonyl, octanesulfonyl, benzenesulfonyl, and toluenesulfonyl), an alkoxycarbonyl group (e.g., methoxycarbonyl, butyloxycarbonyl, dodecyloxycarbonyl, and octadecyloxycarbonyl), a heterocyclic oxy group (e.g., 1-phenyltetrazol-5-oxy and 2-tetrahydropyranyloxy), an azo group (e.g., phenylazo, 4-methoxyphenylazo, 4-pivaloylaminophenylazo, and 2-hydroxy-4-propanoylphenylazo), an acyloxy group (e.g., acetoxy), a carbamoyloxy group (e.g., N-methylcarbamoyloxy and N-phenylcarbamoyloxy), a silyloxy group (e.g., trimethylsilyloxy and dibutylmethylsilyloxy), an aryloxycarbonylamino group (e.g., phenoxycarbonylamino), an amido group (e.g., N-succinimido, N-phthalimido, and 3-octadencenylsuccinimido), a heterocyclic thio (e.g., 2-benxothiazolylthio, 2,4-diphenoxy-1,3,5-triazole-6-thio, and 2-pyridylthio), a sulfinyl group (e.g., dodecansulfonyl, 3-pentadecylphenylsulfinyl, and 3-phenoxypropylsulfinyl), a phosphonyl group (e.g., phenoxysulfonyl, octyloxysulfonyl, and phenylsulfonyl), an aryloxycarbonyl group (e.g., phenoxycarbonyl), an acyl group (e.g., acetyl, 3-phenylpropanoyl, benzoyl, and 4-dodecyloxybenzoyl), or an azolyl group (e.g., imidazolyl, pyrazolyl, 3-chloro-pyrazol-1-yl, and triazolyl).

$R_{25}$ and $R_{51}$ are preferably an alkyl group, an aryl group, an alkoxy group, an aryloxy group, an alkylthio group, an ureido group, a urethane group, or an acylamino group.

$R_{52}$ has the same meaning as $R_{51}$ and is preferably a hydrogen atom, an alkyl group, an aryl group, a heterocyclic group, an alkoxycarbonyl group, a carbamoyl group, a sulfamoyl group, a sulfinyl group, an acyl group, or a cyano group.

Also, $R_{53}$ has the same meaning as $R_{51}$ and is preferably a hydrogen atom, an alkyl group, an aryl group, a heterocyclic group, an alkoxy group, an aryloxy group, an alkylthio group, an arylthio group, an alkoxycarbonyl group, a carbamoyl group, or an acyl group, and more preferably an alkyl group, an aryl group, a heterocyclic group, an alkylthio group, or an arylthio group.

The effect of this invention becomes particularly remarkable when the 4-equivalent pyrazolone series magenta couplers represented by formula (M) are used.

Specific non-exclusive examples of the preferred 4-equivalent magenta couplers are illustrated below.

(M-1)

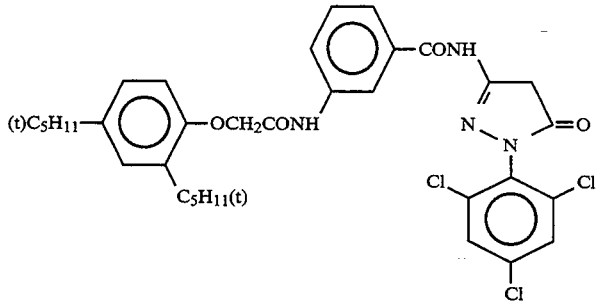

(M-2)

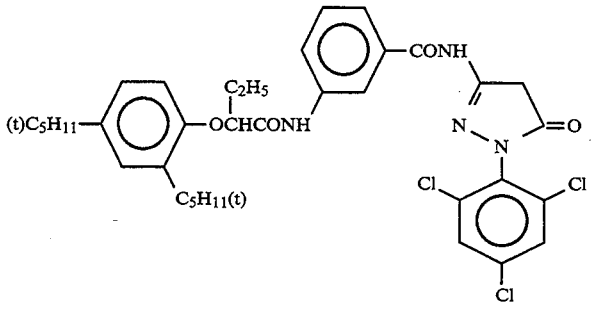

(M-3)

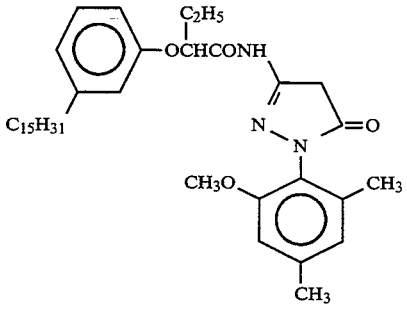

(M-4)

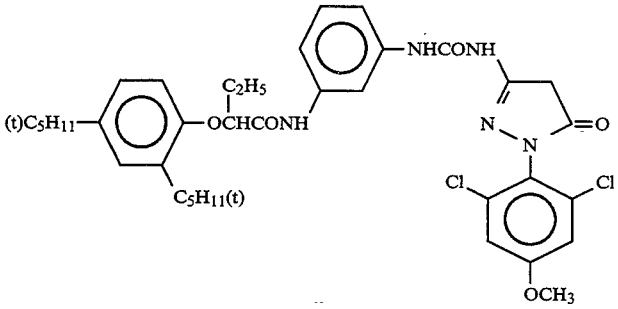

-continued
(M-5)
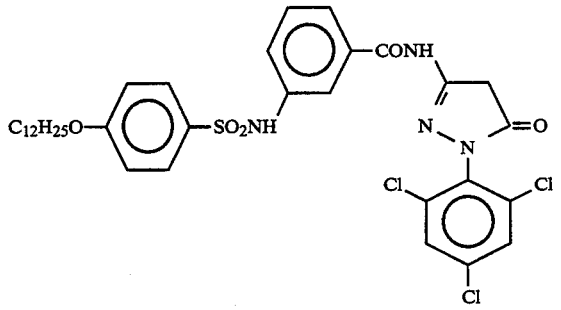
(M-6)
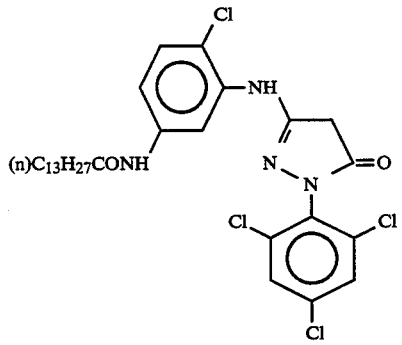
(M-7)
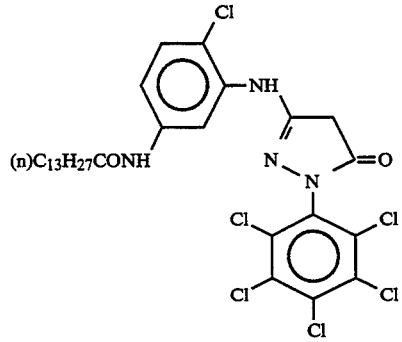
(M-8)
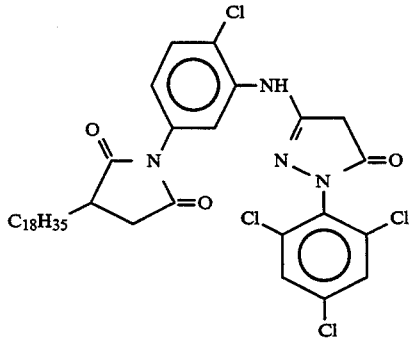
(M-9)
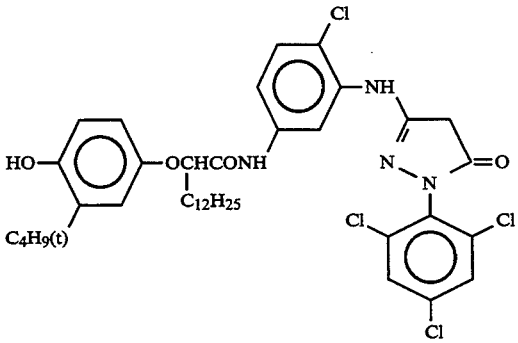

-continued
(M-10)
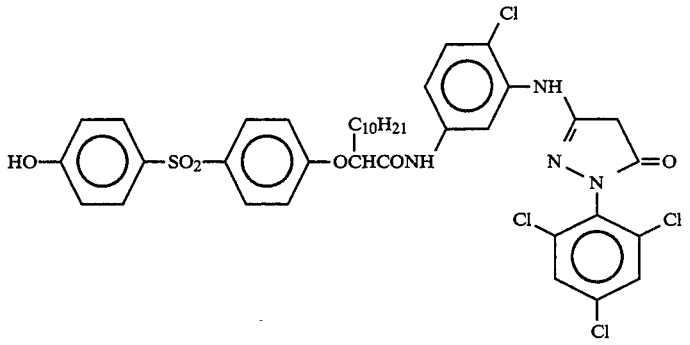
(M-11)
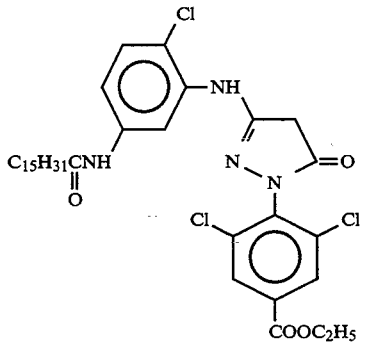
(M-12)
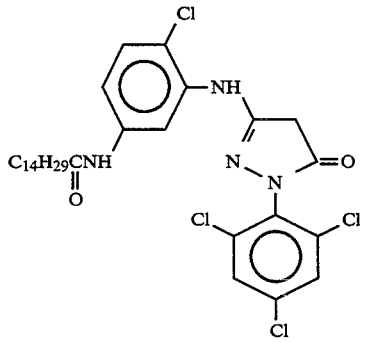
(M-13)
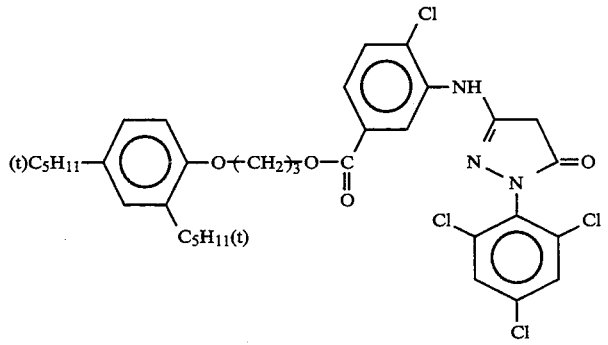

-continued
(M-14)
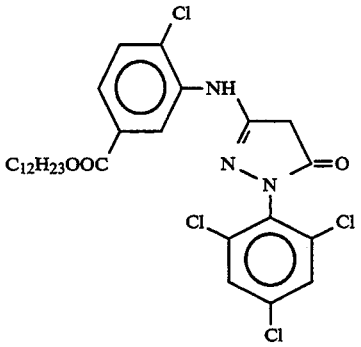
(M-15)
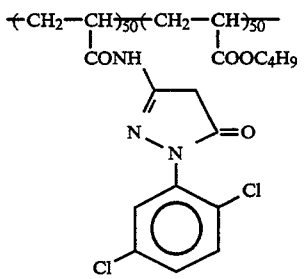
The number is weight %
mean molecular Weight: about 25,000
(M-16)
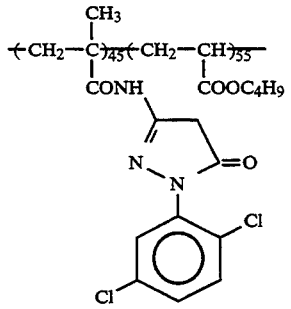
The number is weight %
mean molecular Weight: about 30,000
(M-17)
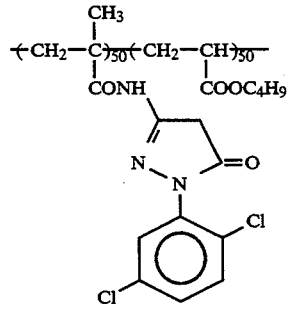
The number is weight %
mean molecular Weight: about 30,000

-continued
(M-18)
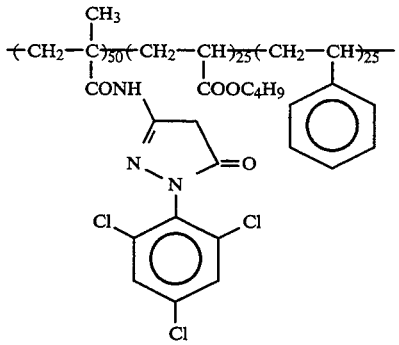
The number is weight %
mean molecular Weight: about 20,000
(M-19)
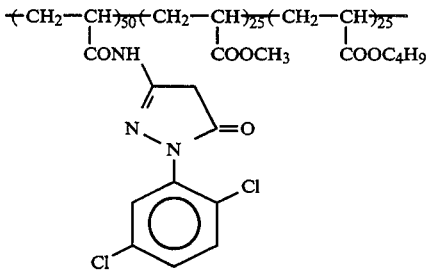
The number is weight %
mean molecular Weight: about 40,000
(M-20)
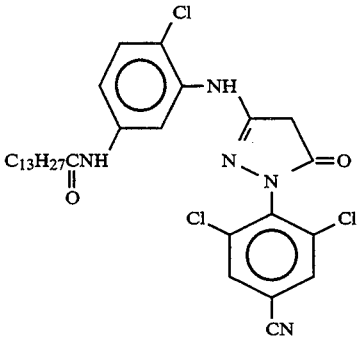
(M-21)
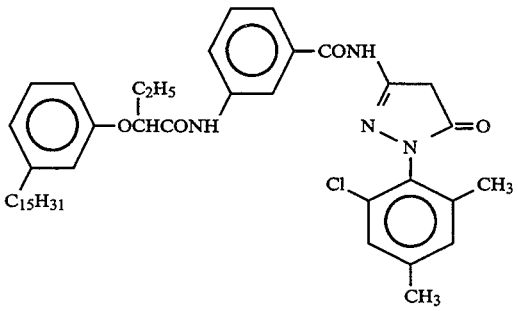

-continued
(M-22)
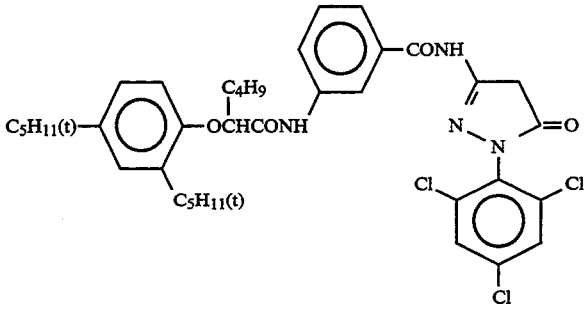
(M-23)
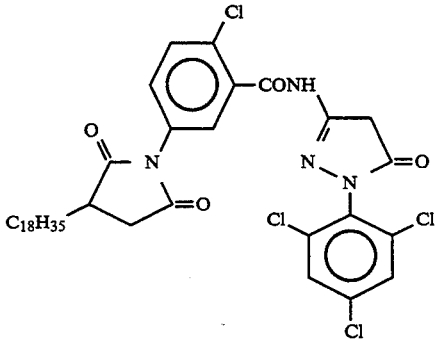
(M-24)
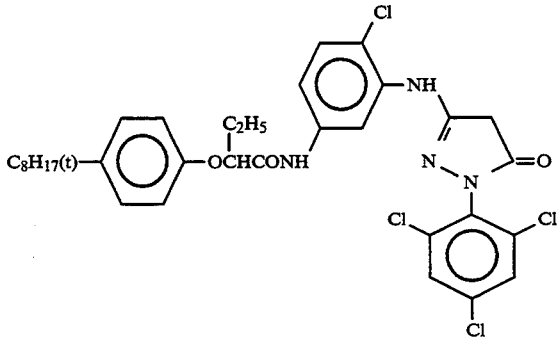
(M-25)
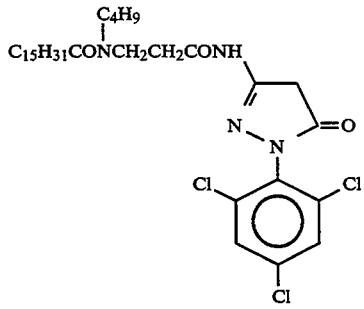
(M-26)
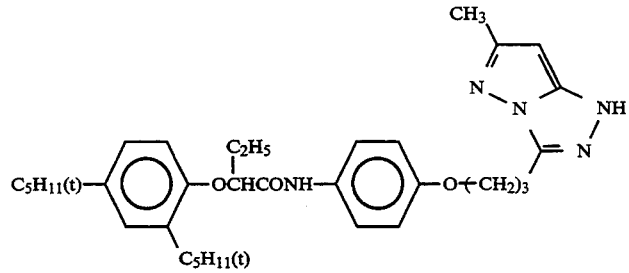

-continued
(M-27)
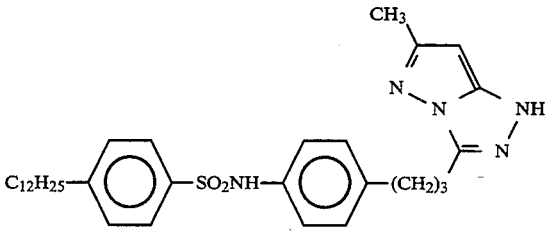
(M-28)
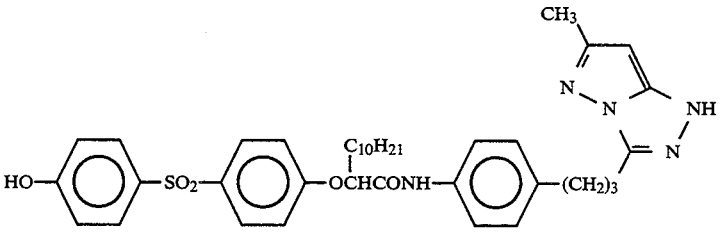
(M-29)
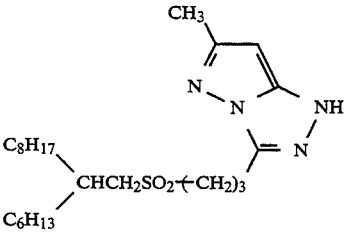
(M-30)
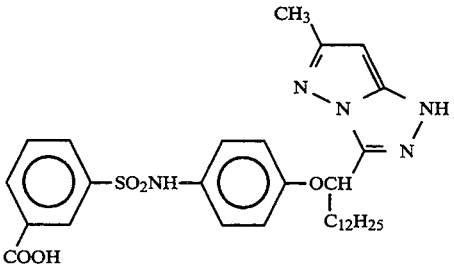
(M-31)
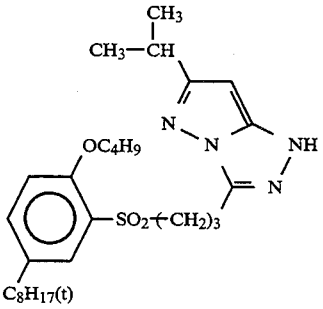
(M-32)
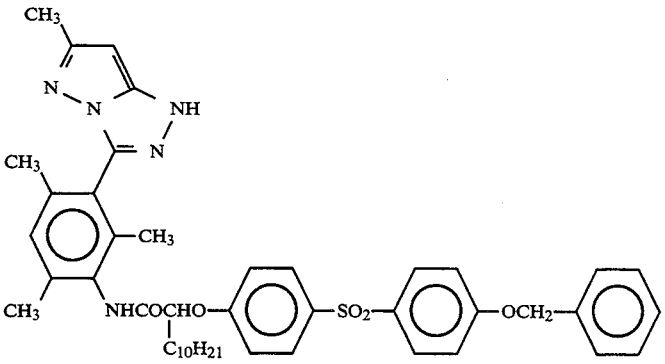

-continued
(M-33)
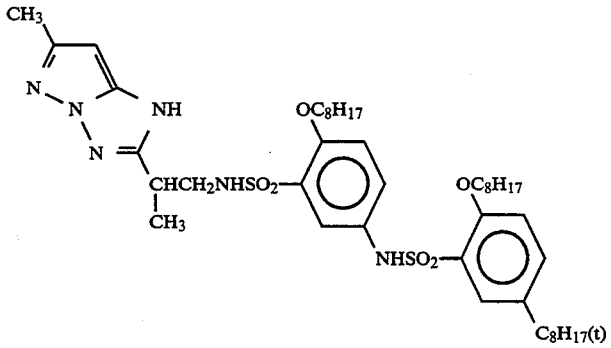
(M-34)
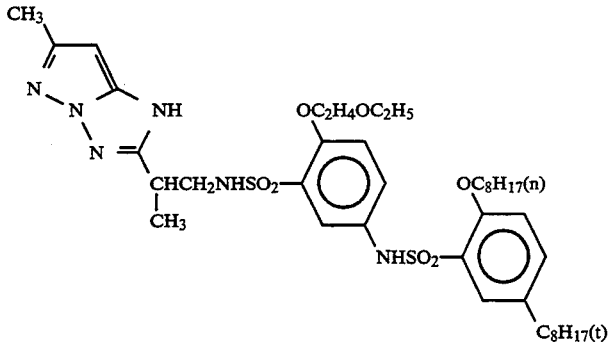
(M-35)
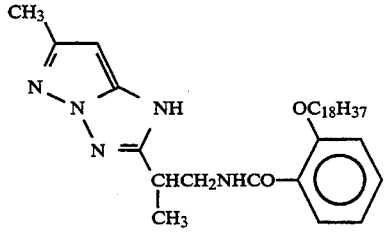
(M-36)
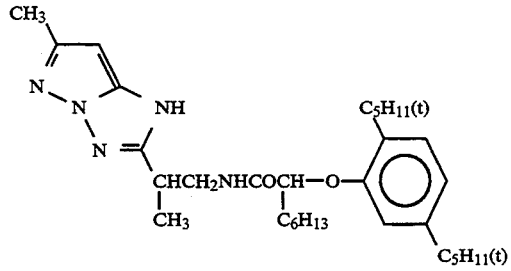
(M-37)
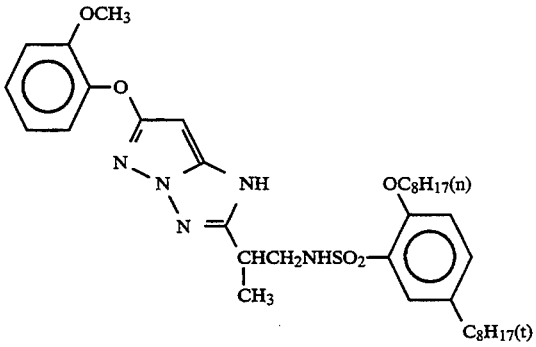

-continued (M-38)

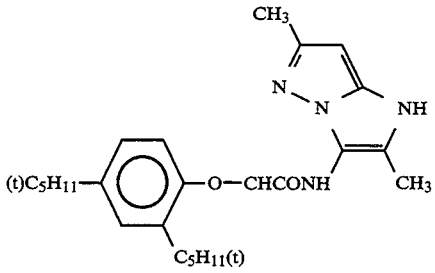

(M-39)

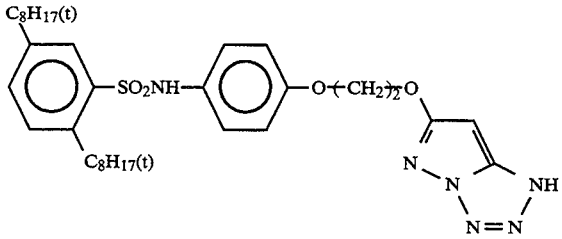

(M-40)

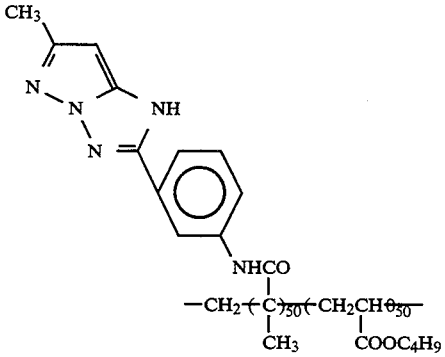

The number is Weight %
mean molecular Weight: about 30,000

(M-41)

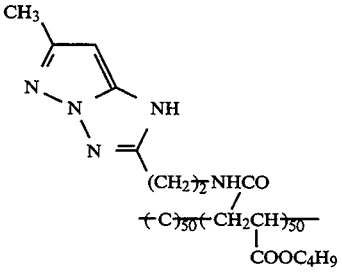

The number is weight %
mean molecular Weight: about 20,000

In the present invention, the coating amount of the 4-equivalent magenta coupler is preferably from $0.4\times10^{-3}$ to $3.5\times10^{-3}$ mol per square mater of the color photographic material. Additionally, the 4-equivalent magenta coupler may be used together with a 2-equivalent magenta.

A cyan coupler can be used in the color photographic material, such as phenolic couplers and naphtholic couplers and those cyan couplers described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Publication (OLS) 3,329,729, European Patents 121,365A and 249,453A, U.S. Pat. Nos. 3,446,622, 4,333,999, 4,753,871, 4,451,559, 4,427,767, 4,690,889, 4,254,212, 4,296,199, JP-A-3-196037 and JP-A-61-42658.

Particularly, pyrrolotriazole, pyrroloimidazole, imidazopyrazole, imidazole, pyrazolotriazole, a cyclic active methine coupler (e.g., those described in JP-A-2-302078, JP-A-2-322051, JP-A-3-226325, JP-A-3-236894, JP-A-64-32250, and JP-A-2-141745) are preferred.

A colored coupler for correcting unnecessary absorption of colored dye can be used in the present invention. Preferred colored couplers are described in *Research Disclosure*, No. 17643, VII-G, U.S. Pat. Nos. 4,163,670, 4,004,929, and 4,138,258, JP-B-57-39413, British Patent 1,146,368, and Japanese Patent Application No. 2-50137. Also preferred are couplers for correcting unnecessary absorption of a colored dye by a fluorescent dye released therefrom at coupling as described in U.S. Pat. No. 4,774,181. Couplers having a dye precursor capable of forming a dye by reacting with a color developing agent as a releasing group described in U.S. Pat. No. 4,777,120 is preferably used in this invention.

In the present invention, a coupler giving a colored dye having a proper diffusibility can be also used in this invention. Preferred couplers are described in U.S. Pat. No. 4,366,237, British Patent 2,125,570, European Patent 96,570 and West German Patent Publication (OLS) 3,234,533.

Also, in the present invention, polymerized dye-forming couplers can be used. Typical examples of the polymerized coupler are described in U.S. Pat. Nos. 3,451,820, 4,080,211, 4,367,282, 4,409,320, and 4,576,910, and British Patent 2,102,173.

Furthermore, preferred couplers release a photographically useful residue upon coupling. Preferably, the couplers imagewise releasing a nucleating agent or a developing accelerator are described in British Patents 2,097,140 and 2,131,188, JP-A-59-157638 and JP-A-59-170840.

Other couplers in the color photographic materials processed by this invention are competing couplers described in U.S. Pat. No. 4,130,427, couplers releasing a dye which is color-restored described in European Patent 173,302A, bleaching accelerator-releasing couplers described in *Research Disclosure*, No. 11449, ibid., No. 24241, and JP-A-61-201247, ligand-releasing couplers described U.S. Pat. No. 4,553,477, couplers releasing a leuco dye described in JP-A-63-75747, and couplers releasing a fluorescent dye described in U.S. Pat. No. 4,774,181.

The couplers for use in this invention can be introduced into color photographic light-sensitive materials by various dispersion methods.

An oil drop-in-water dispersion method of a high-boiling point organic solvent are described in U.S. Pat. No. 2,322,027, etc. Practical examples of a high-boiling point organic solvent (boiling point of 175° C. or more at normal pressure) used for the oil drop-in-water dispersion method include phthalic acid esters [e.g., dibutyl phthalate, dicyclohexyl phthalate, di-2-ethylhexyl phthalate, decylphthalate, bis(2,4-di-amylphenyl)phthalate, bis(2,4-di-t-amylhenyl)isophthalate, and bis(1,1-diethylpropyl)phthalate], phosphoric acid esters and phosphonic acid eaters (e.g., triphenyl phosphate, tricresyl phosphate, 2-ethyl-hexyldiphenyl phosphate, trichlorohexyl phosphate, tri-2-ethylhexyl phosphate, tridecyl phosphate, tributoxyethyl phosphate, trichloropropyl phosphate, and di-2-ethylhexylphenyl phosphonate), benzoic acid esters (e.g., 2-ethylhexyl benzoate, dodecyl benzoate, and 2-ethylhexyl-p-hydroxy benzoate), amides (e.g., N,N-diethyldodecanamido, N,N-benzoate), diethyllaurylamide, and N-tetradecylpyrrolidone), alcohols and phenols (e.g., isostearyl alcohol and 2,4-di-tert-amylphenol), aliphatic carboxylic acid esters [e.g., bis(2-ethylhexyl)sebacate, dioctyl azelate, glycerol tributyrate, isostearyl lactate, and trioctyl citrate], aniline derivatives (e.g., N,N-dibutyl-2-butoxy-5-tertoctylaniline ), and hydrocarbons (e.g., paraffin, dodecylbenzene, and diisopropylnaphthalene ).

Also, an organic solvent (boiling point of about 30° C. or more, and preferably from about 50° C. to 160° C.) can be used as an auxiliary solvent in dispersion methods. Typical examples are ethyl acetate, butyl acetate, ethyl propionate, methyl ethyl ketone, cyclohexanone, 2-ethoxyethyl acetate, and dimethyl-formamide.

A latex dispersion method can also be used. Practical examples of the steps and effects of the latex dispersion method as well as the latexes for impregnation are described in U.S. Pat. No. 4,199,363, West German Patent Publications (OLS) 2,541,274 and 2,541,230.

Also, the couplers can be dispersed by emulsification in an aqueous hydrophilic colloid solution impregnated with a loadable latex polymer and couplers, in the presence or absence of the described high-boiling organic solvent (as described in U.S. Pat. No. 4,203,716), or after dissolving the couplers in a polymer which is insoluble in water but soluble in an organic solvent. Preferred such polymers are the homopolymers or copolymers described in WO(PCT) 88/00723, pages 12 to 30. Acrylamide series polymers are particularly preferred to stabilize dye images.

Supports suitable used for the color photo-graphic materials of the present invention are described in *Research Disclosure*, No. 17643, page 28 and ibid., No. 18716, from page 647, right column to page 648, left column.

The present invention can be applied to various kinds of color photographic materials. Preferably, the invention can be used for processing general or cine color negative photographic films and reversal photographic films for slides or television.

WORKING EXAMPLES

The invention is described in more detail by the following non-exclusive examples:

EXAMPLE 1

1. Layers

A multilayer color photographic material (Sample 101) was used as a support. Sample 101 had the following layer compositions arranged on a cellulose triacetate film support having a subbing layer.

The coated amounts are given in units of g/m$^2$. The silver halide emulsion and colloid silver, coated amounts are given in units of g/m$^2$ based on the silver content thereof. Coated amounts for couplers additives, and gelatin are given in units of g/m$^2$. Coated amounts for sensitizing dyes are given in units of mols per mol of silver halide contained in the same layer.

| | |
|---|---|
| Layer 1 (Antihalation Layer) | |
| Black Colloid Silver | 0.20 as Ag |
| Gelatin | 2.20 |
| UV-1 | 0.11 |
| UV-2 | 0.22 |
| Cpd-1 | $4.0 \times 10^{-2}$ |
| Cpd-2 | $1.9 \times 10^{-2}$ |
| Solv-1 | 0.30 |
| Solv-2 | $1.2 \times 10^{-2}$ |
| Layer 2 (Interlayer) | |
| Fine Grain Silver Iodobromide (AgI: 1.0 mol %, sphere-corresponding diameter: 0.07 μm) | 0.15 as Ag |
| Gelatin | 1.00 |
| ExC-4 | $6.0 \times 10^{-2}$ |
| Cpd-3 | $2.0 \times 10^{-2}$ |
| Layer 3 (1st Red-Sensitive Emulsion Layer) | |
| Silver Iodobromide Emulsion (AgI: 5.0 mol %, surface high AgI type, sphere-corresponding diameter: 0.9 μm, variation coeff. of sphere-corresponding diameters: 21%, tabular grains, aspect ratio (diameter/thickness): 7.5) | 0.42 as Ag |
| Silver-Iodobromide Emulsion (AgI: 4.0 mol %, inside high AgI type, sphere-corresponding diameter: 0.4 μm, variation coeff. of sphere-corresponding diameters: 18%, tetradecahedral grains) | 0.40 as Ag |
| Gelatin | 1.90 |
| ExS-1 | $4.5 \times 10^{-4}$ |

-continued

| | |
|---|---|
| ExS-2 | $1.5 \times 10^{-4}$ |
| ExS-3 | $4.0 \times 10^{-5}$ |
| ExC-1 | 0.65 |
| ExC-3 | $1.0 \times 10^{-2}$ |
| ExC-4 | $2.3 \times 10^{-2}$ |
| Solv-1 | 0.32 |
| Layer 4 (2nd Red-Sensitive Emulsion Layer) | |
| Silver Iodobromide Emulsion (AgI: 8.5 mol %, inside high AgI type, sphere-corresponding diameter: 1.0 μm, variation coeff. of sphere-corresponding diameters: 25%, tabular grains, aspect ratio: 3.0) | 0.85 |
| Gelatin | 0.91 |
| ExS-1 | $3.0 \times 10^{-4}$ |
| ExS-2 | $1.0 \times 10^{-4}$ |
| ExS-3 | $3.0 \times 10^{-5}$ |
| ExC-1 | 0.13 |
| ExC-2 | $6.2 \times 10^{-2}$ |
| ExC-4 | $4.0 \times 10^{-2}$ |
| Solv-1 | 0.10 |
| Layer 5 (3rd Red-Sensitive Emulsion) | |
| Silver Iodobromide Emulsion (AgI: 11.3 mol %, inside high AgI type, sphere-corresponding diameter: 1.4 μm, variation coeff. of sphere-corresponding diameters, tabular grains, aspect ratio: 6.0) | 1.50 |
| Gelatin | 1.20 |
| ExS-1 | $2.0 \times 10^{-4}$ |
| ExS-2 | $6.0 \times 10^{-5}$ |
| ExS-3 | $2.0 \times 10^{-5}$ |
| ExC-2 | $8.5 \times 10^{-2}$ |
| ExC-5 | $7.3 \times 10^{-2}$ |
| ExC-6 | $1.0 \times 10^{-2}$ |
| Solv-1 | 0.12 |
| Solv-2 | 0.12 |
| Layer 6 (Interlayer) | |
| Gelatin | 1.00 |
| Cpd-4 | $8.0 \times 10^{-2}$ |
| Solv-1 | $8.0 \times 10^{-2}$ |
| Layer 7 (1st Green-Sensitive Emulsion Layer) | |
| Silver iodobromide Emulsion (AgI: 5.0 mol %, surface high AgI type, sphere-corresponding diameter: 0.9 μm, variation coeff. of sphere-corresponding diameters: 21%, tabular grains, aspect ratio: 7.0) | 0.28 |
| Silver iodobromide Emulsion (AgI: 4.0 mol %, inside high AgI type, sphere-corresponding diameter: 0.4 μm, variation coeff. of sphere-corresponding diameter: 18%, tetradecahedral grains) | 0.16 |
| Gelatin | 1.20 |
| ExS-4 | $5.0 \times 10^{-4}$ |
| ExS-5 | $2.0 \times 10^{-4}$ |
| ExS-6 | $1.0 \times 10^{-4}$ |
| ExM-1 | 0.50 |
| ExM-2 | 0.10 |
| ExM-5 | $3.5 \times 10^{-2}$ |
| Solv-1 | 0.20 |
| Solv-3 | $3.0 \times 10^{-2}$ |
| Layer 8 (2nd Green-Sensitive Emulsion Layer) | |
| Silver iodobromide Emulsion (AgI: 8.5 mol %, Inside high AgI type, sphere-corresponding diameter: 1.0 μm, variation coeff. of sphere-corresponding diameters: 25%, tabular grains, aspect ratio: 3.0) | 0.57 |
| Gelatin | 0.45 |
| ExS-4 | $3.5 \times 10^{-4}$ |
| ExS-5 | $1.4 \times 10^{-4}$ |
| ExS-6 | $7.0 \times 10^{-5}$ |
| ExM-1 | 0.12 |
| ExM-2 | $7.1 \times 10^{-3}$ |
| ExM-3 | $3.5 \times 10^{-2}$ |
| Solv-1 | 0.15 |
| Solv-3 | $2.0 \times 10^{-2}$ |
| Layer 9 (Interlayer) | |
| Gelatin | 0.50 |
| Solv-1 | $2.0 \times 10^{-2}$ |

-continued

| | |
|---|---|
| Layer 10 (3rd Green-Sensitive Emulsion Layer) | |
| Silver iodobromide Emulsion (AgI: 11.3 mol %, Inside high AgI type, sphere-corresponding diameter: 1.4 μm, variation coeff. of sphere-corresponding diameters: 28%, tabular grains, aspect ratio: 6.0) | 1.30 |
| Gelatin | 1.20 |
| ExS-4 | $2.0 \times 10^{-4}$ |
| ExS-5 | $8.0 \times 10^{-5}$ |
| ExS-6 | $8.0 \times 10^{-5}$ |
| ExM-4 | $4.5 \times 10^{-2}$ |
| ExM-6 | $1.0 \times 10^{-2}$ |
| ExC-2 | $4.5 \times 10^{-3}$ |
| Cpd-5 | $1.0 \times 10^{-2}$ |
| Solv-1 | 0.25 |
| Layer 11 (Yellow Filter Layer) | |
| Gelatin | 0.50 |
| Cpd-6 | $5.2 \times 10^{-2}$ |
| Solv-1 | 0.12 |
| Layer 12 (Interlayer) | |
| Gelatin | 0.45 |
| Cpd-3 | 0.10 |
| Layer 13 (1st Blue-Sensitive Emulsion Layer) | |
| Silver iodobromide Emulsion (AgI: 2 mol %, uniform AgI type, sphere-corresponding diameter: 0.55 μm, variation coeff. of sphere-corresponding diameters: 25%, tabular grains, aspect ratio: 7.0) | 0.20 |
| Gelatin | 1.00 |
| ExS-7 | $3.0 \times 10^{-4}$ |
| ExY-1 | 0.60 |
| ExY-2 | $2.3 \times 10^{-2}$ |
| Solv-1 | 0.15 |
| Layer 14 (2nd Blue-Sensitive Emulsion Layer) | |
| Silver iodobromide Emulsion (AgI: 19.0 mol %, inside high type, sphere-corresponding diameter: 1.0 μm, variation coeff. of sphere-corresponding diameters: 16%, octahedral grains) | 0.19 |
| Gelatin | 0.35 |
| ExS-7 | $2.0 \times 10^{-4}$ |
| ExY-1 | 0.22 |
| Solv-1 | $7.0 \times 10^{-2}$ |
| Layer 15 (Interlayer) | |
| Fine Grain Silver iodobromide (AgI: 2 mol %, uniform AgI type, sphere-corresponding diameter: 0.13 μm) | 0.20 |
| Gelatin | 0.36 |
| Layer 16 (3rd Blue-Sensitive Emulsion Layer) | |
| Silver iodobromide Emulsion (AgI: 14.0 mol %, inside high type, sphere-corresponding diameter: 1.7 μm, variation coeff. of sphere-corresponding diameters: 28%, tabular grains, aspect ratio: 5.0) | 1.55 |
| Gelatin | 1.00 |
| ExS-8 | $1.5 \times 10^{-4}$ |
| ExY-1 | 0.21 |
| Solv-1 | $7.0 \times 10^{-2}$ |
| Layer 17 (1st Protective Layer) | |
| Gelatin | 1.80 |
| UV-1 | 0.13 |
| UV-2 | 0.21 |
| Solv-1 | $1.0 \times 10^{-2}$ |
| Solv-2 | $1.0 \times 10^{-2}$ |
| Layer 18 (2nd Protective Layer) | |
| Fine Grain Silver Chloride (sphere-corresponding diameter: 0.07 μm) | 0.36 |
| Gelatin | 0.70 |
| B-1 (diameter 1.5 μm) | $2.0 \times 10^{-2}$ |
| B-2 (diameter 1.5 μm) | 0.15 |
| B-3 | $3.0 \times 10^{-2}$ |
| W-1 | $2.0 \times 10^{-2}$ |
| H-1 | 0.35 |
| Cpd-7 | 1.00 |

The working example contained: 1,2-benzisothiazolin-3-one in an average amount of about 200 ppm based on gelatin; n-butyl-p-hydroxy benzoate in an average amount of about 1,000 ppm based on gelatin; and 2-phenoxy ethanol in an average amount of about 10,000 ppm based on gelatin. Furthermore, the working example contained these compounds: B-4, B-5, W-2, W-3, F-1, F-2, F-3, F-4, F-5, F-6, F-7, F-8, F-9, F-10, F-11, F-12, and F-13, an iron salt, a lead salt, a gold salt, a platinum salt, an iridium salt, and a rhodium salt.

2. Chemical Structures

The chemical structures used in this working example are shown below:

UV-1

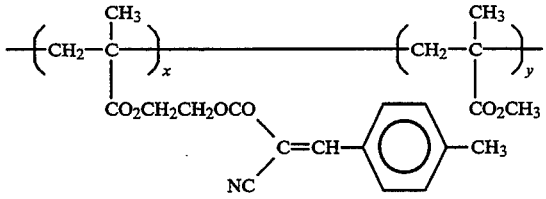

x/y = 7/3 (weight ratio)

UV-2

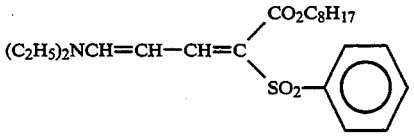

ExC-1

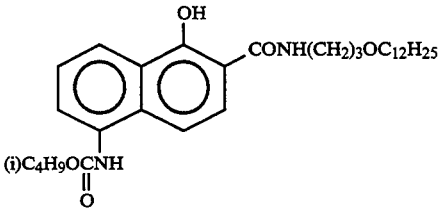

ExC-2

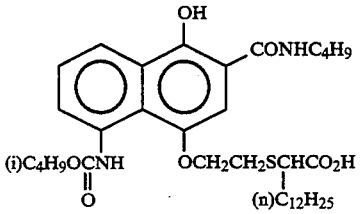

ExC-3

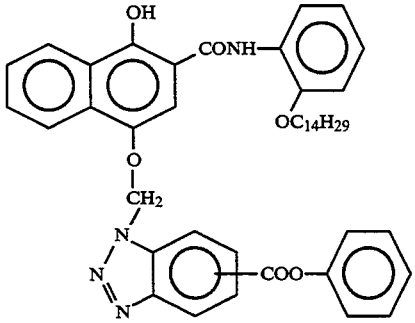

ExC-4

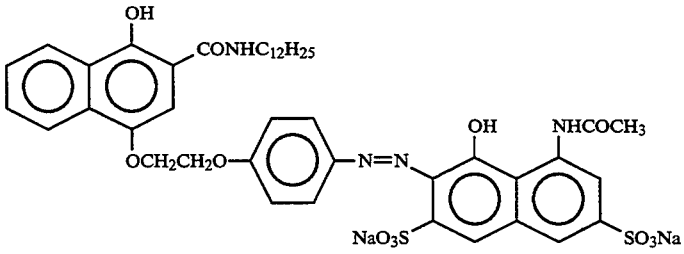

ExC-5

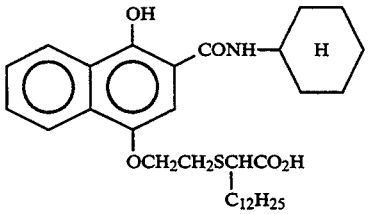

-continued
ExC-6
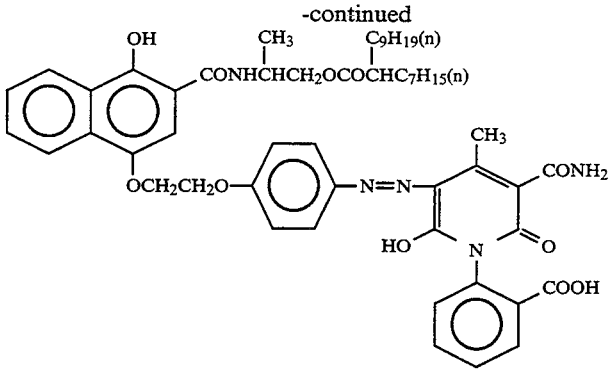
ExM-1
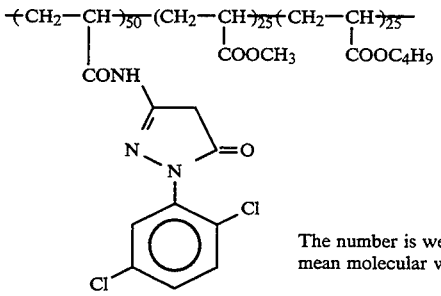
The number is weight %
mean molecular weight: about 40,000
ExM-2
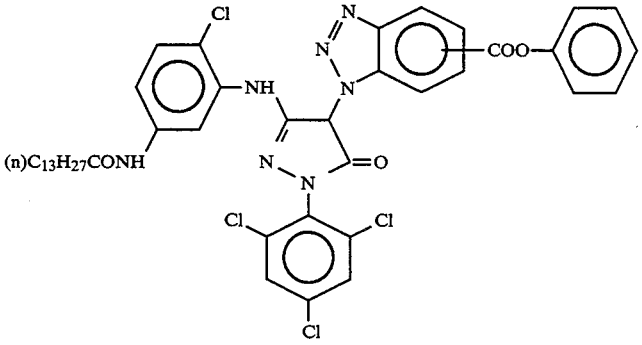
ExM-3
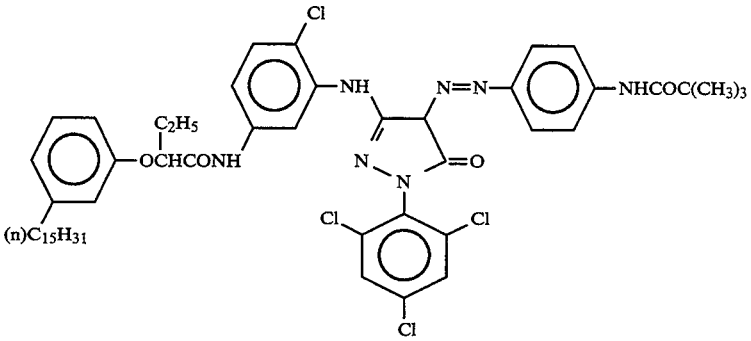
ExM-4
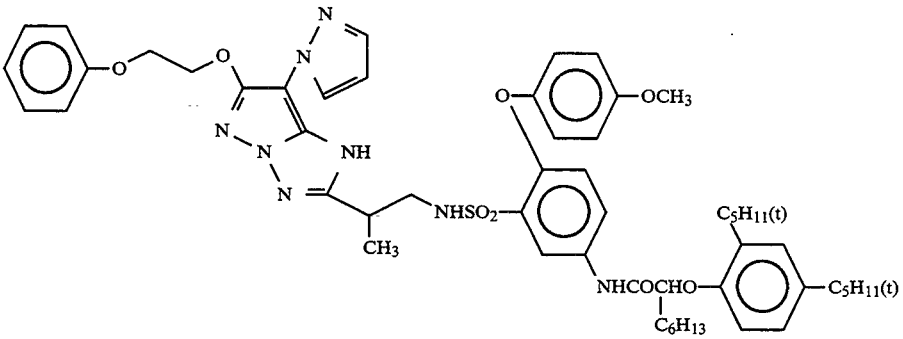

-continued
ExM-5
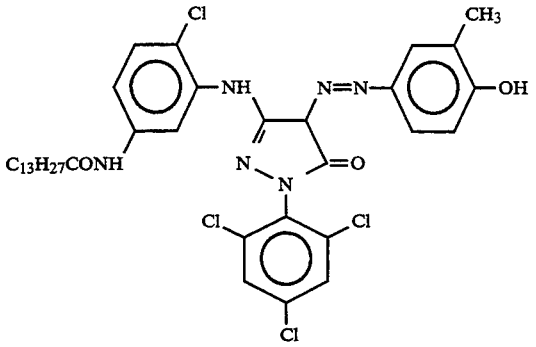
ExM-6
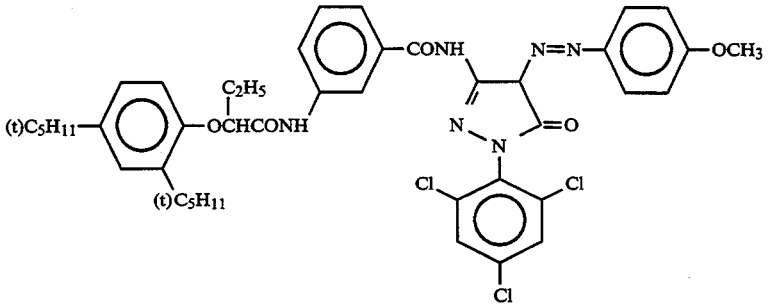
ExY-1
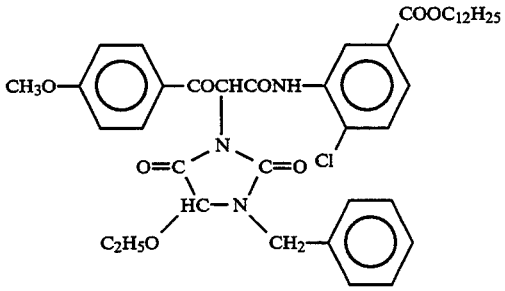
ExY-2
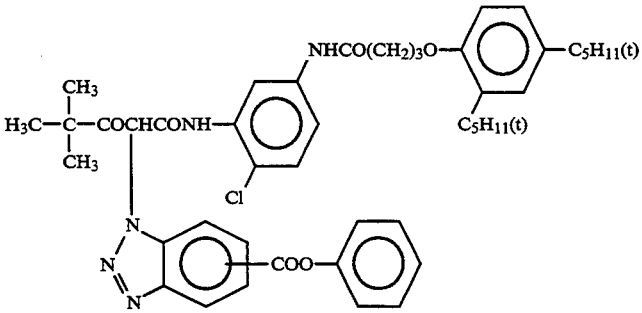
Cpd-1
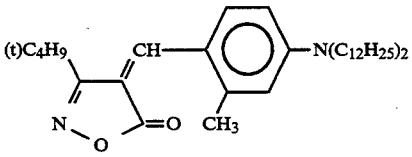
Cpd-2
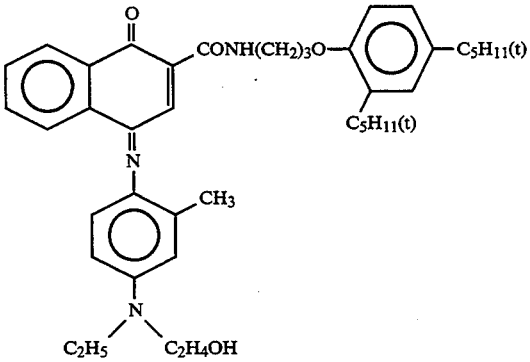

-continued
Cpd-3
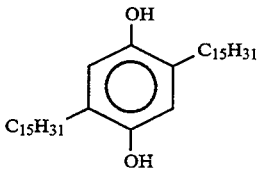
Cpd-4
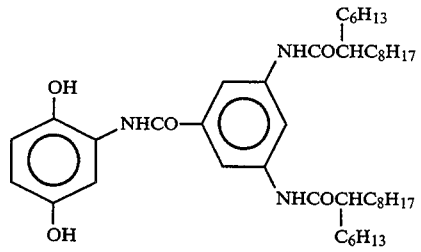
Cpd-5
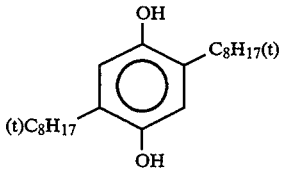
Cpd-6
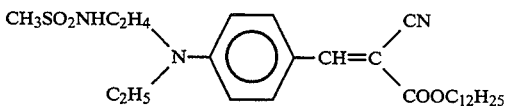
Cpd-7
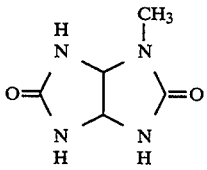
Solv-1
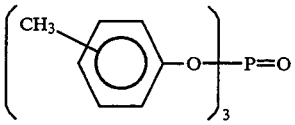
Solv-2
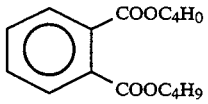
Solv-3
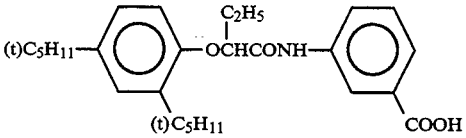
ExS-1
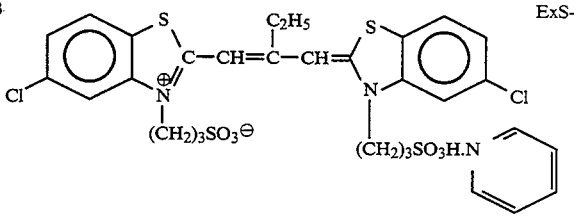
ExS-2
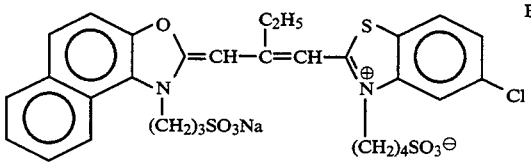
ExS-3
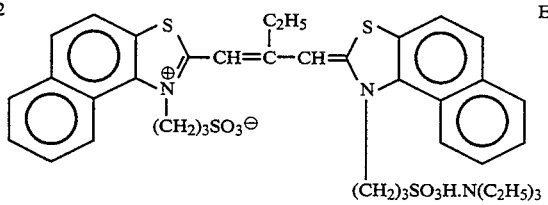
ExS-4
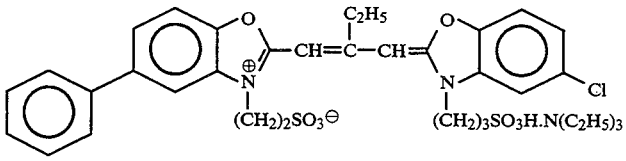
ExS-5
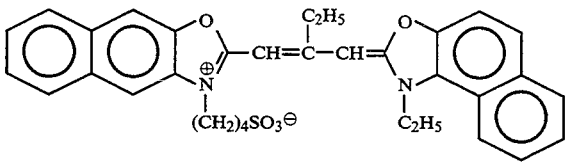

-continued
ExS-6
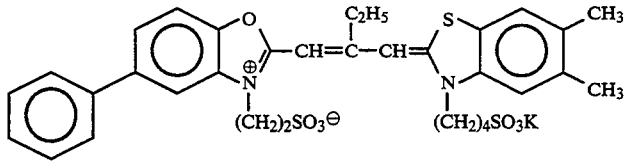
ExS-7
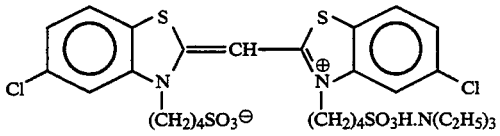
ExS-8
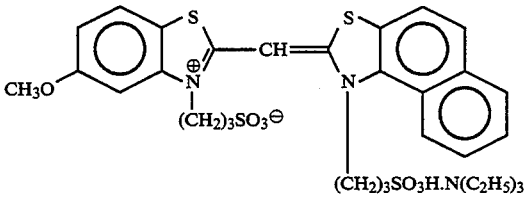
B-1
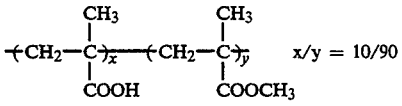
x/y = 10/90
B-2
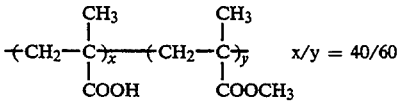
x/y = 40/60
B-3
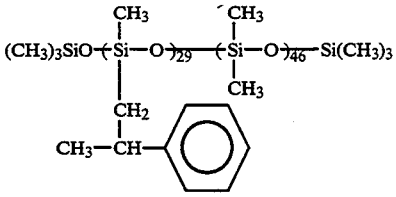
B-4
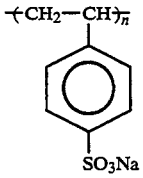
B-5
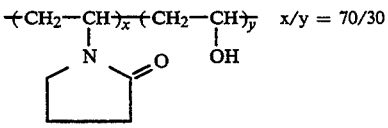
x/y = 70/30
W-1
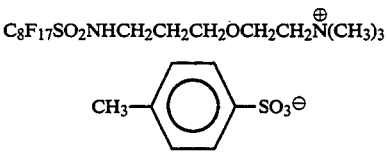
W-2
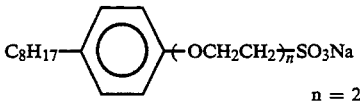
n = 2–4
W-3
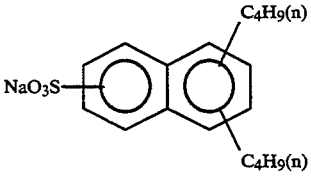
H-1
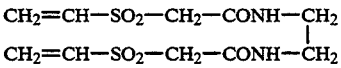
F-1
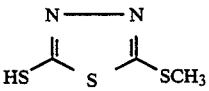
F-2
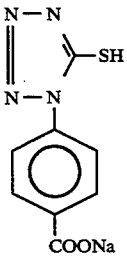
F-3
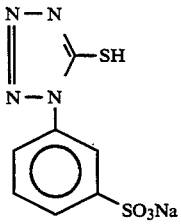
F-4
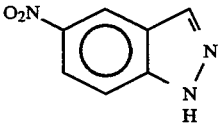
F-5
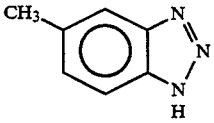

-continued

F-6

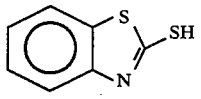

F-7

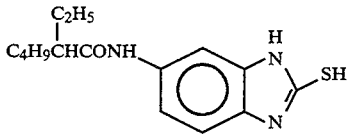

F-8

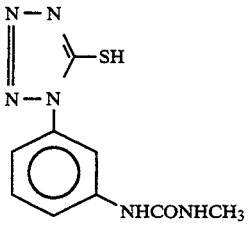

F-9

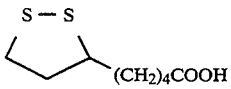

F-10

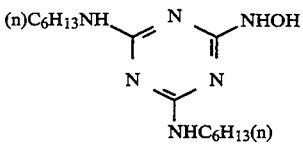

F-11

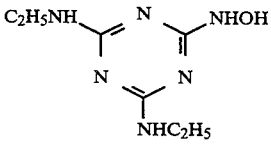

F-12

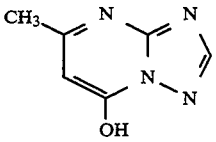

F-13

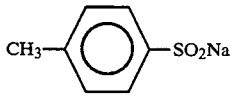

3. Preparation of Sample

The dry layer thickness of Sample 101, excluding the support, was 22 μm and the swelling speed, $T\frac{1}{2}$, was 9 seconds.

To prepare Sample 101, it was slit into a width of 35 mm and a length of 2 meters. This prepared sample was exposed to white light of 50 lux for 0.01 second and processed using an automatic processor under the following conditions. The stabilizing solution only was successively replaced and other processings were carried out under the sample conditions. The processed sample was then evaluated for stains and image storage stability.

4. Processing Steps

The processing steps and the compositions of the processing solutions are shown below.

| Processing Steps | | | | |
|---|---|---|---|---|
| Step | Processing Time | Processing Temp. (°C.) | Replenishment Amount (ml) | Tank Volume (liter) |
| Color Development | 3 min. and 5 sec. | 38.0 | 600 | 17 |
| Bleaching | 50 sec. | 38.0 | 140 | 5 |
| Blixing | 50 sec. | 38.0 | — | 5 |
| Fixing | 50 sec. | 38.0 | 420 | 5 |
| Washing | 30 sec. | 38.0 | 980 | 3 |
| Stab. (1) | 20 sec. | 38.0 | — | 3 |
| Stab. (2) | 20 sec. | 38.0 | 560 | 3 |
| Drying | 1 min. | 60 | — | — |

In the above table, "Stab" is stabilization and the replenishment amount is the amount per square meter of the sample color photographic material.

The stabilization was carried out by a countercurrent replenishment system of from (2) to (1) and the entire overflow solution from the washing step was all introduced into the fixing bath.

The blixing bath was replenished as follows. A cut was formed at the upper portion of the bleaching bath and at the upper portion of the fixing bath of the automatic processor. All overflow solutions (caused by addition of replenishers to the bleaching bath and fixing bath) were introduced into the blixing bath. In addition, the amount of color developer carried over into the bleaching step, the amount of bleaching solution carried over into the blixing step, the amount of blixing solution carried over into the fixing step, and the amount of fixing solution carried over into the washing step were 65 ml, 50 ml, 50 ml and 50 ml, respectively per square meter of the color photographic material. Also, the crossover time was 6 seconds each which was included in the processing time of the pre-step. Also, the composition of the each replenisher was same as the tank solution.

5. Processing Solutions

The composition of each processing solution is shown below.

| | |
|---|---|
| Color Developer | |
| Diethylenetriaminepentaacetic Acid | 2.0 g |
| 1-Hydroxyethylidene-1,1-diphosphonic Acid | 3.3 g |
| Sodium Sulfite | 3.9 g |
| Potassium Carbonate | 37.5 g |
| Potassium Bromide | 1.4 g |
| Potassium Iodide | 1.3 mg |
| Hydroxylamine Sulfate | 2.4 g |
| 2-Methyl-4-[N-ethyl-N-(β-hydroxyethyl]aminolaniline Sulfate | 4.5 g |
| Water to make | 1.0 liter |
| pH | 10.05 |
| Bleaching Solution | |
| 1,3-Diaminopropanetetraacetic Acid Ferric Ammonium Monohydrate | 130 g |
| Ammonium Bromide | 80 g |
| Ammonium Nitrate | 15 g |
| Hydroxyacetic Acid | 50 g |
| Acetic Acid | 40 g |

-continued

| | |
|---|---|
| Water to make | 1.0 liter |
| pH (adjusted by aqueous ammonia) | 4.2 |

Blixing Solution

A mixture of the above bleaching solution and the above fixing solution at a volume ratio of 15/85. (pH 7.0).

| Fixing Solution | |
|---|---|
| Ammonium Sulfite | 19 g |
| Aqueous Ammonium thiosulfate Solution (700 g/liter) | 280 ml |
| Imidazole | 15 g |
| Ethylenediaminetetraacetic Acid | 15 g |
| Water to make | 1.0 liter |
| pH (adjusted by aqueous ammonia or acetic acid) | 7.4 |

Water Water

Tap water was passed through a mixed bed column packed with an H type strong acidic cation exchange resin (Amberlite IR-120B, trade name, made by Rohm & Haas Co., Ltd.) and an OH type strong basic anion exchange resin (Amberlite IRA-400, trade name, made by Rohm & Haas Co., Ltd.). This reduced the concentrations of calcium ions and magnesium ions to 3 mg/liter or less. Then 20 mg/liter of sodium dichloroisocyanurate and 150 mg/liter of sodium sulfate was added to the water. The pH of the washing solution was in the range from 6.5 to 7.5.

| Stabilizing solution | |
|---|---|
| Sodium p-Toluenesulfinate | 0.1 g |
| Polyoxyethylene-p-monononyl Phenyl Ether (mean polymerization degree 10) | 0.2 |
| Ethylenediaminetetraacetic Acid Disodium Salt | 0.05 |
| Image Stabilizer (shown in Table A) | 0.01 mol |
| Water to make | 1.0 liter |
| pH | 7.2 |

6. Evaluation of Image Storage Stability

The magenta density of each processed sample was measured using a photographic densitometer FSD 103 (trade name, manufactured by Fuji Photo Film Co., Ltd.).

The magenta density of each processed sample was 1.5. The sample was allowed to stand for 2 months at 5° C. and 55% RH. The magenta density was then measured again. Thus, the image storage stability was determined by the reduced magenta density over the passage of time. (M fading)

7. Evaluation of Processing Stain

Each of the processed samples was visually observed and evaluated for staining. The ratings used to evaluate are as follows.

| | |
|---|---|
| Rank 1: | No stain was observed |
| 2: | Slight stain was observed (1/10 or less of the sample surface was stained to a slightly clouded extent). |
| 3: | Cloud was observed (more than 1/10 of the sample surface). |
| 4: | Sticking of substance was observed (less than 1/10 of the sample surface). |
| 5: | Sticking of substance was observed (more than 1/10 of the sample surface). |

8. Measurement of Formaldehyde Vapor Pressure

Vapor pressure of formaldehyde was then measure as follows:

100 ml of each stabilizing solution was placed in a separate vessel (open area 80 $cm^2$). The vessel was placed in a 5 liters closed glass container and allowed to stand for 7 days at 20° C. The vapor pressure of formaldehyde in the glass container was measured by a formaldehyde L-type direct reading gas detecting tube made by Gas Teck Co., Ltd.

9. Comparative Examples

The chemical structures of Comparative (1) to (10) shown in Table (A) are shown below.

Comparative Compound (1)

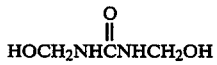

Compound described in U.S. Pat. No. 4,859,574

Comparative Compound (2)

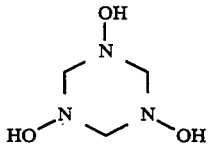

Compound described in European Patent Publication (unexamined) 395,442

Comparative Compound (3)

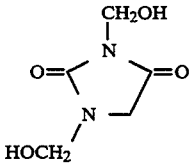

Compound described in JP-A-2-153348

Comparative Compound (4)

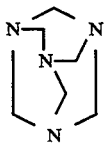

Compound described in JP-A-63-244036

Comparative Compound (5)

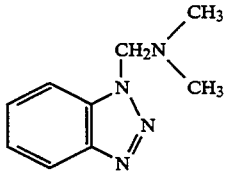

Compound described in JP-A-61-42660, JP-A-61-75354, JP-A-62-255948, JP-A-1-295258 and JP-A-2-54261

Comparative Compound (6)

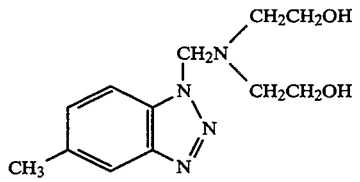

Compound described in JP-A-61-42660, JP-A-61-75354, JP-A-62-255948, JP-A-1-295258 and JP-A-2-54261

Comparative Compound (7)

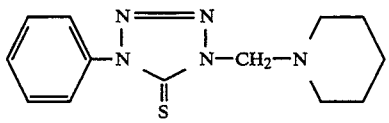

Compound described in JP-A-1-230043

Comparative Compound (8)

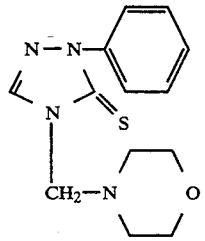

Compound described in JP-A-1-230043

Comparative Compound (9)

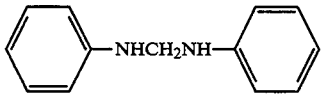

Compound described in JP-A-2-153350

Comparative Compound (10)

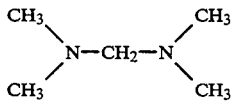

Compound described in JP-A-2-153350

Comparative Compound (11)

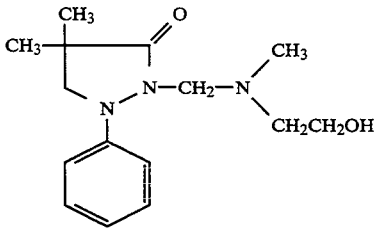

Compound described in U.S. Pat. No. 3,247,201

Comparative Compound (12)

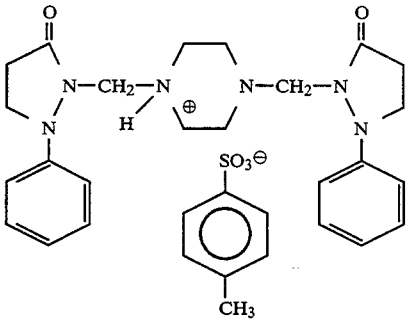

Compound described in U.S. Pat. No. 4,917,992

10. Results and Comparisons

The image stabilizers used and each evaluation result are shown in Table A.

TABLE A

| Sample No. | Image Stabilizer | M Fading | Stain Rank |
|---|---|---|---|
| 1 | none | 0.30 | 1 |
| 2 | Formalin | 0.00 | 1 |
| 3 | Comp. Compound (1) | 0.19 | 5 |
| 4 | Comp. Compound (2) | 0.24 | 3 |
| 5 | Comp. Compound (3) | 0.25 | 3 |
| 6 | Comp. Compound (4) | 0.27 | 3 |
| 7 | Comp. Compound (5) | 0.22 | 4 |
| 8 | Comp. Compound (6) | 0.21 | 4 |
| 9 | Comp. Compound (7) | 0.23 | 4 |
| 10 | Comp. Compound (8) | 0.24 | 4 |
| 11 | Comp. Compound (9) | 0.25 | 4 |
| 12 | Comp. Compound (10) | 0.23 | 4 |
| 13 | Comp. Compound (11) | 0.21 | 4 |
| 14 | Comp. Compound (12) | 0.22 | 5 |
| 15 | Compound I-1 | 0.05 | 2 |
| 16 | Compound I-5 | 0.06 | 1 |
| 17 | Compound I-15 | 0.05 | 2 |
| 18 | Compound I-20 | 0.03 | 1 |
| 19 | Compound I-24 | 0.03 | 1 |
| 20 | Compound I-25 | 0.03 | 1 |
| 21 | Compound II-3 | 0.06 | 1 |
| 22 | Compound II-7 | 0.07 | 1 |
| 23 | Compound II-8 | 0.06 | 1 |
| 24 | Compound II-17 | 0.00 | 1 |
| 25 | Compound II-18 | 0.00 | 1 |
| 26 | Compound II-19 | 0.02 | 1 |
| 27 | Compound II-20 | 0.02 | 1 |
| 28 | Compound II-22 | 0.03 | 1 |
| 29 | Compound II-27 | 0.02 | 1 |
| 30 | Compound II-30 | 0.00 | 1 |
| 31 | Compound II-34 | 0.00 | 1 |
| 32 | Compound II-35 | 0.02 | 1 |
| 33 | Compound II-39 | 0.02 | 1 |
| 34 | Compound II-40 | 0.03 | 1 |
| 35 | Compound III-10 | 0.07 | 1 |
| 36 | Compound III-16 | 0.05 | 2 |
| 37 | Compound III-17 | 0.06 | 1 |
| 38 | Compound III-20 | 0.06 | 1 |

Sample Nos. 1 to 14: Comparative Examples
Sample Nos. 15 to 38: Examples of the Invention.

The data in Table A clearly show that the compounds of this invention result in color images with excellent image storage stability with virtually no stains.

Measurement of formaldehyde vapor pressure showed formaldehyde of 5 ppm or more in Comparative Sample Nos. 1 to 5 and Sample Nos. 7 to 14. Comparative Sample No. 6 and the compounds of this invention, Sample Nos. 15 to 38, produced 2 ppm of formaldehyde or less. Although comparative Sample No. 6 produced lower amounts of formaldehyde, Table A clearly show that its image storage stability and resistance to staining were inferior.

The above results conclusively show these desired properties exhibited by the compounds of this invention: (1) image storage stability is excellent; (2) staining is lessened; and (3) formaldehyde vapor pressure is reduced to acceptable safe levels. Conventional formalin substitutes do not produce these same results.

EXAMPLE 2

The same procedures in Example 1 were followed except that equimolar amounts of magenta coupler M-1 or M-17 were substituted for magenta coupler ExM-1. Accordingly, Samples 201 and 202 were prepared, and almost the same results were obtained when the same teste were applied.

Sample 203 was prepared by following the same procedures of Example 1 except that an equimolar amount of magenta coupler M-1 replaced magenta coupler ExM-4. Sample 204 was prepared by following the same procedures of Example 1 except that an equimotar amount of magenta coupler ExM-4 and magenta coupler M-1 at a mol ratio of 1:1 replaced magenta coupler ExM-4. Almost the same results in Example 1 were obtained when the same tests were applied to Samples 203 and 204. Thus, the compound of this invention has laudable properties with various magenta couplers.

EXAMPLE 3

The same evaluations of Example 2 were followed except that the amount of each image stabilizers was decreased from 0.01 mol to 0.002 mol per liter of the stabilizing solution. Also, the pH of the stabilizing solution was changed to 7.8. Almost the same results as in Example 1 were obtained. This confirmed that the compounds for use in this invention had excellent effects even in small amounts.

EXAMPLE 4

Sample 101 was processed using the following processing steps and processing solution by an automatic processor according to the processing method in Example 1 until the accumulated amount of replenisher for each stabilizing solution was three times the tank volume. The image storage stability was tested in the same method as in Example 1, and almost the same results were obtained. That is, it was confirmed that the compounds for use in this invention had excellent effects.

1. Processing Steps

The processing steps employed were as follows:

| | Processing Steps | | | |
|---|---|---|---|---|
| Step | Processing Time | Processing Temp. (°C.) | Replenishment Amount* (ml) | Tank Volume (liter) |
| Color Development | 3 min. and 15 sec. | 38 | 33 | 20 |
| Bleaching | 6 min. and 30 sec. | 38 | 25 | 40 |
| Washing | 2 min. and 10 sec. | 24 | 1200 | 20 |
| Fixing | 4 min. and 20 sec. | 38 | 25 | 30 |
| Washing (1) | 65 sec. | 24 | — | 10 |
| Washing (2) | 60 sec. | 24 | 1200 | 10 |
| Stabilization | 65 sec. | 38 | 25 | 10 |
| Drying | 4 min. and 20 sec. | 55 | — | — |

-continued (*): Replenishing amount was per 35 mm in width and 1 meter in length.

Washing step was by a countercurrent system from (2) to (1).

2. Processing Solutions

The composition of each processing solution is shown below.

| | Tank Solution | Replenisher |
|---|---|---|
| Color Developer | | |
| Diethylenetriaminepentaacetic Acid | 1.0 g | 1.1 g |
| 1-Hydroxyethylidene-1,1-diphosphonic Acid | 3.0 g | 3.2 g |
| Sodium Sulfite | 4.0 g | 4.4 g |
| Potassium Carbonate | 30.0 g | 37.0 g |
| Potassium Bromide | 1.4 g | 0.7 g |
| Potassium Iodide | 1.5 mg | — |
| Hydroxylamine Sulfate | 2.4 g | 2.8 g |
| 4-[N-ethyl-N-(β-hydroxyethyl)amino]-2-methylaniline Sulfate | 4.5 g | 5.5 g |
| Water to make | 1 liter | 1 liter |
| pH | 10.05 | 10.10 |
| Bleaching Solution | | |
| Ethylenediaminetetraacetic Acid Ferric Sodium Trihydrate | 100.0 g | 120.0 g |
| Ethylenediaminetetraacetic Acid Disodium Salt | 10.0 g | 10.0 g |
| Ammonium Bromide | 140.0 g | 160.0 g |
| Ammonium Nitrate | 30.0 g | 35.0 g |
| Aqueous Ammonia (27 wt %) | 6.5 ml | 4.0 ml |
| Water to make | 1 liter | 1 liter |
| pH | 6.0 | 5.7 |
| Fixing Solution | | |
| Ethylenediaminetetraacetic Acid Disodium Salt | 0.5 g | 0.7 g |
| Sodium Sulfite | 7.0 g | 8.0 g |
| Sodium Hydrogensulfite | 5.0 g | 5.5 g |
| Aqueous Ammonium Thiosulfate Solution (700 g/liter) | 170 ml | 200.0 ml |
| Water to make | 1 liter | 1 liter |
| pH | 6.7 | 6.6 |
| Stabilizing solution | | |
| Image Stabilizer (shown in Table A above) | 0.01 mol | 0.011 mol |
| Polyoxyethylene-p-monononyl Phenyl Ether (mean polymerization degree: 10) | 0.3 g | 0.33 g |
| Ethylenediaminetetraacetic Acid Disodium Salt | 0.05 | 0.055 |
| Water to make | 1 liter | 1 liter |
| pH | 8.2 | 8.0 |

EXAMPLE 5

Sample 101 in Example 1 was processed according to Example 4 using no image stabilizer—Sample No. 1—and using bleaching solutions each containing 0.03 mol/liter of each of the image stabilizers shown in Table A. Stain and image storage stability evaluations of the sample after processing produced, and almost the same results as in Example 1 were obtained. That is, it was confirmed that the compounds for use in this invention had excellent effects.

EXAMPLE 6

1. Layers

A multilayer color photographic material (for Sample 501) was used as a support. Sample 501 had the following layer compositions arranged on a cellulose triacetate film support of 127 μm in thickness having a subbing layer. The numbers below show the coated amount per square meter. In addition, the function of each compound is not limited to the use thereof as given below.

| | |
|---|---|
| Layer 1 (Antihalation Layer) | |
| Black Colloid Silver | 0.25 |
| Gelatin | 1.9 g |
| U.V. Absorber U-1 | 0.04 g |
| U.V. Absorber U-2 | 0.1 g |
| U.V. Absorber U-3 | 0.1 g |
| U.V. Absorber U-4 | 0.1 g |
| U.V. Absorber U-6 | 0.1 g |
| High-Boiling Organic Solvent Oil-1 | 0.1 g |
| Layer 2 (Interlayer) | |
| Gelatin | 0.40 g |
| Compound Cpd-D | 10 mg |
| High-Boiling Organic Solvent Oil-3 | 0.1 g |
| Dye-D-4 | 0.4 mg |
| Layer 3 (Interlayer) | |
| Surface- and Inside-Fogged Fine Grain Silver Iodobromide Emulsion (mean grain size: 0.06 μm, variation coeff.: 18%, AgI: 1 mol %) | 0.05 g as Ag |
| Gelatin | 0.4 g |
| Layer 4 (Low-Speed Red-Sensitive Emulsion Layer) | |
| Emulsion A | 0.2 g as Ag |
| Emulsion B | 0.3 g as Ag |
| Gelatin | 0.8 g |
| Coupler C-1 | 0.15 g |
| Coupler C-2 | 0.05 g |
| Coupler C-9 | 0.05 g |
| Compound Cpd-D | 10 mg |
| High-Boiling Organic Solvent Oil-2 | 0.1 g |
| Layer 5 (Medium-Speed Red-Sensitive Emulsion Layer) | |
| Emulsion B | 0.2 g as Ag |
| Emulsion C | 0.3 g as Ag |
| Gelatin | 0.8 g |
| Coupler C-1 | 0.2 g |
| Coupler C-2 | 0.05 g |
| Coupler C-3 | 0.2 g |
| High-Boiling Organic Solvent Oil-2 | 0.1 g |
| Layer 6 (High-Speed Red-Sensitive Emulsion Layer) | |
| Emulsion D | 0.4 g as Ag |
| Gelatin | 1.1 g |
| Coupler C-1 | 0.3 g |
| Coupler C-3 | 0.7 g |
| Additive P-1 | 0.1 g |
| Layer 7 (interlayer) | |
| Gelatin | 0.6 g |
| Additive M-1 | 0.3 g |
| Color Mixing Inhibitor Cpd-K | 2.6 mg |
| U.V. Absorber U-1 | 0.1 g |
| U.V. Absorber U-6 | 0.1 g |
| Dye D-1 | 0.02 g |
| Layer 8 (Interlayer) | |
| Surface- and Inside-Fogged Silver Iodobromide Emulsion (mean grain size: 0.06 μm, variation coeff.: 16%, AgI: 0.3 mol %) | 0.02 g as Ag |
| Gelatin | 1.0 g |
| Additive P-1 | 0.2 g |
| Color Mixing Inhibitor Cpd-J | 0.1 g |
| Color Mixing Inhibitor Cpd-A | 0.1 g |
| Layer 9 (Low-Speed Green-Sensitive Emulsion Layer) | |
| Emulsion E | 0.3 g as Ag |
| Emulsion F | 0.1 g as Ag |

-continued

| | |
|---|---|
| Emulsion G | 0.1 g as Ag |
| Gelatin | 0.5 g |
| Coupler C-7 | 0.05 g |
| Coupler C-8 | 0.20 g |
| Compound Cpd-B | 0.03 g |
| Compound Cpd-D | 10 mg |
| Compound Cpd-E | 0.02 g |
| Compound Cpd-F | 0.02 g |
| Compound Cpd-G | 0.02 g |
| Compound Cpd-H | 0.02 g |
| High-boiling Organic Solvent Oil-1 | 0.1 g |
| High-boiling Organic Solvent Oil-2 | 0.1 g |
| Layer 10 (Medium-Speed Green-Sensitive Emulsion Layer) | |
| Emulsion G | 0.3 g as Ag |
| Emulsion H | 0.1 g as Ag |
| Gelatin | 0.6 g |
| Coupler C-7 | 0.2 g |
| Coupler C-8 | 0.1 g |
| Compound Cpd-B | 0.03 g |
| Compound Cpd-E | 0.02 g |
| Compound Cpd-F | 0.02 g |
| Compound Cpd-G | 0.05 g |
| Compound Cpd-H | 0.05 g |
| High-boiling organic Solvent Oil-2 | 0.01 g |
| Layer 11 (High-Speed Green-Sensitive Emulsion Layer) | |
| Emulsion I | 0.5 g as Ag |
| Gelatin | 1.0 g |
| Coupler C-4 | 0.3 g |
| Coupler C-8 | 0.1 g |
| Compound Cpd-B | 0.08 g |
| Compound Cpd-E | 0.02 g |
| Compound Cpd-F | 0.02 g |
| Compound Cpd-G | 0.02 g |
| Compound Cpd-H | 0.02 g |
| High-boiling Organic Solvent Oil-1 | 0.02 g |
| High-boiling Organic Solvent Oil-2 | 0.02 g |
| Layer 12 (Interlayer) | |
| Gelatin | 0.6 g |
| Dye D-1 | 0.1 g |
| Dye D-2 | 0.05 g |
| Dye D-3 | 0.07 g |
| Layer 13 (Yellow Filter Layer) | |
| Yellow Colloidal Silver | 0.1 g as Ag |
| Gelatin | 1.1 g |
| Color Mixing Inhibitor Cpd-A | 0.01 g |
| High-boiling Organic Solvent Oil-1 | 0.01 g |
| Layer 14 (Interlayer) | |
| Gelatin | 0.6 g |
| Layer 15 (Low-Speed Blue-Sensitive Emulsion Layer) | |
| Emulsion J | 0.4 g as Ag |
| Emulsion K | 0.1 g as Ag |
| Emulsion L | 0.1 g as Ag |
| Gelatin | 0.8 g |
| Coupler C-5 | 0.6 g |
| Layer 16 (Medium-Speed Blue-Sensitive Emulsion Layer) | |
| Emulsion L | 0.1 g as Ag |
| Emulsion M | 0.4 g as Ag |
| Gelatin | 0.9 g |
| Coupler C-5 | 0.3 g |
| Coupler C-6 | 0.3 g |
| Layer 17 (High-Speed Blue-Sensitive Emulsion Layer) | |
| Emulsion N | 0.4 g as Ag |
| Gelatin | 1.2 g |
| Coupler C-6 | 0.7 g |
| Layer 18 (1st Protective Layer) | |
| Gelatin | 0.7 g |
| U.V. Absorber U-1 | 0.04 g |
| U.V. Absorber U-2 | 0.01 g |
| U.V. Absorber U-3 | 0.03 g |
| U.V. Absorber U-4 | 0.03 g |
| U.V. Absorber U-5 | 0.05 g |
| U.V. Absorber U-6 | 0.05 g |
| High-boiling Organic Solvent Oil-1 | 0.02 g |
| Formalin Scavengers: | |
| Cpd-C | 0.2 g |

-continued

| | |
|---|---|
| Cpd-I | 0.4 g |
| Dye D-3 | 0.05 g |
| Layer 19 (2nd Protective Layer) | |
| Colloidal Silver | 0.1 mg as Ag |
| Fine Grain Silver Iodobromide Emulsion (mean grain size: 0.06 μm, AgI: 1 mol %) | 0.1 mg as Ag |
| Gelatin | 0.4 g |
| Layer 20 (3rd Protective Layer) | |
| Gelatin | 0.4 g |
| Polymethyl Methacrylate (mean grain size: 1.5 μm) | 0.1 g |
| Copolymer of Methyl-Methacrylate and Acrylic Acid (4:6) (mean grain size: 1.5 μm) | 0.1 g |
| Silicone Oil | 0.03 g |
| Surface Active Agent W-1 | 3.0 mg |
| Surface Active Agent W-2 | 0.03 mg |

Each silver halide emulsion layer also contained additives F-1 to F-8, gelatin hardener H-1, surface active agents W-3 and W-4 for coating and emulsification, and antiseptics and antimolds, such as phenol, 1,2-benziso-thiazolin-3-one, 2-pheoxy ethanol, p-hydroxybenzoic acid butyl eater and phenethyl alcohol.

2. Silver Iodobromide Emulsions

The properties of the silver iodobromide emulsions used in this example are shown below:

| | Emulsion | Mean Grain Size (m) | Variation Coeff. (%) | AgI Content (%) |
|---|---|---|---|---|
| A | Monodisperse Tetradecahedral grains | 0.25 | 16 | 3.7 |
| B | Monodisperse Cubic Internal Latent Image Type Grains | 0.30 | 10 | 3.3 |
| C | Monodisperse Tetradecahedral Grains | 0.30 | 18 | 5.0 |
| D | Polydisperse Twin Grains | 0.60 | 25 | 2.0 |
| E | Monodisperse Cubic Grains | 0.17 | 17 | 4.0 |
| F | Monodisperse Cubic Grains | 0.20 | 16 | 4.0 |
| G | Monodisperse Cubic Internal Latent Image Type Grains | 0.25 | 11 | 3.5 |
| H | Monodisperse Cubic Internal Latent Image Grains | 0.30 | 9 | 3.5 |
| I | Polydisperse Tabular Grains (Mean Aspect Ratio: 4.0) | 0.80 | 28 | 1.5 |
| J | Monodisperse Tetradecahedral Grains | 0.30 | 18 | 4.0 |
| K | Monodisperse Tetradecahedral Grains | 0.37 | 17 | 4.0 |
| L | Monodisperse Cubic Internal Latent Image Type Grains | 0.46 | 14 | 3.5 |
| M | Monodisperse Cubic Grains | 0.55 | 13 | 4.0 |
| N | Polydisperse Tabular Grains (Mean Aspect Ratio: 7.0) | 1.00 | 33 | 1.3 |

Spectral Sensitization of Emulsion A to N

| Emulsion | Sensitizing Dye Added | Added Amount per mol of AgX (g) | Timing For Adding Sensitizing Dye |
|---|---|---|---|
| A | S-1 | 0.025 | (a) |
| | S-2 | 0.25 | (a) |
| B | S-1 | 0.01 | (b) |
| | S-2 | 0.25 | (b) |
| C | S-1 | 0.02 | (a) |
| | S-2 | 0.25 | (a) |
| C | S-1 | 0.01 | (a) |
| | S-2 | 0.10 | (a) |
| | S-7 | 0.01 | (a) |
| E | S-3 | 0.5 | (a) |
| | S-4 | 0.1 | (a) |
| F | S-3 | 0.3 | (a) |
| | S-4 | 0.1 | (a) |
| G | S-3 | 0.25 | (b) |
| | S-4 | 0.08 | (b) |
| H | S-3 | 0.2 | (c) |
| | S-4 | 0.06 | (c) |
| I | S-3 | 0.3 | (d) |
| | S-4 | 0.07 | (d) |
| | S-8 | 0.1 | (d) |
| J | S-6 | 0.2 | (c) |
| | S-5 | 0.05 | (c) |
| K | S-6 | 0.2 | (c) |
| | S-5 | 0.05 | (c) |
| L | S-6 | 0.22 | (b) |
| | S-5 | 0.06 | (b) |
| M | S-6 | 0.15 | (a) |
| | S-5 | 0.04 | (a) |
| N | S-6 | 0.22 | (b) |
| | S-5 | 0.06 | (b) |

(a): Immediately after chemical sensitization.
(b): Immediately after finishing grain formation.
(c): During formation of grains.
(d): Immediately before the initiation of chemical sensitization 3. Chemical Structures The chemical structures of compounds used in the color photographic material of this example are shown below:

C-1

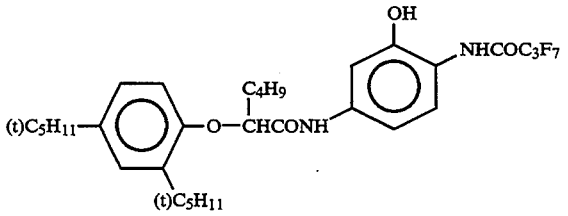

C-2

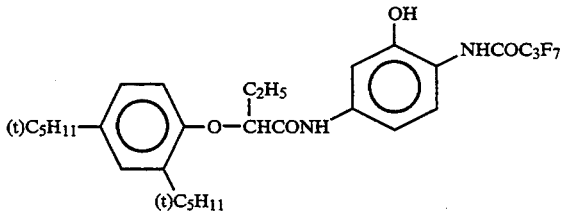

-continued
C-3
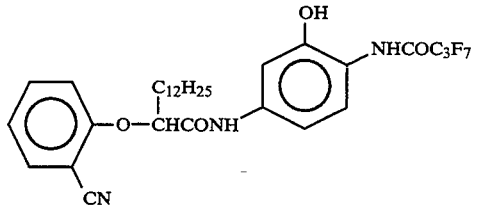
C-4
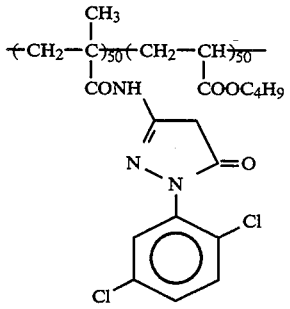
The number is weight %
mean molecular Weight: about 25,000
C-5
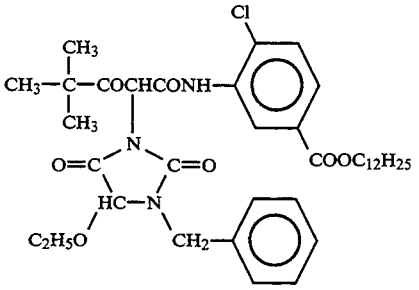
C-6
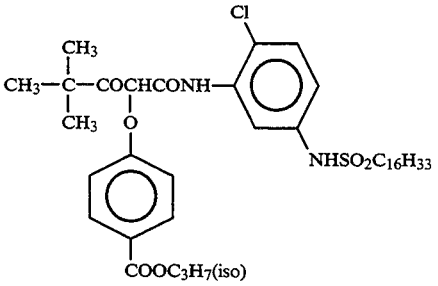
C-7
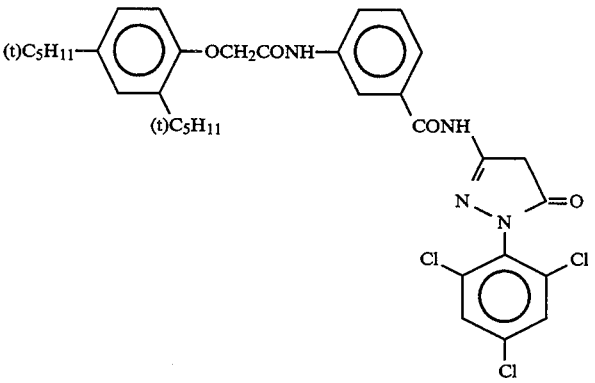

-continued
C-8
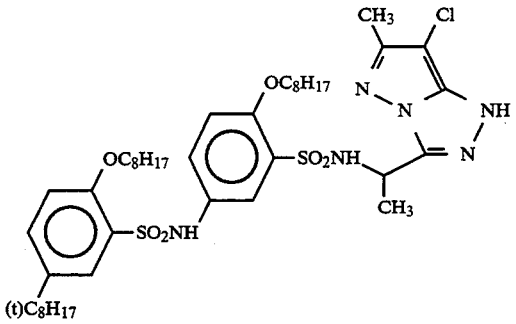
C-9
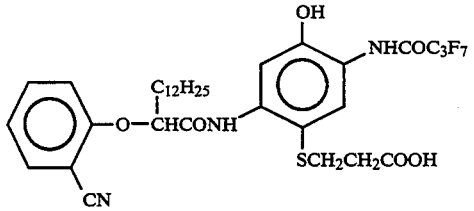
Dibutyl Phthalate Oil-1
Tricresyl Phosphate Oil-2
Oil-3
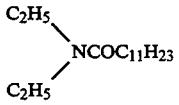
Cpd-A
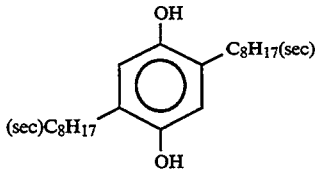
Mixture (4:1 by weight) of
Cpd-B
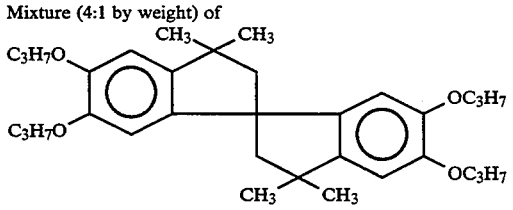
and
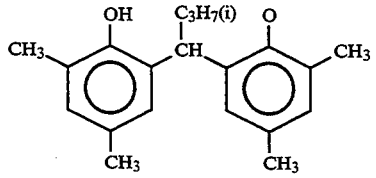
Cpd-C
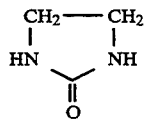
Cpd-D
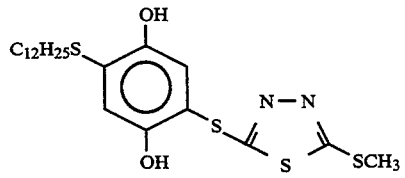

-continued
Cpd-E
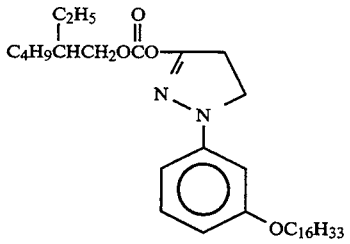
Mixture (1:1 by weight) of
Cpd-F
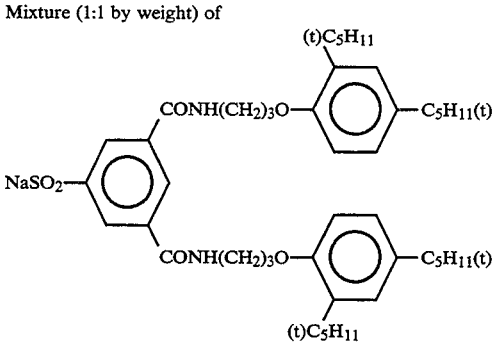
and
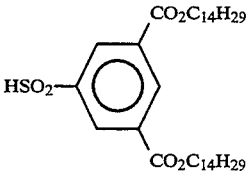
Cpd-G
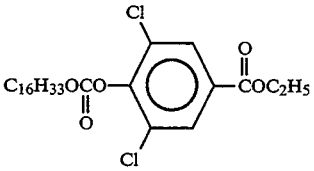
Mixture (1:1 by weight) of
Cpd-H
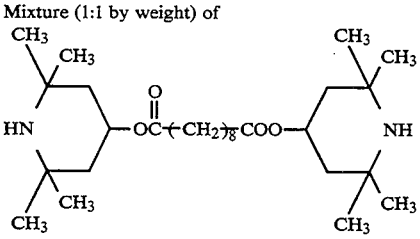
and
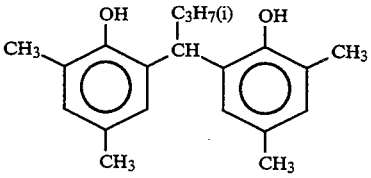
Cpd-I
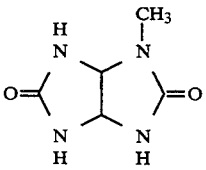

-continued
Cpd-J
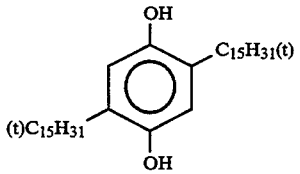
Cpd-K
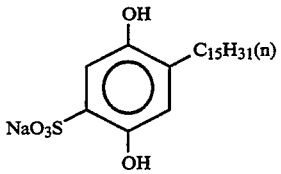
U-1
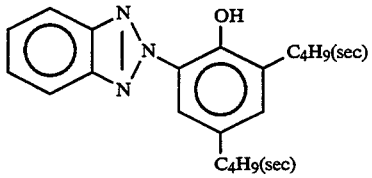
U-2
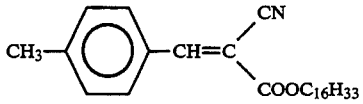
U-3
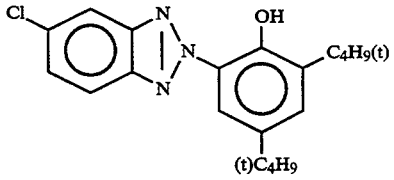
U-4
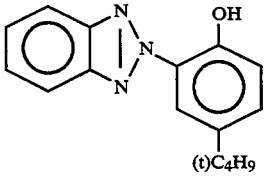
U-5
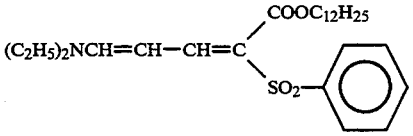
U-6
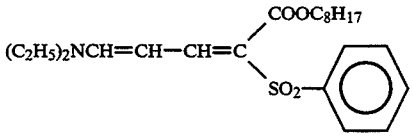
S-1
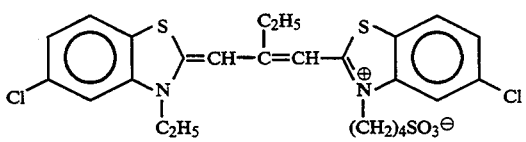

-continued
S-2
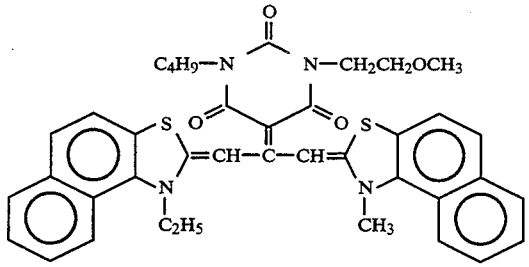
S-3
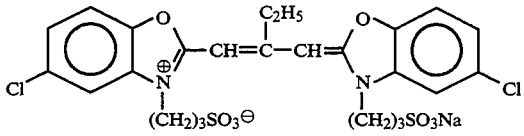
S-4
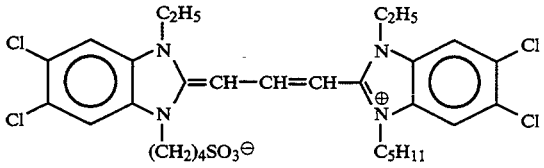
S-5
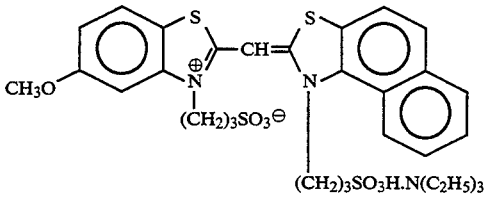
S-6
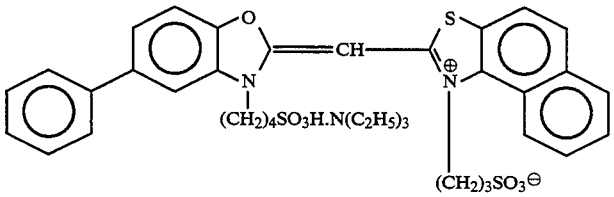
S-7
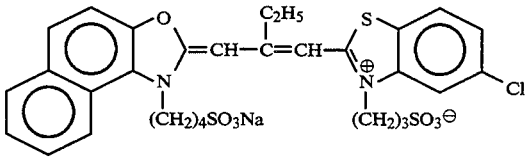
S-8
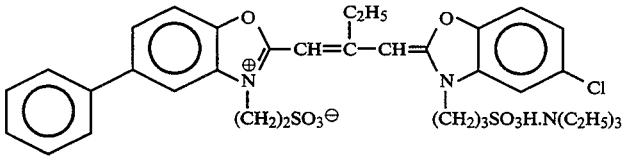
D-1
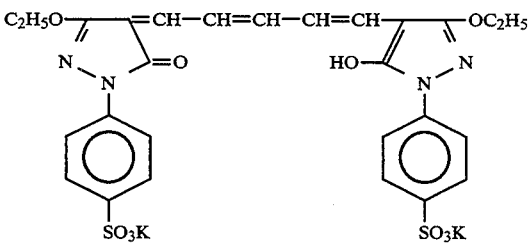

-continued
D-2
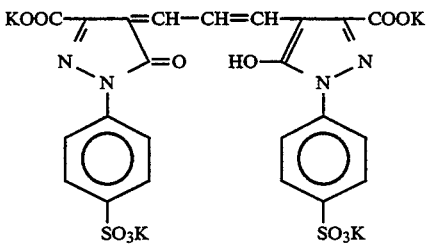
D-3
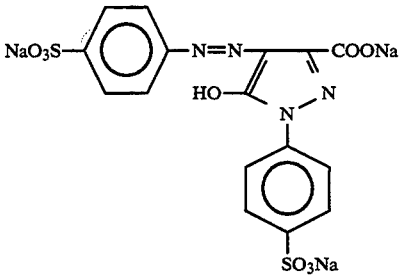
D-4
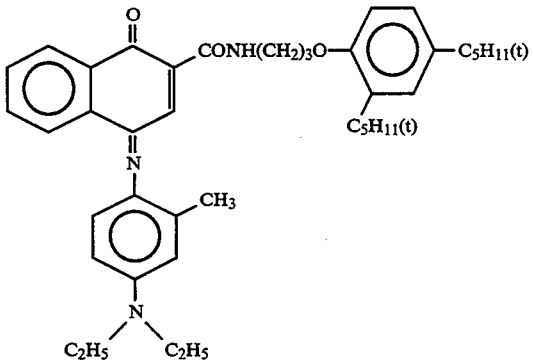
H-1
$CH_2{=}CH{-}SO_2{-}CH_2{-}CONH{-}CH_2$
$CH_2{=}CH{-}SO_2{-}CH_2{-}CONH{-}CH_2$
W-1
$C_8F_{17}SO_2NHCH_2CH_2CH_2OCH_2CH_2\overset{\oplus}{N}(CH_3)_3$
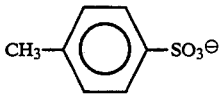
W-2
$C_8F_{17}SO_2N(C_3H_7)CH_2COOK$
W-3
$NaO_3S{-}CH(CH_2COOCH_2CH(C_2H_5)C_4H_9)COOCH_2CH(C_2H_5)C_4H_9$
W-4
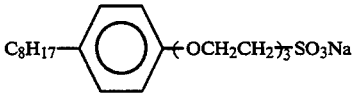
P-1
$\left(CH_2{-}CH(CONHC_4H_9(t))\right)_n$
M-1
$\left(CH_2{-}CH(COOC_4H_9)\right)_n$ -continued

F-1

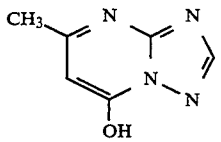

F-2

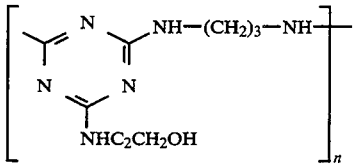

F-3

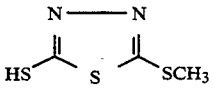

F-4

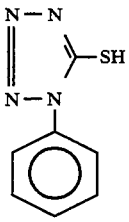

F-5

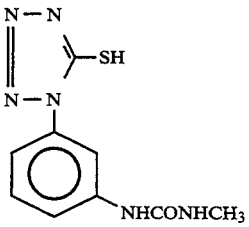

F-6

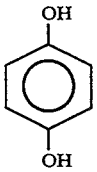

F-7

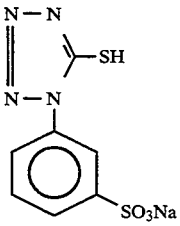

F-8

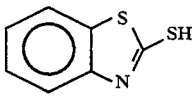

4. Processing Steps

Sample 501 was subjected to an imagewise exposure and then processed using a cine type automatic processor. First, 0.5 square meter of the sample was processed with Bleaching Solution 1 and then with each stabilizing solution. Next, the sample was similarly processed using Bleaching Solution 2. Details of the processing steps are provided below:

| | Processing Steps | | | |
|---|---|---|---|---|
| Step | Processing Time (minute) | Processing Temp. (°C.) | Replenishment Amount* (liter) | Tank Volume (liter) |
| Black & White Development | 6 | 38 | 1.5 | 12 |

-continued

| Step | Processing Steps: Processing Time (minute) | Processing Temp. (°C.) | Replenishment Amount* (liter) | Tank Volume (liter) |
|---|---|---|---|---|
| 1st Washing | 1 | 38 | 7.5 | 4 |
| Reversal | 1 | 38 | 1.1 | 4 |
| Color Development | 4 | 38 | 2.0 | 12 |
| Conditioning | 2 | 38 | 1.1 | 4 |
| Bleaching | 4 | 38 | 1.3 | 12 |
| Fixing | 3 | 38 | 1.3 | 12 |
| 2nd Washing (1) | 1 | 38 | — | 4 |
| 2nd Washing (2) | 1 | 38 | 7.5 | 4 |
| Stabilization | 1 | 38 | 1.1 | 4 |
| Drying | 2 | 50 | — | — |

(*): The replenishing amount was per square meter of the color photographic material.

In the above processing steps, the overflow solution from 2nd washing (2) was introduced into the bath of 2nd washing (1).

5. Processing Solutions

The composition of each processing solution was as follows.

| Black & White Developer | Starting Solution | Replenisher |
|---|---|---|
| Nitrilo-N,N,N-trimethylene-phosphonic Acid.Pentasodium Salt | 2.0 g | 2.0 g |
| Diethylenetriaminepentaacetic Acid.Pentasodium Salt | 3.0 g | 3.0 g |
| Potassium Sulfite | 30 g | 30 g |
| Hydroquinone Potassium monosulfonate | 20 g | 20 g |
| Potassium Carbonate | 33 g | 33 g |
| 1-Phenyl-4-methyl-4-hydroxymethyl-3-pyrazolidone | 2.0 g | 2.0 g |
| Potassium Bromide | 2.5 g | 0.9 g |
| Potassium Thiocyanate | 1.2 g | 1.2 g |
| Potassium Iodide | 2.0 mg | 2.0 mg |
| Water to make | 1 liter | 1 liter |
| pH (25° C.) | 9.60 | 9.70 |

The pH was adjusted with hydrochloric acid or potassium hydroxide.

| Reversal Solution Starting solution = Replenisher | |
|---|---|
| Nitrilo-N,N,N-trimethylenephosphonic Acid.Pentasodium Salt | 2.0 g |
| Stannous Chloride.Dihydrate | 1.0 g |
| p-Aminophenol | 0.1 g |
| Sodium Hydroxide | 8.0 g |
| Glacial Acetic Acid | 15 ml |
| Ammonium Sulfite | 20 g |
| Water to make | 1 liter |
| pH (25° C.) | 6.60 |

The pH was adjusted with acetic acid or an aqueous ammonia.

| Color Developer | Starting Solution | Replenisher |
|---|---|---|
| Nitrilo-N,N,N-trimethylene-phosphonic Acid Pentasodium Salt | 2.0 g | 2.0 g |
| Diethylenetriaminepentaacetic Acid.Pentesodium Salt | 2.0 g | 2.0 g |
| Sodium Sulfite | 7.0 g | 7.0 g |
| Potassium Tertiary Phosphate-Dodecahydrate | 36 g | 36 g |
| Potassium Bromide | 1.0 g | — |
| Potassium Iodide | 90 mg | — |
| Sodium Hydroxide | 3.0 g | 3.0 g |
| Citrazinic Acid | 1.5 g | 1.5 g |
| N-Ethyl-(β-methanesulfonamido-ethyl)-3-methyl-4-aminoaniline Sulfate | 10.5 g | 10.5 g |
| 3,6-Dithiaoctane-1,8-diol | 3.5 g | 3.5 g |
| Water to make | 1 liter | 1 liter |
| pH (25° C.) | 11.90 | 12.05 |

The pH was adjusted with hydrochloric acid or potassium hydroxide.

| Conditioning Solution Starting solution = Replenisher | |
|---|---|
| Ethylenediaminetetraacetic Acid Disodium Salt.Dihydrate | 8.0 g |
| Sodium Sulfite | 12 g |
| 2-Mercapto-1,3,4-triazole | 0.5 g |
| pH (25° C.) | 6.00 |

The pH was adjusted with hydrochloric acid or sodium hydroxide.

| Bleaching Solution 1 Starting solution = Replenisher | |
|---|---|
| Ethylenediaminetetraacetic Acid | 3 g |
| Ethylenediaminetetraacetic Acid Ferric Ammonium.Dihydrate | 150 g |
| 2-Mercapto-1,3,4-triazole | 0.5 g |
| Ammonium Bromide | 120 g |
| Ammonium Nitrate | 25 g |
| Water to make | 1 liter |
| pH (25° C.) | 4.20 |

The pH was adjusted with acetic acid or aqueous ammonia.

| Bleaching Solution 2 Starting solution = Replenisher | |
|---|---|
| 1,3-Diaminopropanetetraacetic Acid | 3 g |
| 1,3-Diaminopropanetetraacetic Acid Ferric Ammonium.Dihydrate | 120 g |
| Glycolic Acid | 40 g |
| Acetic Acid | 30 g |
| Ammonium Bromide | 120 g |
| Ammonium Nitrate | 25 g |
| Water to make | 1 liter |
| pH (25° C.) | 4.20 |

The pH was adjusted with acetic acid or an aqueous ammonia.

| Fixing Solution Starting solution = Replenisher | |
|---|---|
| Ethylenediaminetetraacetic Acid Disodium.Dihydrate | 1.7 g |
| Sodium Benzaldehyde-o-sulfonate | 20 g |
| Sodium Hydrogensulfite | 15 g |
| Aqueous Ammonium Thiosulfate Solution (700 g/liter) | 250 ml |
| Water to make | 1 liter |
| pH (25° C.) | 6.00 |

The pH was adjusted with acetic acid or an aqueous ammonia.

Stabilizing solution

Each stabilizing solution shown in Example 1 was used (the starting solution=the replenisher).

The gray colored portion of each sample having a magenta density of 0.5 was used to evaluate the image storage stability. The results were almost same as in Example 1, that is, improved results were obtained by using the stabilizer containing the compound of this invention.

Also, image storage stability was similarly evaluated for stabilizing solutions containing the image stabilizer of this invention and also for conditioning solutions containing 0.03 mol/liter of each of the image stabilizers shown in Table B below. The results obtained are shown in Table B.

TABLE B

| No. | Image Stabilizer | Image Storage Stability* Bleach Solution 1 | Bleach Solution 2 |
|---|---|---|---|
| 1 | None | 0.20 | 0.20 |
| 2 | Formalin | 0 | 0 |
| 3 | Compound I-1 | 0.05 | 0.05 |
| 4 | Compound I-5 | 0.05 | 0.06 |
| 5 | Compound II-3 | 0.06 | 0.06 |
| 6 | Compound II-4 | 0.05 | 0.05 |
| 7 | Compound II-17 | 0.01 | 0.00 |
| 8 | Compound II-18 | 0.01 | 0.00 |
| 9 | Compound II-19 | 0.02 | 0.01 |
| 10 | Compound II-20 | 0.01 | 0.02 |
| 11 | Compound II-30 | 0.01 | 0.00 |
| 12 | Compound II-39 | 0.01 | 0.02 |
| 13 | Compound II-40 | 0.01 | 0.02 |
| 14 | Compound III-10 | 0.06 | 0.05 |

(*) M Fading.
Sample Nos. 1 and 2: Comparative Examples.
Sample Nos. 3 to 14: Examples of the invention.

As is shown in Table B, when the compounds of this invention are used for the conditioning baths, they show a substantive fading prevention effect on magenta dyes.

In particular, better results are obtained with use of 1,3-diamiopropanetetraacetic acid ferric complex salt as a bleaching agent.

Additionally, no stains were observed on surfaces of each sample shown in Table B.

That is, it was confirmed that the compounds for use in this invention had excellent effects.

EXAMPLE 7

Sample 201 of Example 2, described in JP-A-2-90151, and Light-sensitive Materials 1 and 9 of in Example 1 and 3, respectively, described in JP-A-2-93641, were processed using Nos. 15 to 38 in Example 1 of the present invention. The vapor pressure of formaldehyde was decreased, the dye images formed were excellent in fastness property, and no stains were formed. That is, it was confirmed that the compounds for use in this invention had excellent effects.

While the invention has been described in detail and with reference to specific embodiments thereof, it will be apparent to one skilled in the art that various changes and modifications can be made therein without departing from the spirit and scope thereof.

What is claimed is:

1. A processing solution for a silver halide color photographic material which has been subjected to color development of a dye image, said solution containing at least one compound represented by formula (II);

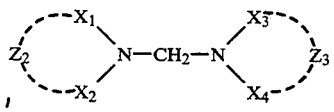

(II)

in formula (II), $X_1$, $X_2$, $X_3$ and $X_4$, which may be the same or different, each represents

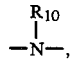

=N—, —O—, —S—,

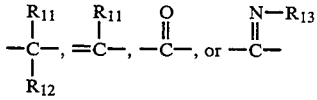

(wherein $R_{10}$, $R_{11}$, $R_{12}$, or $R_{13}$, which may be the same or different, each represents a hydrogen atom or a substituent) and $Z_2$ and $Z_3$, which may be the same or different, each represents a non-metallic atomic group necessary for forming a 4- to 8-membered ring, with the proviso that when the ring formed by $Z_2$ is a 5-membered ring and one of $X_1$ and $X_2$ is

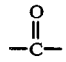

and another of $X_1$ and $X_2$ is

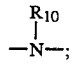

and/or when the ring formed by $Z_3$ is a 5-membered ring and one of $X_3$ and $X_4$ is

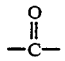

and another of $X_3$ and $X_4$ is

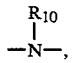

$R_{10}$ is not an aryl group.

2. The processing solution as claimed in claim 1, wherein said 4- to 8-membered ring which is formed with $Z_2$ in formula (II),

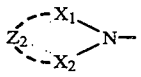

represents an aromatic ring or a ring capable of formally formimg an aromatic ring as a tautomer; and said 4- to 8-membered ring which is formed with $Z_3$ in formula (II),

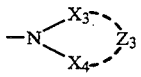

is a non-aromatic ring.

3. The processing solution as claimed in claim 2, wherein said 4- to 8-membered ring which is formed with $Z_2$ or $Z_3$ is a 5-membered ring.

4. The processing solution as claimed in claim 3, wherein said 5-membered ring is a pyrazole ring, a 1,2,4-triazole ring or a urazole ring.

5. The processing solution as claimed in claim 1, wherein said 4- to 8-membered ring which is formed with $Z_2$ in formula (II) is azetidine, azetidin-2-on, pyrrole, pyrrolidine, pyrazole, imidazole, indole, benzimidazole, 1,2,4-triazole, 1,2,3-triazole, tetrazole, urazole, pyrazoline, piperazine, piperidine, morpholine, purine, azepine, ε-caprolactam, 7-pentanelactam, or s-triazine.

6. The processing solution as claimed in claim 5, wherein said 4- to 8-membered ring which is formed with $Z_2$ in formula (II) is a pyrazole ring, a 1,2,4-triazole ring, a 1,2,3-triazole ring or a urazole ring; and said 4- to 8-membered ring which is formed with $Z_3$ in formula (II) is a pyrrolidine ring, a piperidine ring, a morpholine ring or a piperazine ring.

7. The processing solution as claimed in claim 1, wherein said compound represented by formula (II) has a sum total of carbon atoms of not more than 30.

8. The processing solution as claimed in claim 7, wherein said sum total of carbon atoms is not more than 20.

9. The processing solution as claimed in claim 1, wherein $R_{10}$ and $R_{13}$ each is a hydrogen atom, an alkyl group, an alkenyl group, an aryl group, a heterocyclic group, an acyl group or a sulfonyl group and $R_{11}$ and $R_{12}$ each is a halogen atom, a nitro group, a formyl group, a cyano group, a sulfo group, an alkylthio group, an arylthio group, a heterocyclicthio group, a heterocyclicoxy group, a hydrogen atom an alkyl group, an alkenyl group, an aryl group, a heterocyclic group, an acyl group, a sulfonyl group, a sulfinyl group, a hydroxy group, an acyloxy group, an alkoxy-carbonyl group, an alkoxy group, an aryloxy group, an amino group, an alkylamino group, an acylamino group, a sulfonamide group, a ureido group, a sulfamoylamino group, an alkoxycarbonylamino group, a carbamoyl group, or a sulfamoyl group; and R13 is a hydrogen atom, an alkyl group, an alkenyl group, an aryl group, a heterocyclic group, an acyl group, a sulfonyl group, a sulfinyl group, a hydroxy group, an acyloxy group, an alkoxycarbonyl group, an alkoxy group, an aryloxy group, an amino group, an alkylamino group, an acylamino group, a sulfonamide group, a ureido group, a sulfamoylamino group, an alkoxycarbonylamino group, a carbamoyl group, or a sulfamoyl group.

10. The processing solution as claimed in claim 1, wherein said compound represented by formula (II) is represented by formula (II-1):

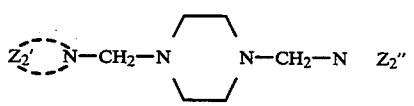

(II-1)

wherein $Z_2'$ and $Z_2''$, which may be the same or different, each represents a non-metallic atomic group necessary for forming a 5-membered aromatic ring or a ring capable of formally forming a 5-membered aromatic ring as a tautomer.

11. The processing solution as claimed in claim 10, wherein said 5-membered aromatic ring or said ring capable of formally forming the 5-membered aromatic ring as a tautomer formed by $Z_2'$ and $Z_2''$ is a pyrazole ring, a 1,2,4-triazole ring, a 1,2,3-triazole ring, or a urazole ring.

12. The processing solution as claimed in claim 10, wherein said 5-membered aromatic ring or said ring capable of formally forming the 5-membered aromatic ring as a tautomer is represented by formula (Z)

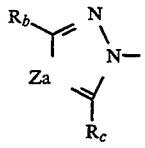

(Z)

wherein Za represents —C(Ra)= or —N= and Ra, Rb, and Rc, which may be the same or different, each represents a hydrogen atom, a halogen atom, a hydroxy group, an alkyl group having a sum total of carbon atoms of from 1 to 3 or an alkylacylamino group having a sum total of carbon atoms of from 1 to 3.

13. The processing solution as claimed in claim 10, wherein Ra, Rb and Rc each represents a hydrogen atom, a halogen atom or an alkyl group having a sum total of carbon atoms of from 1 to 3.

14. The processing solution as claimed in claim 1, wherein said compound represented by formula (II) is contained in an amount of from $1\times10^{-4}$ to 0.5 mol per liter of the processing solution.

15. The processing solution as claimed in claim 1, wherein said processing solution is a processing solution having an effect for stabilizing the dye images formed by color development.

16. The processing solution as claimed in claim 15, wherein said processing solution comprises a bleaching solution, a bleach-fixing solution, a fixing solution, a stopping solution, a conditioning solution, a washing solution, a rinsing solution or a stabilizing solution.

17. The processing solution as claimed in claim 16, wherein said processing solution comprises a stabilizing solution, a conditioning solution, or a bleaching solution.

18. The processing solution as claimed in claim 17, wherein said processing solution is a stabilizing solution.

19. The processing solution as claimed in claim 10, wherein said compound represented by formula (II-1) is

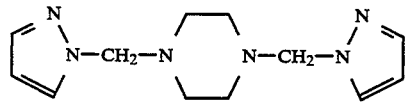

(II-17)

or

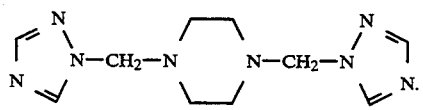

(II-18)

* * * * *